US009401134B2

(12) United States Patent
Baker

(10) Patent No.: US 9,401,134 B2
(45) Date of Patent: Jul. 26, 2016

(54) ACOUSTIC-ELECTRIC STRINGED INSTRUMENT WITH IMPROVED BODY, ELECTRIC PICKUP PLACEMENT, PICKUP SWITCHING AND ELECTRONIC CIRCUIT

(71) Applicant: Donald L. Baker, Tulsa, OK (US)

(72) Inventor: Donald L. Baker, Tulsa, OK (US)

( * ) Notice: Subject to any disclaimer, the term of this patent is extended or adjusted under 35 U.S.C. 154(b) by 0 days.

(21) Appl. No.: 14/338,373

(22) Filed: Jul. 23, 2014

(65) Prior Publication Data

US 2016/0027422 A1 Jan. 28, 2016

(51) Int. Cl.

| | |
|---|---|
| ***G10H 3/18*** | (2006.01) |
| ***G10H 3/22*** | (2006.01) |
| ***G10D 1/08*** | (2006.01) |

(52) U.S. Cl.

CPC ..... *G10H 3/22* (2013.01); *G10D 1/085* (2013.01); *G10H 2220/481* (2013.01); *G10H 2220/505* (2013.01)

(58) Field of Classification Search

CPC ..... G10D 1/08; G10D 3/04; G10D 3/06; G10D 1/085; G10H 2220/465; G10H 3/22; G10H 1/085; G10H 2220/505; G10H 2220/481

USPC ..... 84/726–728, 742, 743

See application file for complete search history.

(56) References Cited

U.S. PATENT DOCUMENTS

| | | | | |
|---|---|---|---|---|
| 1,861,717 | A | | 6/1932 | Pfeil |
| 1,915,858 | A | | 6/1933 | Miessner |
| 2,026,841 | A | | 1/1936 | Lesti |
| 2,239,985 | A | | 4/1941 | Benioff |
| 2,455,575 | A | | 12/1948 | Fender |
| 2,557,754 | A | | 6/1951 | Morrison |
| 2,964,985 | A | * | 12/1960 | Webster ..... 84/723 |
| 2,976,755 | A | | 3/1961 | Fender |
| 3,413,883 | A | | 12/1968 | Helbourne |
| 3,657,462 | A | | 4/1972 | Robinson |
| 3,771,408 | A | | 11/1973 | Wright |
| 3,911,777 | A | * | 10/1975 | Rendell ..... 84/743 |
| 3,916,751 | A | | 11/1975 | Stich |
| 4,180,707 | A | | 12/1979 | Moog |
| 4,254,683 | A | | 3/1981 | Nulman |
| 4,405,832 | A | | 9/1983 | Sondermeyer |
| 4,915,003 | A | | 4/1990 | Clough |
| 4,995,084 | A | | 2/1991 | Pritchard |

(Continued)

OTHER PUBLICATIONS agilent.com, 2004, RF Examples.pdf, from http://cp.literature.agilent.com/liteweb/pdf/ads2004a/dglin/dglin024.html.

(Continued)

*Primary Examiner* — Jeffrey Donels

(57) ABSTRACT

An electric-acoustic stringed instrument has a removable, adjustable and acoustic artwork top with a decorative bridge and tailpiece; a mounting system for electric string vibration pickups that allows five degrees of freedom in placement and orientation of each pickup anyplace between the neck and bridge; a pickup switching system that provides K*(K−1)/2 series-connected and K*(K−1)/2 parallel-connected hum-bucking circuits for K matched single-coil pickups; and an on-board preamplifier and distortion circuit, running for over 100 hours on two AA cells, that provides control over second- and third-harmonic distortion. The switched pickups, and up to M=12 switched tone capacitors provide up to M*K*(K−1) tonal options, plus a linear combination of linear, near second-harmonic and near-third harmonic signals, preamp settings, and possible additional vibration sensors in or on the acoustic top.

22 Claims, 38 Drawing Sheets

© 2014 don baker dba android originals LC

(56) References Cited

U.S. PATENT DOCUMENTS

| | | | | |
|---|---|---|---|---|
| 5,072,646 | A * | 12/1991 | Valkama | 84/726 |
| 5,637,823 | A | 6/1997 | Dodge | |
| 5,682,003 | A | 10/1997 | Jarowsky | |
| 5,929,362 | A | 7/1999 | Oteyza | |
| 5,945,614 | A | 8/1999 | White | |
| 6,046,392 | A | 4/2000 | Saul | |
| 6,162,984 | A * | 12/2000 | Engard | 84/743 |
| 6,194,644 | B1 | 2/2001 | Hendrickson | |
| 6,525,246 | B1 | 2/2003 | Erismann | |
| 6,649,817 | B2 | 11/2003 | Hartill | |
| 6,809,245 | B2 | 10/2004 | Sawhney | |
| 6,911,590 | B2 | 6/2005 | Childress | |
| 6,992,243 | B2 * | 1/2006 | Small | 84/267 |
| 7,002,065 | B2 | 2/2006 | Petersen | |
| 7,060,888 | B2 * | 6/2006 | Spalt | 84/727 |
| 7,141,730 | B1 | 11/2006 | Wu | |
| 7,145,063 | B2 * | 12/2006 | Redard | 84/267 |
| 7,442,865 | B2 | 10/2008 | Moghaddam | |
| 7,453,033 | B2 | 11/2008 | Redard | |
| 7,514,614 | B2 * | 4/2009 | McGrew | 84/291 |
| 7,787,634 | B1 | 8/2010 | Dahl | |
| 8,217,254 | B2 | 7/2012 | Zoran | |
| 2010/0307313 | A1 * | 12/2010 | Zoran et al. | 84/192 |

OTHER PUBLICATIONS

Dave Hunter, The Guitar Pickup Handbook: The start of your sound, 2008, 256 p, Backbeat Books, Milwaukee WI.

B. A. Heaney, 2010, http://digitalviolin.com/Patents.html.

D.L. Baker, 2014, http://www.TulsaSoundGuitars.com/interviews-2/paul-humphrey-february-5-2014.

* cited by examiner

© 2014 don baker dba android originals LC

© 2014 don baker dba android originals LC

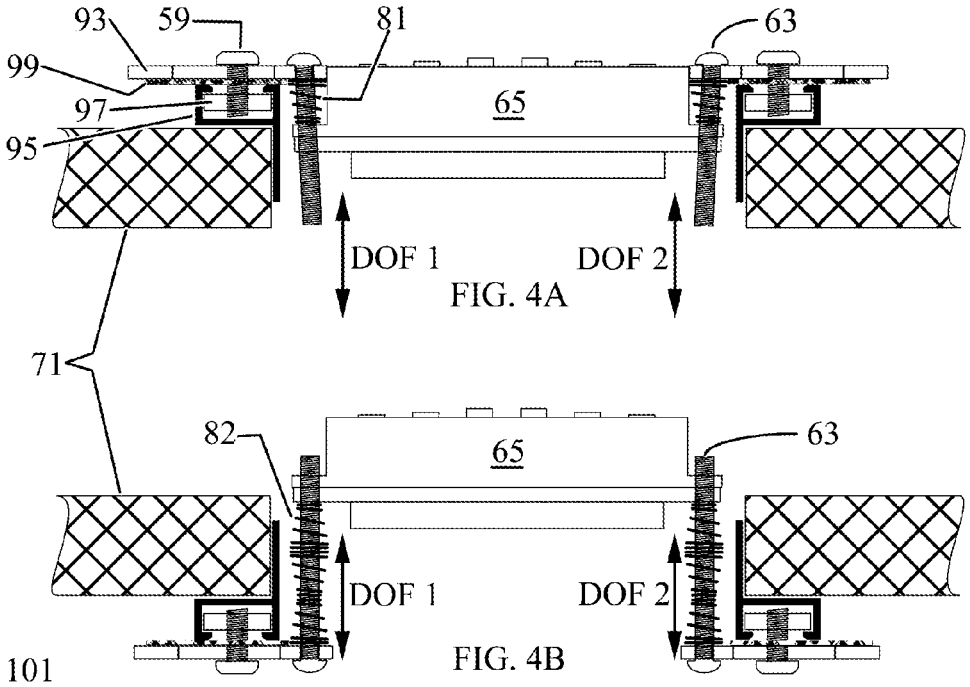
FIG. 4A
FIG. 4B
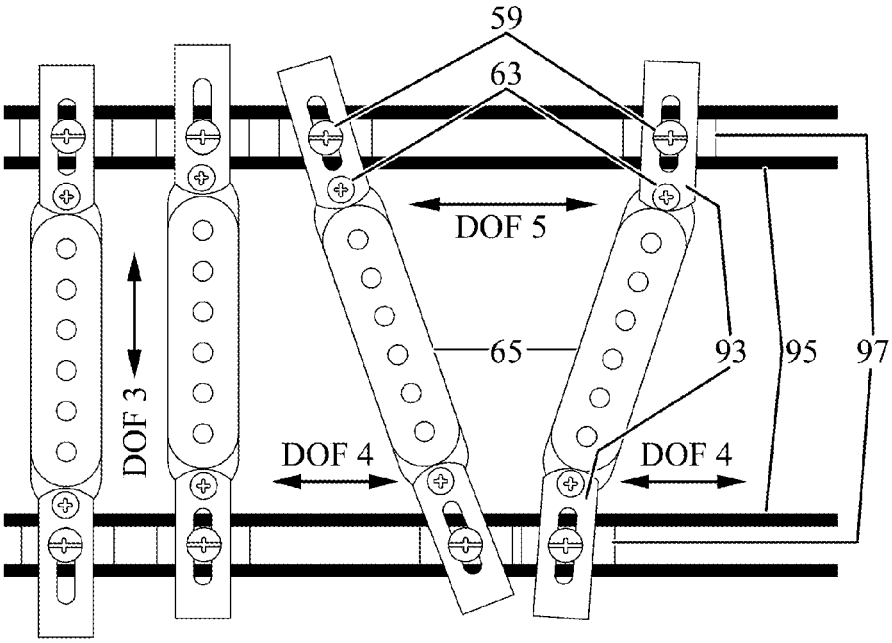
FIG. 5
© 2014 don baker dba android originals LC © 2014 don baker dba android originals LC © 2014 don baker dba android originals LC © 2013 don baker dba android originals LC © 2014 don baker dba android originals LC © 2014 don baker dba android originals LC © 2014 don baker dba android originals LC © 2014 don baker dba android originals LC © 2014 don baker dba android originals LC © 2014 don baker dba android originals LC © 2014 don baker dba android originals LC © 2014 don baker dba android originals LC © 2014 don baker dba android originals LC © 2014 don baker dba android originals LC © 2014 don baker dba android originals LC © 2012-2014 don baker dba android originals LC © 2014 don baker dba android originals LC © 2014 don baker dba android originals LC © 2014 don baker dba android originals LC © 2014 don baker dba android originals LC © 2014 don baker dba android originals LC © 2014 don baker dba android originals LC © 2014 don baker dba android originals LC © 2014 don baker dba android originals LC © 2014 don baker dba android originals LC © 2014 don baker dba android originals LC © 2014 don baker dba android originals LC © 2014 don baker dba android originals LC © 2014 don baker dba android originals LC © 2014 don baker dba android originals LC © 2014 don baker dba android originals LC © 2014 don baker dba android originals LC © 2014 don baker dba android originals LC © 2014 don baker dba android originals LC © 2014 don baker dba android originals LC © 2014 don baker dba android originals LC

ACOUSTIC-ELECTRIC STRINGED INSTRUMENT WITH IMPROVED BODY, ELECTRIC PICKUP PLACEMENT, PICKUP SWITCHING AND ELECTRONIC CIRCUIT

CROSS-REFERENCE TO RELATED APPLICATIONS

This application claims the precedence of the related Provisional Patent Application No. 61/861,800, filed Aug. 2, 2013, by this inventor, Donald L. Baker dba android originals LC, Tulsa Okla. USA.

COPYRIGHT AUTHORIZATION

Other than for confidential and/or necessary use inside the Patent and Trademark Office, this authorization is denied until the Nonprovisional patent application is published (pending any request for delay of publication), at which time it may be taken to state:

The entirety of this application, specification, claims, abstract, drawings, tables, formulae etc., is protected by copyright: © 2013-2015 Donald L. Baker dba android originals LLC. The (copyright or mask work) owner has no objection to the facsimile reproduction by anyone of the patent document or the patent disclosure, as it appears in the Patent and Trademark Office patent file or records, but otherwise reserves all (copyright or mask work) rights whatsoever.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

No Known Applicability

STATEMENTS REGARDING PRIOR DISCLOSURES BY THE INVENTOR OR A JOINT INVENTOR

Not Applicable

TECHNICAL FIELD

This invention relates to the body construction and electronic design of stringed instruments, including guitars, sitars, basses, viols and in some cases pianos, including the areas of:

1. construction of sound boards on stringed instruments and control of their artistic and acoustic properties (84/267);
2. adjustable positions of electromagnetic transducers (84/276, 84/723, 84/726, 84/727);
3. the construction of bridges and tailpieces (84/298, 84/299, 84/307);
4. the control of the timbre of electromagnetic transducers by means of position placement, combinatorial switching and analog signal processing (applicable to any instrument that generates electronic signals) (84/723, 84/726, 84/735)

BACKGROUND ART

The Perfect Guitar

In the current state of the art, stringed instruments are basically fixed in shape, appearance and function at the time of manufacture or construction, with little or no ability to make radical or even substantive changes to those properties within the guitars themselves. At most, commonly available instruments can usually change appearance only by refinishing the surface or using appliques (U.S. Pat. No. 6,649,817) (or recutting the body, if solid), and change the quality of sound only by changing the strings and/or electronic pickups and circuits (if electric). It has been written that some blues players screwed soda bottle caps loosely to their acoustic guitars to create a harsher sound, which would horrify a classical guitarist. Electric guitarists commonly change their sound with exterior electronics, from mechanical reverberation to buzz boxes to digital audio processors. All [are] subject to the artist's taste, and artists may spend hundreds to thousands of dollars to find their perfect guitar, which often is reserved for just one of the styles of music and visual presentation the artist employs.

Pickups: Mounting and Adjustment

Note that the use of electric violins reportedly goes back to the 1920s (see http://en.wikipedia.org/wiki/Electric violin), and U.S. patents for electric violins go back to at least 1932 (see http://digitalviolin.com/Patents.html), for example U.S. Pat. No. 1,861,717, which included an electromagnetic bridge pickup and a skeletonized body. As early as the 1933 (U.S. Pat. No. 1,915,858), Miessner patented an electromagnetic pickup based upon a set of wire coils picking up the vibrations of strings near the static magnetic fields of a number of pole pieces. In 1936 (U.S. Pat. No. 2,026,841, Re20070), Lesti recognized that combining coils of opposite polarity would cancel out extraneous magnetic fields, later called humbucking, but used no permanent magnets in his pickup design. In 1948 (U.S. Pat. No. 2,455,575), Fender patented a pickup based upon the same physics as Meissner's, with a single coil. In 1951 (U.S. Pat. No. 2,557,754), Morrison patented a single-coil, six-pole guitar pickup little different from those seen on guitars today.

As early as 1961 (U.S. Pat. No. 2,976,755), Fender recognized that two single-coil pickups with permanent magnets of opposite magnetic polarity could be placed close together to cancel picking up exterior hum. Note that side-by-side coils in a humbucker produce a double-dipole field tends to reduce the reach of the field to the strings. Many other patents have followed but are incremental changes (Dave Hunter, The Guitar Pickup Handbook: The start of your sound, Backbeat Books, Milwaukee Wis., 2008; not a critical reference, since this patent does not cover a new type of pickup) to the three main types of electromagnetic pickup commonly sold today: the single-coil pickup, the humbucking pickup with two side-by-side coils, and the humbucking pickup with two stacked coils. The single-coil pickup tends to be the simplest, cheapest and easiest to produce, and can be made at home. Other pickups include piezoelectric, capacitive, light beam-interrupting LED and microphonic.

In most if not all electric guitars on the market today, including unfinished bodies for custom or home construction, have pickups placed in set positions, with at most two degrees of freedom in adjustment from those positions. The typical electromagnetic pickup can only be adjusted up and down at each end. Wright (U.S. Pat. No. 3,771,408, 1973), claims multiple mounting points for pickups, with three times as many pickup mounting holes as the usual electric guitar, but merely shows three separate pickups in FIG. 3, filling all the mounting holes, making no other claim of adjustability. Another (U.S. Pat. No. 4,254,683, 1981), allows up and down motion on just one axis, with horizontal motion between the neck and bridge.

Redard (U.S. Pat. No. 7,145,063 B2, 2006; U.S. Pat. No. 7,453,033 B2, 2008) has one of the most complicated pickup mounting and positioning systems, offering at most three degrees of freedom in positioning. Pickups in the system below the strings (2006) move in one degree of freedom between the bridge and neck, mounted on a set of parallel rods, with adjustment screws specified to adjust the distance between the strings and pickups. Both patents specify another pickup situated over the strings, rather inconveniently for anyone who wishes to pluck or strum them, moving on a track or bar parallel to the strings, rotating in angle across the strings with a vertical elevation adjustment above the strings, allowing three degrees of freedom in position. While horizontal angular rotation above the strings changes that orientation over the strings, it does not allow for alignment of the poles across the strings. It can be rotated away from string 1, the treble string, so that the pickup cannot appreciably detect string 1 vibrations, without any means to correct it.

U.S. Pat. No. 7,453,033 can claim four degrees of freedom, with adjustment screws at the ends of the pickup. In U.S. Pat. No. 7,145,063, FIGS. 8 and 9 show an apparent double-coil pickup, shown explicitly in U.S. Pat. No. 7,453,033, FIG. 3B, which is too far above the strings to reliably detect their vibrations, especially for the double-dipole field of that kind of pickup, which falls off faster with distance than a single-coil pickup.

Spalt (U.S. Pat. No. 7,060,888, 2006) has a single pickup that rotates horizontally about a fixed point under and beside the strings, allowing at most two degrees of freedom, if it also rotates slightly in the vertical, or can be adjusted vertically with washers on the pivot bolt.

Electric Stringed Instrument Bodies, Especially Guitars

In the area of body design, today's guitar market is dominated by acoustic guitars of standard design (some of which have electric pickups and amplifiers), electric guitars with solid bodies and electric guitars with hollow bodies with wall and soundboard construction which is considerably thicker and stiffer than acoustic instruments. Steel and resonator guitars might be considered a subtype of either acoustic or electric, depending upon amplification. Other non-acoustic stringed instruments, such as autoharps, and lap steel guitars comprise a small minority.

Some U.S. patents which address body improvements that either radically change the appearance of an instrument or allow an instrument's appearance to be radically changed fall into some general groups: skeletal or wire-frame bodies (U.S. Pat. Nos. 2,239,985, 3,413,883, 3,771,408); and modular bodies (U.S. Pat. Nos. 3,657,462, 4,254,683, 4,915,003, 5,637,823, 5,682,003, 5,929,362, 5,945,614, 6,046,392, 6,194,644, 6,525,246, 6,809,245, 6,911,590, 7,002,065, 7,141,730, and 7,442,865). Of the modular bodies, the large majority have a core section with the neck, strings, pickups (if any), bridge and tailpiece (if any), where the body attaches in one or more sections, with or without electronics.

One interesting variation (McGrew, U.S. Pat. No. 7,514,614, 2009) has a skeletonized body with an adjustable sound board, connected to the body of the guitar at only three points. However, the soundboard is constructed in several layers, including a single "large magnetic transducer", impeding any vibration of the soundboard that could contribute to the sound of the instrument. The lever effect of McGrew's neck adjustments decree less effect on bridge tilt than vertical adjustments in line with the bridge. McGrew has no options for multiple sensors, adjustable in position.

Zoran (US-2010/0307313 A1, 2010; U.S. Pat. No. 8,217,254 B2, 2012) describe a semi-skeleton body with a soundboard top and electronics plugging into a central cavity. That soundboard has an electronic plug at the neck end and two points of suspension at the edges in line with the bridge, apparently held in place with string pressure. It has no vertical adjustments at the edges to counteract sag in the soundboard. Zoran describes sensors in the soundboard to pick up different modes of vibration. The soundboards of both McGrew and Zoran are limited in size and shape to the central body cavity. They cannot be further decorated or shaped or stressed to change the look of the entire guitar, or the major modes of vibration. Zoran's instrument in particular requires a level of manufacturing resources and expertise that precludes any major physical modifications by a kit builder in search of personal expression.

Electric Stringed Instrument Signal Amplification, Control and Modification

Although in this invention pickups may be mounted under the soundboard/top, through it without touching, or upon it, mounting pickups under it drives the need for an electronic pre-amplifier in the stringed instrument, as the detected string vibration signal will be smaller, due to the increased distance from standard pickups to the strings. Since many musicians who play electric stringed instruments also use external fuzz boxes, it makes sense to include such a feature in the preamp. In this regard, U.S. pat. No. 4,1800,707 (1979), U.S. Pat. No. 4,405,832 (1983), U.S. Pat. No. 4,995,084 (1991) and U.S. Pat. No. 7,787,634 (2010) seem to be the most relevant.

Moog's circuit produces "hard" and "soft" clipping to get third and higher order odd harmonics by overdriving a semiconductor transconductance amplifier, intending to replace vacuum tube circuits. It obtains even harmonics, intending to produce asymmetric waveforms, by using the same transconductance amplifier as a "squaring" element to generate "soft" even harmonics, and by a full-wave rectifier to generate "hard" even harmonics. Combinations of which could be mixed with the linear fundamental signal. Except for the more extremely asymmetrical signals with even harmonics, the linear fundamental predominated. The circuit largely maintained the character of the signal with automatic gain control, or AGC.

Sondermeyer's circuit is a simple diode clipper, which adds odd order harmonics, with a potentiometer output which varies continuously between the linear fundamental linear signal and the clipped signal, with some additional band-shaping. In simulation, Pritchard's analog distortion circuits produce various types of asymmetric clipping, with the linear fundamental signal tending to predominate over the harmonics.

U.S. Pat. No. 7,787,634 (Philip Young Dahl, 2010 Aug. 31) would seem to interfere the most with the electronic circuit presented here. The basic designs used both here and in Dahl's patent use concepts known in other fields, such as microwave and laser communications, as "analog predistorters", which date back to at least the 1980s. For example, RF Examples.pdf, circa 2004, from http://cp.literature.agilent-.com/litweb/pdf/ads2004a/dglin/dglin024.html, speaks of using anti-parallel diodes and biased diodes to generate Cubic Law and Square Law signals which are used for "eliminating the fundamental".

Dahl's patent deals only with distortion emphasizing the third harmonic. It controls the ratio of the fundamental and third harmonic in the output primarily by changing the amplitude of the input signal before clipping by anti-parallel diode pairs. The remixing of the non-linear signal with the inverse of the linear signal to produce the third harmonic occurs only at a fixed gain. It does not then remix the third harmonic with the linear signal to produce a continuous range from the linear to the third harmonic to a predominately inverse linear signal after generation of the third harmonic. Nor does it attempt to generate any second harmonic signal.

Nor does it reduce the concept to its simplest terms using the simplest circuit, which can be demonstrated with an analog signal block diagram and associated equations, and which will predict the widest possible range of results, including emphasizing the second harmonic. It offers the puzzling term "non-limiting clipping", which would seem to be a contradiction in terms.

SUMMARY OF INVENTION

This invention intends to provide a platform, a common canvas, for combining musical expression and visual art in a stringed instrument that is easy and practical to modify, manufacture and repair, even in a home garage shop. It began and grew from a desire to create a simple, lightweight guitar with a skeletonized body, using a neck and one or more pickups from a used guitar. The pickups are intended to be moveable in five degrees of freedom to any place, level and orientation between the neck and bridge. A thin removable, soundboard-top, was designed and intended for the placement of artwork on a guitar, such that it could be embellished either by hand or on a flatbed digital printer. The pickups could be mounted either on it or under it, providing a surface uninterrupted by them. A removable back, also separate of the size and shape of the guitar, would allow access to pickups and electronics, and could be shaped to the user's anatomy and playing style, with such things as the belly-cut often found in solid-body electric guitars. It allows the musician to change how the body of the instrument looks, feels or sounds, piecemeal, without the expense of buying an entirely new instrument. It allows the user to choose and switch the pickups, and change the individual physical placement, height and orientation of the pickups between the neck and bridge. It allows a choice of up to 12 different tone capacitors or none, and choice of linear or a range of distorted outputs via onboard amplification. With currently-available switches, it can produce up to 12 different series and parallel connected humbucking pickup outputs from four single-coil pickups. Electronic distortion control provides continuous mixing of the output signal among the first, second and third harmonics of the resulting guitar signal. Between that and 144 different pickup and tone capacitor switch combinations, it has enough range in timbre to allow a musician to generate outputs commonly perceived (see language example of U.S. Pat. No. 4,180,707, Moog, 1979, cols 1 & 2) as varying from the warm, mellow tones of jazz to the harsh tones of metal (http://www.tulsasoundguitars.com/interviews-2/paul-humphrey-february-5-2014/). The thin and resonant soundboard-top and bridge, which is cantilevered above the body, produces enough acoustic output to allow quiet practice without electronic amplification. Two different embodiments of tailpiece design offer a choice of a larger cantilevered area of soundboard-top, to allow for more resonance and acoustic output, or a top fixed firmly to the body below the bridge, to allow for a larger stable area for electronic control placement.

Technical Problems Found and Resolved

In development through several prototypes, various problems and solutions presented and suggested themselves, leading to a more complicated instrument. All the prototypes used commonly-available necks, tuners, strings, electrical switches, electronic and mechanical parts, and inexpensive single-coil pickups. The first prototype had a single movable pickup, no soundboard and broke under string pressure. The second had a volume control, two fixed pickups and a two-piece Masonite top, cut and painted in the shape of a barbed axe. Eventually two switches were added to provide serial and parallel outputs, with a 12-pole choice of eight tone capacitors, no capacitor, or three types of diode clippers.

The third prototype worked, but was heavy and ugly with pickups that could not be adjusted with the soundboard on. The fourth prototype is lighter, but still heavy, allows its four single-coil pickups to be adjusted by removing the bottom cover, and has an active electronic pre-amplifier and distortion circuit driven by two AA cells. It has 10 different serial and parallel humbucking outputs, a choice of 11 different tone capacitors in parallel with the pickups with either resonant peak or roll-off frequencies spanning almost three octaves, and a choice of linear or distorted signal, with a distortion control pot, for a total of 240 switch positions, plus a volume pot.

The woodworking shop power tools have been limited those such as a drill press, Dremel tool, Foredom flexible shaft machine, miter saw, table saw, scroll saw and router table. This required an emphasis on manufacture and repair at the level of a home garage shop, especially using router templates and glued layers with alignment pins. Which broadens the range of possible production to custom, production and kit models, including models with bodies constructed from paper plans, where the neck, musical hardware and electronics are purchased separately.

In the process of this development, several things became apparent. In order to produce the most string response and acoustic output, a removable top could be fixed to the body only at a few and widely separated point contacts. In the third and fourth prototypes, this resolved to two at the neck and four in line with the bridge, with the tail end of the body held down by a hinged tailpiece under string pressure.

In order to put the pickups as close as possible to the strings, while underneath the soundboard, and to account for any sag in the soundboard under string pressure, the soundboard has to be adjustable in height above the body at both the neck and bridge line. At the bridge line, this resolved to two screws at the edge of the body holding the soundboard down on two flathead screws slightly closer to the bridge. At the neck, this resolved to two screws close to the base of the neck holding the soundboard to two narrow-diameter columns, made up either of metal rods of adjustable height, or a stack of small washers. The bridge on the third prototype was an inexpensive metal stop tailpiece with adjustable intonation on each string. Because a loose metal bridge part on it produced string rattle, the fourth prototype used a shaped and filed wood bridge on an artwork base spacer, with set screw intonation adjustments at the ends of the bridge.

The second prototype used a 6 mm Masonite soundboard, and the third and fourth used 6 mm, 3-ply Luaun plywood from a large chain home supply store, simply because they are inexpensive, sturdy and readily available. Other than the bridge, bridge base and bridge line screw plates on the fourth prototype (including a thin brass plate under the bridge to solder-mount the screws holding the bridge and base down, the soundboards have no tuning or reinforcing ribs like thinner acoustic instrument soundboards. For one thing, that would defeat the option of putting the pickups as close to the soundboards as possible. Yet the sounds they produce are credibly musical. Many other materials and composites are possible, such as, fiberglass, carbon fiber, metal, and Nomex or aluminum honeycomb. Perhaps wood with carbon fiber inlayed into the top as both reinforcement, acoustic control and visual art. Even soundboards with integrated vibration sensors to replace electromagnetic pickups. It promises a new field of design and experimentation.

The first and second prototypes had no adjustable soundboards and used commonly-available adjustable, non-tremolo metal bridges. As noted, the third and fourth prototypes, with removable and adjustable soundboards, used hinged tailpieces to hold down the tail of the soundboard and allow it to shift with bridge line elevations. The wooden tailpiece for the third prototype demonstrated that strings could rattle in the exit slots of the tailpiece, which had to be large enough to pass the string wraps securing the string-end button to the string. This required a strip of hardwood to be added to the bridge end of the tailpiece to confine the strings to narrow slots passing non-wrapped string diameter. In the fourth prototype, the tailpiece eliminated string rattle by canting the exit slots off the line from the button to the bridge, so that the strings would bear on one side of each slot.

The first prototype mounted a single single-coil pickup mounted by standard springs and screws to a narrow plate, which itself mounted, by screws and slots in its ends, to smaller plates sliding in modified Nielsen-Bainbridge™ aluminum picture frame moulding mounted to the skeleton body, providing placement anywhere between the neck and non-tremolo bridge in a range of height, and angular and cross-string orientations, beneath the strings. In the third and fourth prototypes, two smaller plates replaced the single plate. They each had a single hole for the spring-and-screw pickup mount and a slot for the slide screw. They allow a narrower body cavity than the single plate pickup mount. But in practice, using slides in a picture-frame track proves to be difficult to easily align with just two hands. So this invention also specifies a set of fixed mounting points on the body, parallel to the strings, with threaded holes placed in alignment with virtual fret positions, extended from the neck towards the bridge, along with a virtual fret scale inscribed in the body to index pickup mounting positions and orientations.

The second prototype with fixed-position pickups produced pickup from body microphonic noise and required acoustic insulation in the pickup mount using a felt material. In the third and fourth prototypes, cork and rubberized auto gasket material were used on the contact points of the small mounting plates between the pickups and the slides. The soundboard vibrates more freely of the body compared to standard acoustic instruments, where the soundboard is rigidly attached about its circumference to the body. Because of this, this instrument is more subject to acoustic feedback and ringing when placed in front of a large amplifier-speaker set. Placed in front of a small amplifier, it may produce a more pleasing reverberation. This reverberation, noted in a Paul Humphrey interview video (cited above), may also be due to some loose added windings to three of the four single-coil pickups.

Using inexpensive single-coil pickups to make up humbucking pairs required that the coil turns be matched. A signal generator driving a large solenoid coil with two pickups connected in series and opposing inside. Testing each pair combination of coils together this way determined the relative order of sensitivity to outside magnetic fields. Turns were added to each of the three weaker coils until their signals sufficiently cancelled the stronger coil. Even using a do-it-yourself turning machine, these additional turns tended to sit loose upon each pickup, and were held down with covers of electrical tape to avoid excessive microphonics.

The inexpensive, ceramic magnet, single-coil pickups tended to all have the same magnetic polarity at the upper pole ends, usually North-up. A very strong rare-earth magnet, rubbed back and forth over the ceramic magnet, reversed the field on two of the four pickups used to South-up, but perhaps not to the same level of intensity as before. Because of this and the relative weakness of the pickup magnetic field at the strings, when mounted below the soundboard as opposed to on it, sets of small rare-earth magnets were added to the ceramic magnets to boost the pickup fields. This patent does not preclude mounting the pickups on the soundboard, or pushing up through holes in the soundboard, to put the poles nearer the strings for a stronger signal. But making pickup holes in the soundboard should be delayed until the preferred pickup placement has been found. This can be done with a half-soundboard that does not extend between the bridge and neck, leaving the pickups uncovered and the strings resting on the bridge.

Noise pickup from fluorescent lights also required that the back-bottom cover have a grounded sheet metal plate, that the pickups be covered with grounded aluminum foil under the soundboard, that the strings be electrically connected together at both ends and grounded through the tailpiece, and that the electronics and controls be mounted either on or under grounded metal plate. Ideally, electrostatic shielding shall be integral with the soundboard, body and bottom cover to completely shield the pickups and electronics.

In the fourth prototype, the electronic controls and batteries were mounted on sheet metal plates to either side of the hinged tailpiece, with a narrow section of soundboard under the tailpiece between them. The electronics circuit board was mounted to the pickup tracks in the body cavity under the soundboard. A piece of aluminum flashing, shaped to the tail of the soundboard, was grounded and mounted under the soundboard to provide shielding.

This arrangement, expedient for possible changes in the electronics and controls, restricted the size and shape of the soundboard from the bridge to the tail. It has been abandoned in the patent plans for the fifth prototype, which specifies a soundboard rigidly mounted to the circumference of an electronics compartment, with controls in the compartment mounted to the soundboard, so that the controls do not appreciably affect the acoustics of the soundboard. This soundboard can be expected to have less acoustic output, but is still free to vibrate from the bridge to the point contact mounts at the neck. The body cavity has a cut-away section under the bridge to facilitate soundboard vibration. The tailpiece on the planned fifth prototype has been changed to a solid-mount, non-hinge type and moved nearer the bridge, giving the electronics compartment more room for controls. Thus the strings do not pull on the tail end of the electronics compartment, allowing it to be made of thinner and lighter materials. This also shortens the more massive section of the body bearing string loads, to reduce body weight.

Ultimately, the pickup switching system derives from a simple circuit with a DPDT switch which switches two pickups from parallel to serial connections, with the in-phase lead of the pickup with the North pole up (N-up) connected to one terminal of the output, and the out-of-phase lead of the S-up pickup connected to the other terminal of the output. The Figurers in the following Drawings section show this to best effect. The fourth prototype uses two 4P5T lever-operated "superswitches", sold by music parts houses to replace the 5-way switch commonly used in electric guitars. The simple circuit was doubled for this prototype, allowing four dual-pickup humbucking and one quad-pickup humbucking circuit for both parallel and serial connections.

In each of these configurations, an N-up pickup is always paired with a S-up pickup. Later, it became apparent in wiring a 3-pickup Fender Strat™ for five humbucking pair outputs using a lever Superswitch, and then a six using a 4P6T rotary switch, that it is possible to get outputs for opposing-phase (out of phase or contraphase) humbucking pairs by connecting two pickups with the same pole up. For this, the simple circuit must be abandoned for all but two of the pickups, with opposite poles up, requiring two switch poles for each of the other pickups. This configuration naturally tends to minimize the fundamental signal, leaving it with significantly higher levels of harmonics, which is commonly perceived as either a hard rock or metal music sound. If instead, the switching is wired to produce quad-pickup humbucking outputs, the signal will have lower amounts of higher harmonics and be perceived as warmer and much like an acoustic instrument.

Eventually the switching network becomes more complicated than available physical contact switches can easily provide. For this reason, this patent specifies in FIG. 30, as an example for a four pickup circuit, a 6P6T switch for a with an inexpensive plug-in printed circuit board with solderable cross-point connections. With one switch and a number of differently connected cross-point plug-in boards, the full possible timbre range of the instrument can be covered. A jazz player might want all the switch positions to be series-connected humbucking circuits, pair and quad, for warm mellow tones. An acoustic player might want mostly quad-connected humbucking circuits. A metal rock player might want mostly contra-phase connections and parallel-connected pairs using pickups near the bridge to emphasize the higher harmonics.

The electronic distortion circuits specified here derive from combining the biased-diode circuit used in the fourth prototype with a circuit installed in a Fender Bullet™ guitar near the beginning of 2008. The Bullet circuit used an anti-parallel diode pair to generate a signal with a logarithmic transfer function (much like Dahl, 2010), and used the inverted linear signal to bend that curve down into a quasi-cubic transfer function that emphasized the third harmonic over the linear. At a certain signal level it inverted the signal peaks to form clipping, like an over-driven tube amplifier. At higher levels of distortion, determined by a pot, it pushed the peaks down past the signal zero crossings, creating a harsh sound more useful metal rock. The second harmonic is generated from a biased-diode signal, which is similarly warped into a quasi-quadratic transfer function.

The circuit shown in FIG. 49 was designed specifically to generate, for one level of input determined by the setting of the preamplifier Gain, three nearly equal and separate signals of the fundamental linear signal, its second harmonic and its third harmonic. These are then linearly recombined into an output signal, first by combining the second with the third harmonic, then by that combination with the fundamental linear signal. This required a 3-deck potentiometer, with some complicated cross-calibration, but this can be and has been eliminated by splitting the functions for generating second and third harmonics into separate circuits, which are separately calibrated to a given level of input signal.

BRIEF DESCRIPTION OF DRAWINGS

More Details in the Description of Embodiments

FIG. 4A-B—Details of an alternative track and slider pickup mounting system with flat mounting plates, showing the two degrees of freedom (DOF) of movement common to almost all electric guitars.

FIG. 5—Details of the alternative track and slider mounting system showing the three additional DOF available.

FIG. 13—FIG. 1 with the neck removed and the bottom cover added, showing the neck mounting area on the core profile, the prototype electronic circuit board position, and the bottom cover electrical shielding under the pickup and electronic cavities.

DESCRIPTION OF INVENTION AND EMBODIMENTS BY MEANS OF FIGURES

Figure 1:
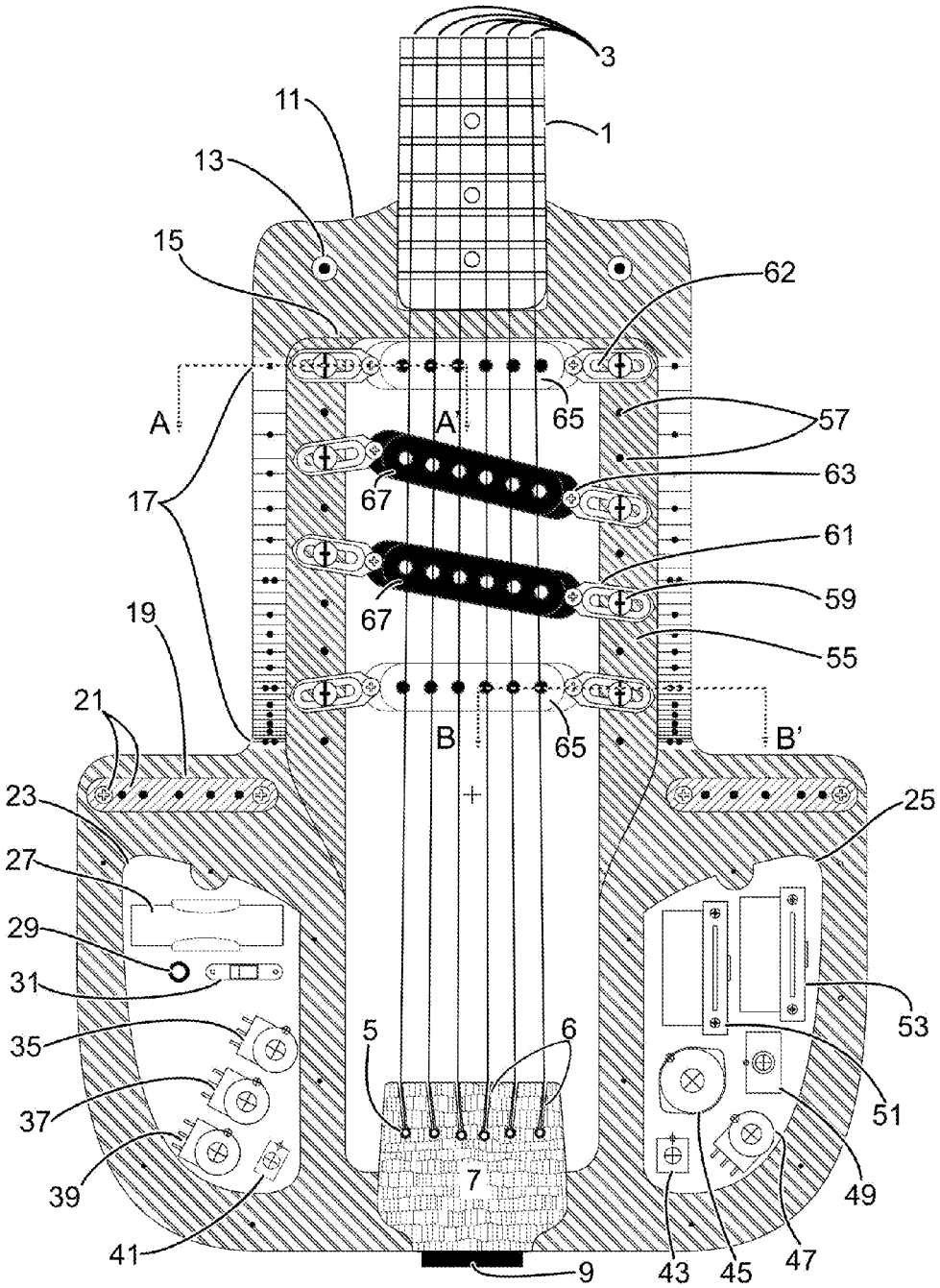
FIG. 1—Skeleton body with pickup mounting system, showing four single-coil pickups, two south pole up and two north pole up, positioned under the strings along three octaves of extended fret marks.

FIGS. 1-5 Describe Body Improvements, Including the Pickup Mounting System To illustrate the pickup mounting system, FIG. 1 shows the 4th prototype with the soundboard (69, FIG. 2) removed and the upper profile (11) visible. The neck (1), strings (3), string buttons (5), tailpiece (7) and tailpiece hinge (9) show how the pickups (65 North up, 67 South up) can line up under the strings in the pickup cavity (15). The pickups are attached to mounts (61) with height adjustment screws (63) and springs (81, 82 FIG. 2). The mounts have slots (62) for mounting screws (59).

In this embodiment, the mounting screws are threaded into holes (57) in the body in a deeper relief cut (55) below the top of the upper profile. They can also be threaded into slides (97, FIG. 4A) fitted into tracks (95, FIG. 4A). This arrangement allows both the pickup and mount to pivot and slide so as to provide three more degrees of freedom (FIG. 5) in adjusting pickup position under the strings. The holes (57) are positioned in sufficient quantity and places that the pickups can reach every position in between by moving the mounts.

Extensions of the neck fret scale (17), up to three octaves, are inscribed on the left and right of the upper surface of the body (11) to help in positioning the pickups from the neck to the bridge (not shown, but in line with 19 and 21), according to whatever musical theory or preference the musician has. Theoretically in Western music, the fret scale extends from the first fret or nut at the head of the neck to the bridge, in steps such that each fret closer to the bridge by $2^{-1/12}$ times the distance to the fret next to it between it an the head of the neck. If the neck is not fretted, then the fret scale still exists as imaginary lines, or finger positions. The physics of actual vibrating strings causes deviations requiring adjustments called intonation.

Frets are numbered by integers increasing from head of the neck to the bridge. At the bridge, the theoretical fret number is infinity, because the frets decrease in spacing from the head of the neck to the bridge in this mathematical progression. In this embodiment, the neck end of the fret scale on the body starts with fret line 24, the second octave from the head, and extends three more octaves to fret line 60 near the bridge. It allows one to do things like pick 5th, 7th and 12th root spacings between the pickups, or between the midpoints of humbucking pairs. Or to set up atonal spacings for metal rock music.

In other features in FIG. 1, the screw plate and mounting screws for the soundboard adjustments at the bridge line (FIG. 11) sit in cavities (19) in the upper profile. The left electronic cavity (23) contains the battery pack (27), the LED power indicator (29), the DPDT slide switch for the batteries (31), the Bias (35), Warp (37) and Mix (39) pots, and the Tube-Metal switch (41). These will be explained in FIGS. 29 A&B. The right electronics cavity contains the DPDT Linear-Distortion switch (43), the rotary 1P12T tuning capacitor switch (45), the volume pot (47), the 4PDT series-parallel switch (49 and FIG. 28), the 4P5T lever switch for series connections (51 and FIG. 26) and the 4P5T lever switch for parallel connections (53 and FIG. 27).

Figure 2:
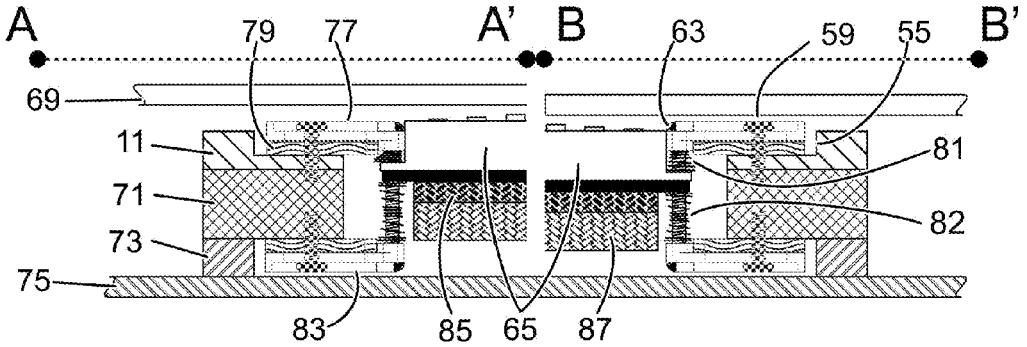
FIG. 2—Details of pickup mounting system showing how the pickups are secured to the body by mounting screws, slotted mounts with sound-absorbing material, adjustment screws and springs. Both top and bottom mounting systems are shown.
Figure 3A:
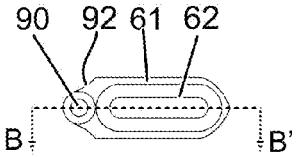
FIG. 3A-E—Details of the pickup mounts used in FIGS. 1 and 2.
Figure 3E:
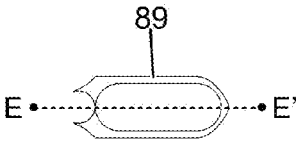
Figure 3B:
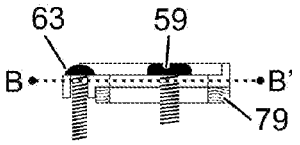
Figure 3D:
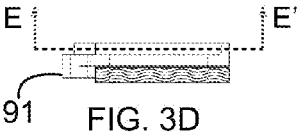
Figure 3C:
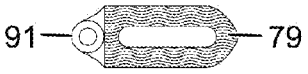

Depending on what one deletes from the drawing, FIG. 2 shows the basic arrangement of three possible mounting arrangements for the pickups in their body cavity, top mount, bottom mount and a combination top-bottom mount. Sections AA' and BB' from FIG. 1 show the pickup mounting for different heights of the soundboard (69). Each one shows the pickup (65) mounted below the soundboard, just far enough away to avoid contact. Other pickups are possible, but this one shows a ceramic magnet (85) style with a booster magnet (87) attached.

The pickup is attached to the top mount plate (77) or a bottom mount plate (83) with (non-magnetic) height adjustment screws (63), held in place by either top mount springs (81) or bottom mount springs (82). Should even more rigidity be desired, both mounts could be used. The mounting screws (59) hold the mounts to threaded holes in the body (11 upper profile, 71 core profile, 73 lower profile). Acoustic insulating pads (79) on the mount plates are required to reduce or avoid microphonic feedback. In this case, the mounts set in a relief cut (55) in the upper profile (11), but another design might have a complete removal of the upper profile in that area to mount directly on the core profile (71).

The profiles themselves are only a convenience to allow routing standard thicknesses of wood in the fourth prototype. Any suitable material and method of molding, subtractive machining or additive construction can be used. The same applies to the soundboard and bottom cover (75).

FIG. 3 shows details of one design of the mounting plate. Basically, the mount is a flat plate with a hole (90) to pass or threaded for the pickup height adjustment screw (63), a bevel or cutaway (92) to allow the mount to rotate on the screw hole against the pickup, a slot to pass the mounting screw (59) through to fix it to the body, and a sound-absorbing acoustic pad (79) to avoid microphonic feedback to the pickup. This figure shows possible embellishments to reinforce the mount, a ridge (89) around the mounting screw slot and a collar (91) around the adjustment screw hole. Section BB' goes vertically through the long axis of the mount, and EE' horizontally through the center of the ridge (89). Any suitable non-magnetic material or construction process can be used to make it. The fourth prototype actually uses ⅛ inch aluminum plates with two layers of gasket material for (79).

FIGS. 4 & 5 show an alternative track mounting system for pickups, as well as the five degrees of freedom of pickup movement that either mounting system allows. The pickup (65) is attached to the flat mounting plate (93), with a sound-absorbing layer (99), by height adjustment screws (63). Springs (81, top mounting; or 82 bottom mounting) hold the pickup in position. The flat mounting plate is secured to a non-magnetic track (95) by the mounting screw (59) screwed a non-magnetic slide (97) captured in the track. The track is secured to the body (71) on either the top (FIG. 4A) or the bottom (FIG. 4B). The height adjustment screws provide a degree of freedom of vertical movement at each end of the pickup (DOF1, DOF2). The third prototype used the top mounting system in FIG. 4A, while the fourth prototype used the bottom mounting system in FIG. 4B.

FIG. 5 shows how moving the mounts on the mounting screws in the in their slots and pivoting the mounts on the height screws produces movement perpendicular to the slots between them (DOF3), and along the slots at each end of the pickup (DOF4, DOF5). In this manner, the pickups can be placed anywhere along the length of the track which can extend from the neck to the tailpiece, as it did in the third prototype. However, pickups placed between the bridge and tailpiece may tend to have little if any contribution to the output signal.

FIGS. 6-22 Describe Improvements to the Soundboard, Bridge and Tailpiece

Figure 6:
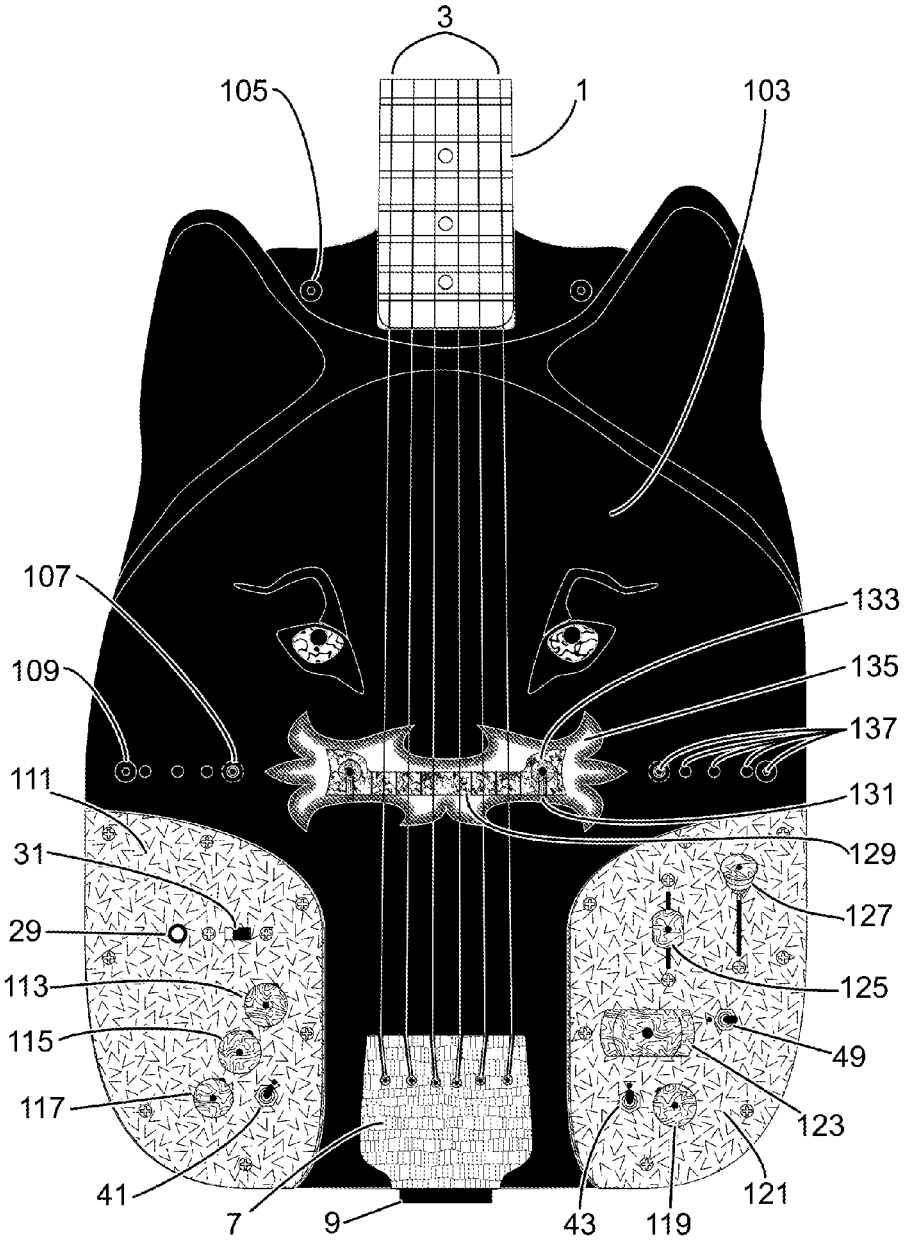
FIG. 6—Top view of the fourth prototype instrument, showing the artwork (Wolf Head) soundboard, top mounting and adjusting screws, adjustable bridge, bridge base, control mounting plates and knobs, neck, strings and tailpiece. Some knobs are conceptual, not appearing on the prototype as drawn.

FIG. 6 shows one concept of an artwork soundboard, a black wolf's head, used on the fourth prototype, which also has good acoustic output. The soundboard (103) wraps around the neck (1), where it is secured to the body by just two machine screws (105), threaded into raised posts (13, FIGS. 1 & 7) directly, or with spacers (139, FIG. 7)) on top of the posts. Strings (3) pass over the bridge (129) to be secured in the tailpiece (7), which is attached to the body by hinge (9). The height of the soundboard at the bridge (129) is adjusted by flathead screws (107) below the soundboard, secured and tensioned by bolts (109) with heads above the soundboard. Holes (137) in the soundboard provide both passage for the top tensioning screws and for an allen wrench or screw driver to reach the flathead screws. The screws (107, 109) thread into the screw plates (21, FIG. 1).

The bridge sets on a decorative base (135) which also sets the bridge height by its thickness. The bridge has slots (189, FIG. 11A) through which non-magnetic screws (189, FIG. 11A) with turning knobs (133) pass to tighten and secure the bridge and its base to the soundboard. Set screws (131) threaded into the bridge bear against these screws to set the position and angle of the bridge with respect to the imaginary line corresponding to the base length of the strings from the nut of the neck, where the fret number is effectively infinity.

For the sake of ease of access to the electronics during prototype testing, the controls are mounted on a left plate (111) and a right plate (121) on either side of the soundboard where the tailpiece holds it to the body by string tension. This upper view shows the LED power indicator (29) and switch (31), the Bias pot knob (113), the Warp pot knob (115), the Linear-Distortion Mix pot knob (117), the toggle for the Tube-Metal Distortion selection switch (41), the toggle for the Linear-Distortion selection switch (43), the knob 119) for the volume pot, the tuning capacitor selection switch knob (123), the toggle for the Series-Parallel selection switch (49), the knob (125) for the 5-way series combination selection switch, and the knob (127) for the 5-way parallel combination selection switch.

Figure 7:
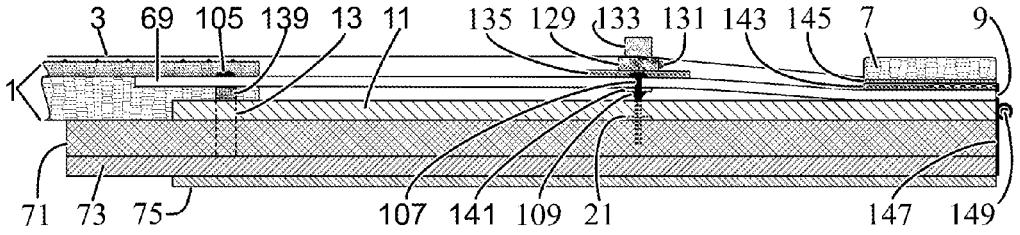
FIG. 7—Side view of the fourth prototype instrument, showing the top (soundboard), bottom cover, upper, core and lower profile layers, and mounting details for the soundboard, bridge and tailpiece.

FIG. 7 shows the arrangement of profile layers from the side and how the strings, bridge, soundboard and tailpiece interact. The strings (3) pass over the neck (1) and the bridge (129) to be secured in the tailpiece (7). The tailpiece is secured to the soundboard (69) by a hinge with an upper part (9) screwed to the tailpiece, a lower part (147) screwed to the body (one or all of 11 upper profile; 71 core profile; and 73 lower profile), connected by a removable hinge pin (149). The tailpiece also has a grounding plate (145) for the strings, and a base (143) to keep the metal parts from contacting and marring the soundboard.

This side view shows the soundboard secured by a round-head machine screw (105) through a height spacer (139), threaded into a mounting post (13) extending through and fixed in the upper and core profiles. The bridge assembly (133, 131, 129, 135) sits on the soundboard. The bridge line soundboard adjustment assembly (107, 109, 21) includes a bearing plate (141) on the underside of the soundboard for the flathead screw.

Figure 8:
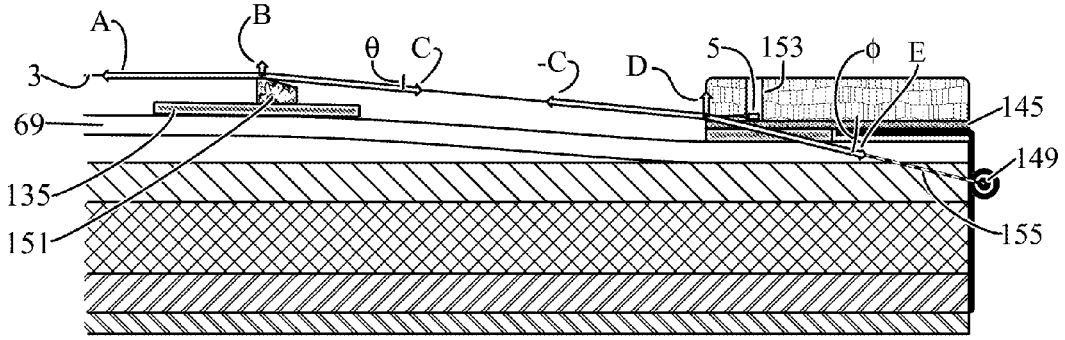
FIG. 8—Detail of side view with a vector force diagram (referenced to forces on the strings at two points) showing how the strings force the bridge and tailpiece down on the soundboard.

FIG. 8 shows the cross section (151) of the bridge, bridge base and tailpiece at a string (3), and how the physical arrangement produces force vectors A, B, C, D and E to demonstrate the downward forces of the string on the bridge and tailpiece. The downward forces opposing B and D achieve three things: 1) the strings bear down on the bridge with enough force to ensure that string vibrations will drive the soundboard to produce acoustic output; 2) the force of the tailpiece against the soundboard removes the need for screws at that end; and 3) the soundboard is then free to slide under the tailpiece as necessary with changes in the height at the bridge.

The string passes over the active part of the base where A, B, and C originate. All the force vectors represent the forces at that point on the string. A is string tension horizontally to the left. B is the upwards force of the bridge on the string. C is the string tension at angle $-\theta$ from the horizontal. Since the string is not moving either vertically or horizontally from that position when at rest, the vectors must cancel, or add up to a net zero in each of the horizontal and vertical directions. The string exerts and equal and opposite force to B downwards against the bridge.

The string is secured by its button (5) in a hole (153) in the tailpiece. We will ignore any forces between there and where it emerges from the tailpiece. Where it emerges it encounters tension $-C$ in the opposite direction, $\pi-\theta$, the upwards force, D, exerted by the tailpiece, and a force E at direction $-\phi$ from that point to the hinge pin (149). The force vectors $-C$, D and E must also cancel to zero in the horizontal and vertical directions at that point. The string exerts an opposite downwards force on the tailpiece at that point, equal in magnitude to D.

Doing the appropriate math produces two relations describing the magnitudes of B and D:

$$F_B=-F_A*\tan(-\theta) \quad \text{Math 1}$$

$$F_D=F_A*[\tan(-\theta)-\tan(-\phi)] \quad \text{Math 2}$$

If $F_A=100$, $\theta=5°$, and $\phi=15°$, then $F_B=8.75$ and $F_D=18.0$. As intended. Math 3

Figure 9A:
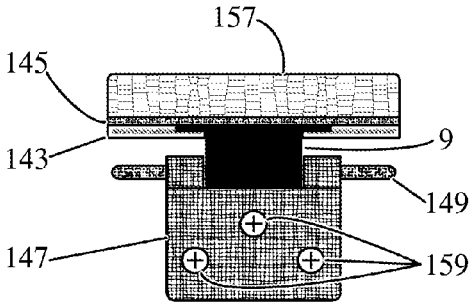
FIG. 9A-B—Back and bottom view of hinged tailpiece showing construction details.

FIG. 9 shows an embodiment for the tailpiece and hinge assembly from other views. FIG. 9A shows the previously described components plus the screws (159) to attach the lower hinge (147) to the body. It also re-identifies the upper part of the tailpiece as (157), which not only holds the string buttons, but can be decorated by carving, painting, etc.

Figure 9B:
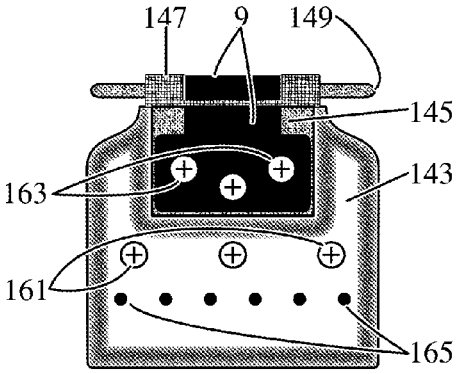

FIG. 9B shows the bottom of the tailpiece with the base mounted by screws (161) to the upper part (157) with holes (165) to facilitate removal of the string buttons with a push rod. The upper part of the hinge (9) is also screwed to the upper tailpiece through the grounding plate (145), allowing the strings to be connected to an electrical ground via the buttons contacting the plate, contacting the lower hinge through the upper hinge and pin, so that a grounding wire may pass through the body to be trapped under and contacted to the lower hinge part.

The fourth prototype was constructed in this manner, but other materials and contacting methods are possible, so long as the strings are grounded. Because not all the string buttons are assured to contact the grounding plate (145), it was necessary to electrically interconnect the string tuners on the head of the neck with brass foil.

Figure 10A:
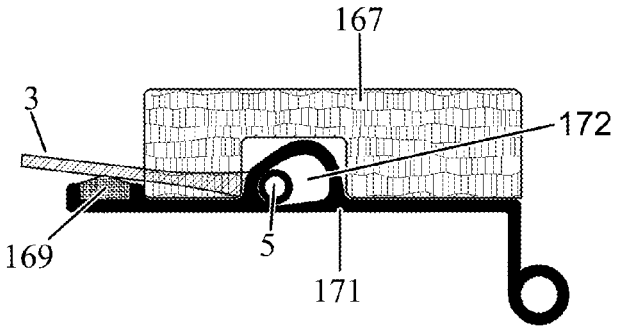
FIG. 10A-C—An alternative upper tailpiece hinge part made of molded or extruded material, with string-capture slots and an optional auxiliary bridge for intonation of sympathetic string vibrations between the bridge and tailpiece.
Figure 10B:
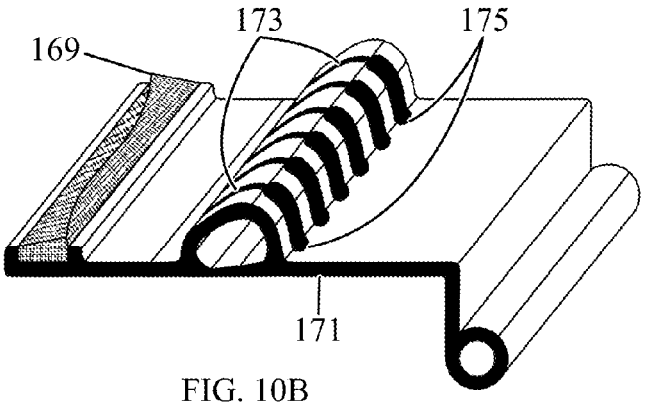
Figure 10C:
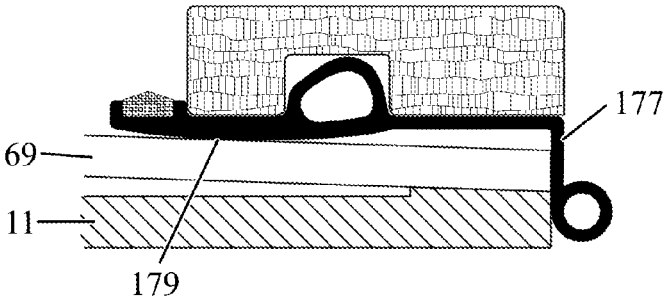

FIG. 10 shows an alternative embodiment for the upper part of the hinged tailpiece. Here, the upper hinge part (171) is molded or machined or extruded out of electrically conductive material. It might include an optional secondary bridge (169) for intonation of the strings between the bridge and tailpiece, since they do vibrate. The cover (167) does not secure the strings, but is decorative. The string buttons (5) are slid past entry slots (175) and are captured against slots (173). The interior cross-section of this space (172) is shaped to force the string buttons downward. This part (171) might have a curved bottom (179) to allow different orientations of the soundboard (69) against it.

FIG. 11 shows more details in the construction of the bridge and bridge line soundboard mounts on the fourth prototype. In this embodiment (FIG. 11A), a wooden bridge (129) was cut for the fourth prototype from ¼-inch (6.5 mm) thick Purpleheart, an exotic hardwood. Any suitable material and manufacturing process can be used, even other types of bridges, such as metal tunematic bridges or stop tailpieces. However the bridge parts of a tunematic bridge can be prone to rattling. This approach eliminates bridge rattle while allowing the musician to custom cut a bridge to a particular purpose, tuning or style of music. The knob and screw tighteners (133, 187) allow relatively quick changes to other precut and adjusted (131) bridges.

Figure 11A:
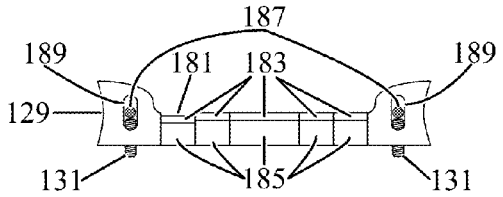
FIG. 11A-D—Construction details of the fourth prototype bridge and bridge base, showing the mounting and tension adjusting screws for the soundboard in line with the bridge.
Figure 11B:
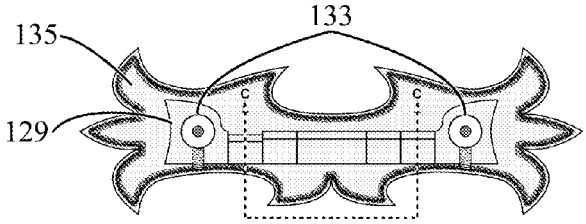

Here, the imaginary bridge line extends through the bridge mounting screws (189). To avoid string rattle on the bridge, it was necessary to cut away downward sloping areas (185) behind the flats (183) upon which the strings rest. Intonation at the bridge seemed to require only one cut (181) at the 6-string for standard EADGBE tuning. A bridge base (135) serves as a shim under the bridge to raise it to proper height, a decoration, and a mechanism to transfer the acoustic energy of the strings from the bridge to the soundboard (69). The bridge base in the fourth prototype used ⅛-inch (3.2 mm) thick basswood cut to the design shown (FIG. 11B).

Figure 11C:
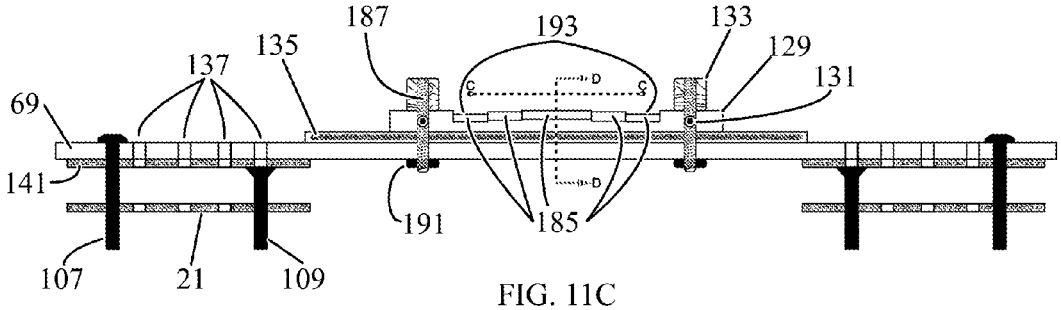
Figure 11D:
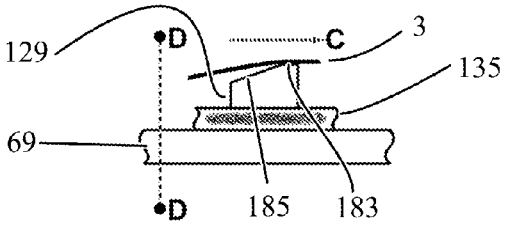

FIG. 11C shows the previously described bridge line mounting and adjusting assembly for the soundboard in greater detail. In addition, it shows how the bridge is cut (193) to accommodate the sting levels imparted or implied by the radius of the frets and/or fret (or finger) board of the neck. This depicts the bridge hold-down screws (187) threaded into nuts (191) secured to the underside of the soundboard (69), with the knobs (133) permanently attached to the screws. The fourth prototype used screws soldered into the nuts, which turned out to be inconvenient for removing the bridge. FIG. 11D shows how the back slope bridge relief cuts (185) function under the strings (3).

Figure 12:
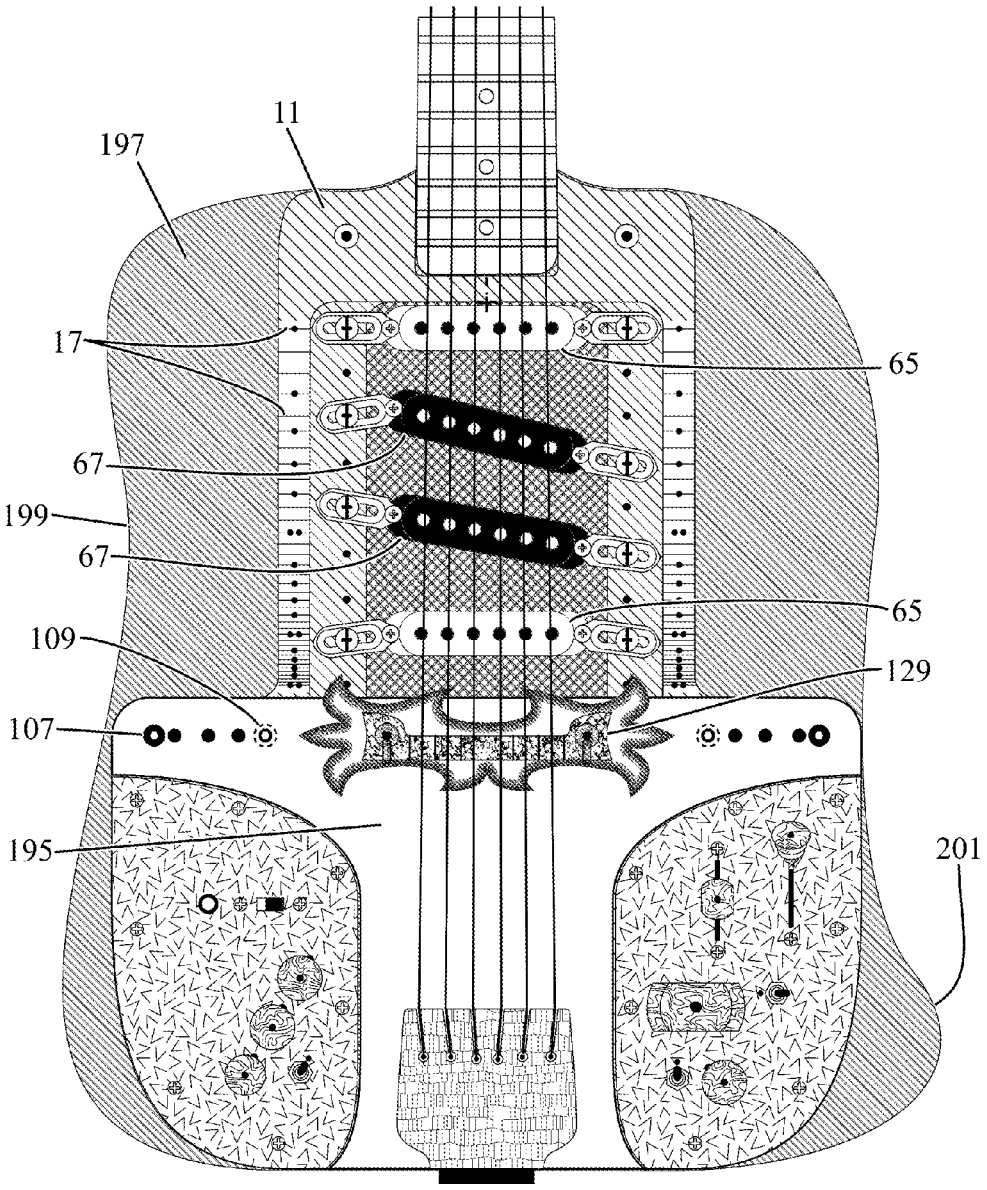
FIG. 12—Top view of the instrument with a half-soundboard in place to adjust the positioning of the bridge and pickups to achieve the desired string height, intonation and timbre.

FIG. 12 shows how placement of the pickups (65, 67), adjustment of the bridge (129), and the adjustment of the soundboard level setting screws (107, 109) to achieve the desired timbres might be accomplished with a half-soundboard (195). It also shows the bottom cover (197), with a belly cut (199) and a thigh hook (201), adjusted to the musician's needs.

Figure 13:
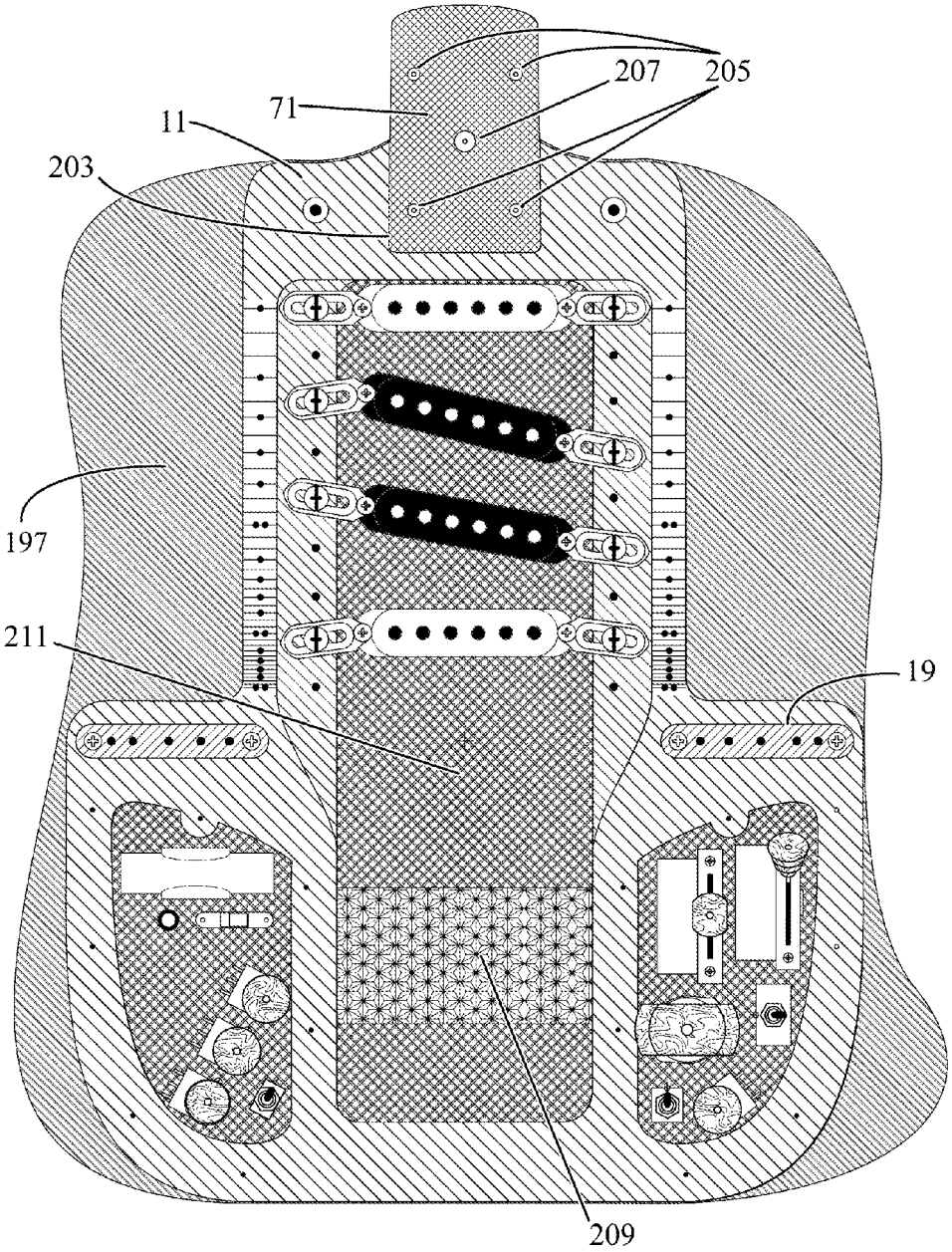

FIG. 13 shows the soundboard, neck, strings, and tailpiece completely removed, revealing the part of the core profile (71) upon which the neck is mounted, with holes (205) to pass neck screws (not shown), and a center hole (207) through which a push rod can help to remove the neck from the neck socket (203) in the upper profile (11). The (fourth prototype) electronic circuit board (209) mounts to the bottom of the core profile, and electrostatic shielding (211) covers the bottom cover (197, and FIG. 16) under the lower profile (73, FIG. 15).

Figure 14:
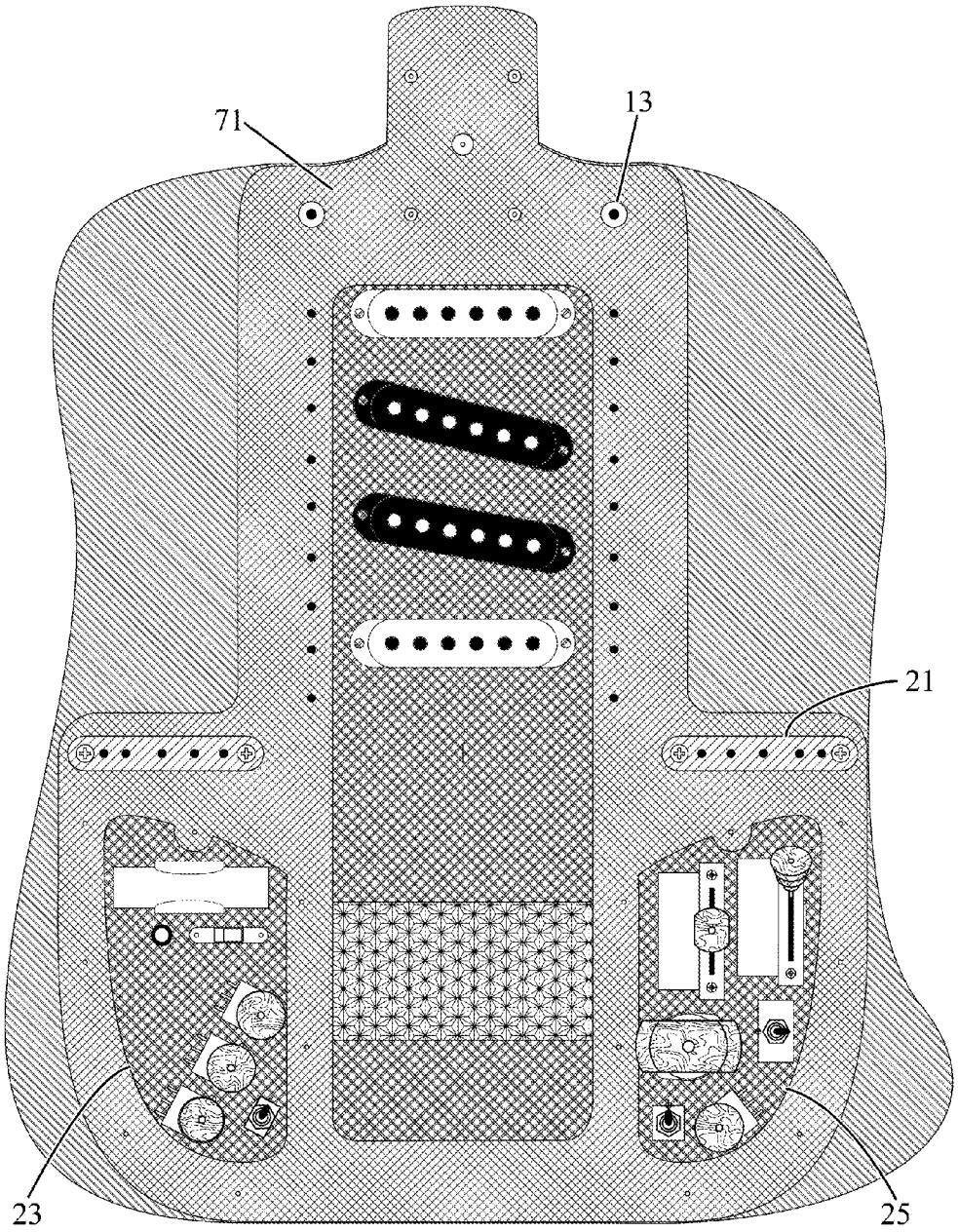
FIG. 14—The core profile.
Figure 15:
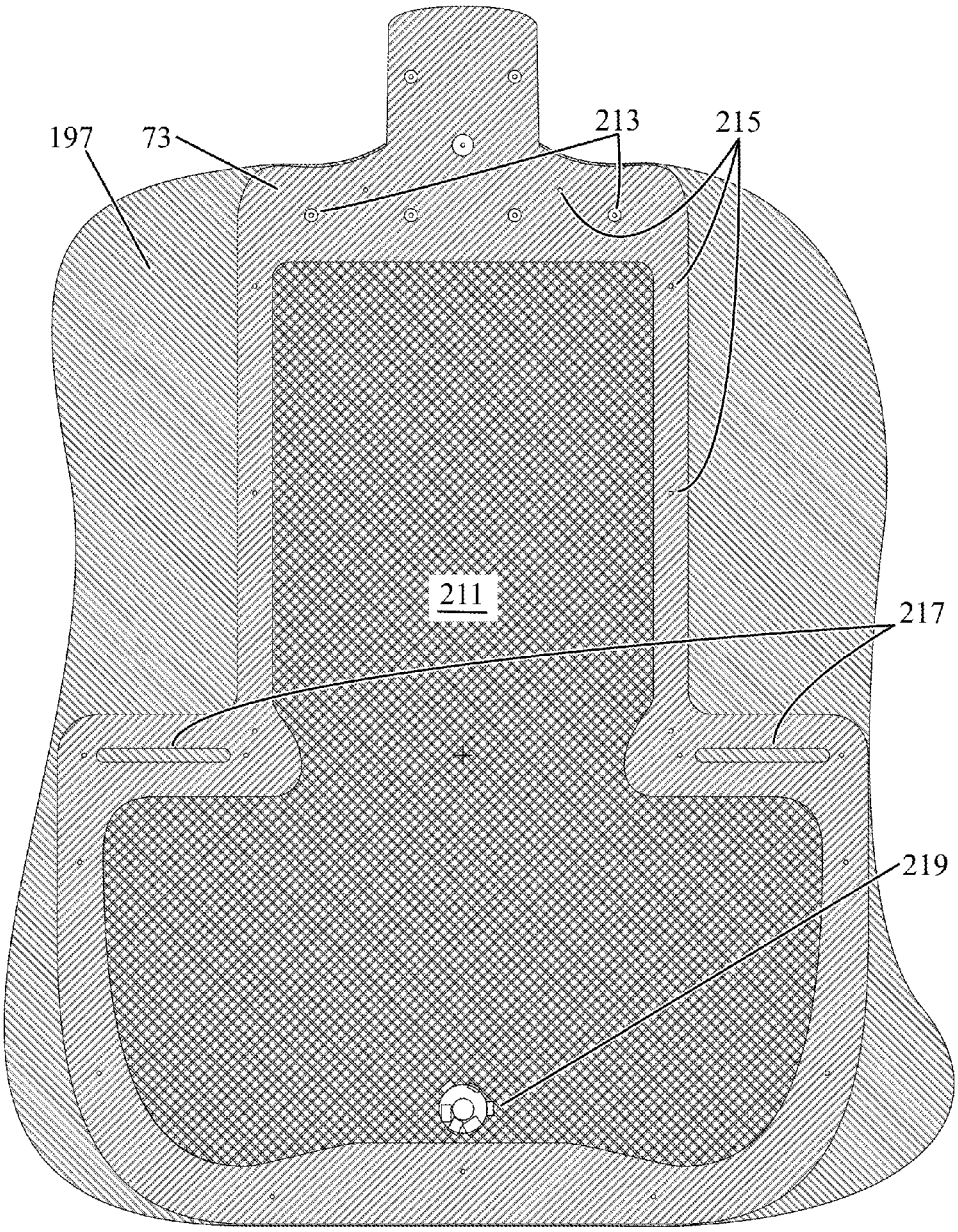
FIG. 15—The lower profile.

FIG. 14 show the core profile (71), with the soundboard mounting posts (13) mounted in it, the screw plate (21) mounted on it, and the left (23) and right (25) electronics cavities cut through it. FIG. 15 shows the lower profile (73), with screw pass holes (217) for the bridge line soundboard mounting and adjusting screws, the output jack (219) mounted on the bottom cover (197) electrically connected to the shield (211), pilot holes (215) for the screws mounting the bottom cover to it, and optional pass holes (213) for the soundboard mounting screws at the neck.

Figure 16A:
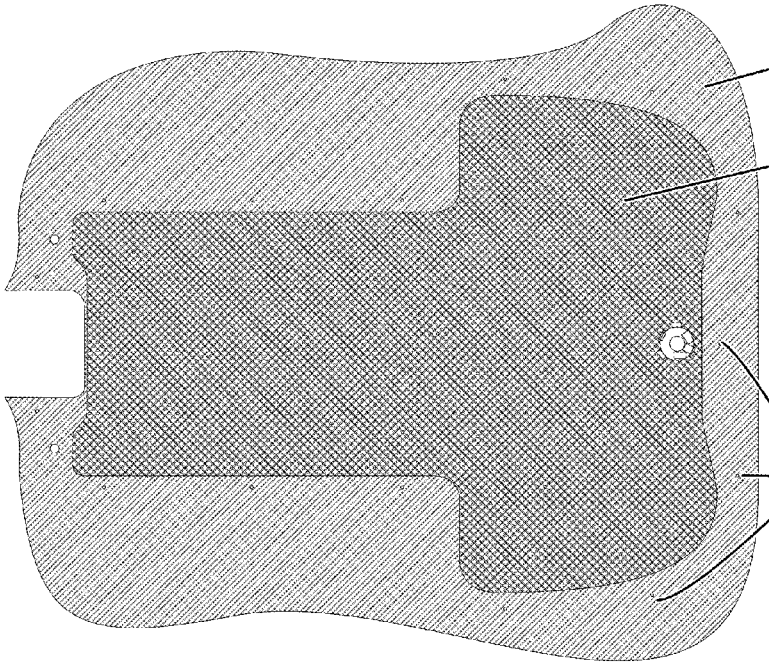
FIG. 16A-B—Top of the bottom cover (A) and Back of the bottom cover.
Figure 16B:
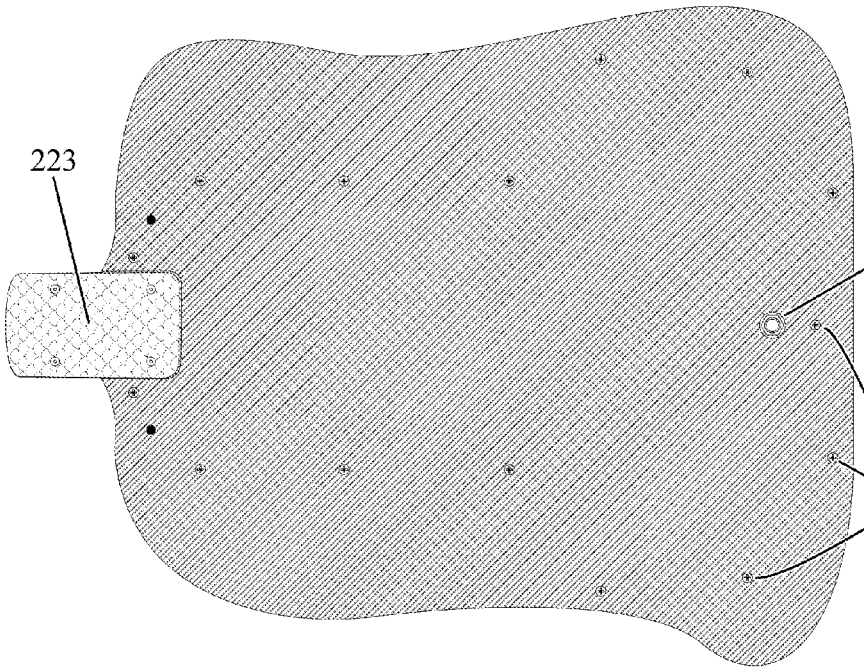
Figure 17:
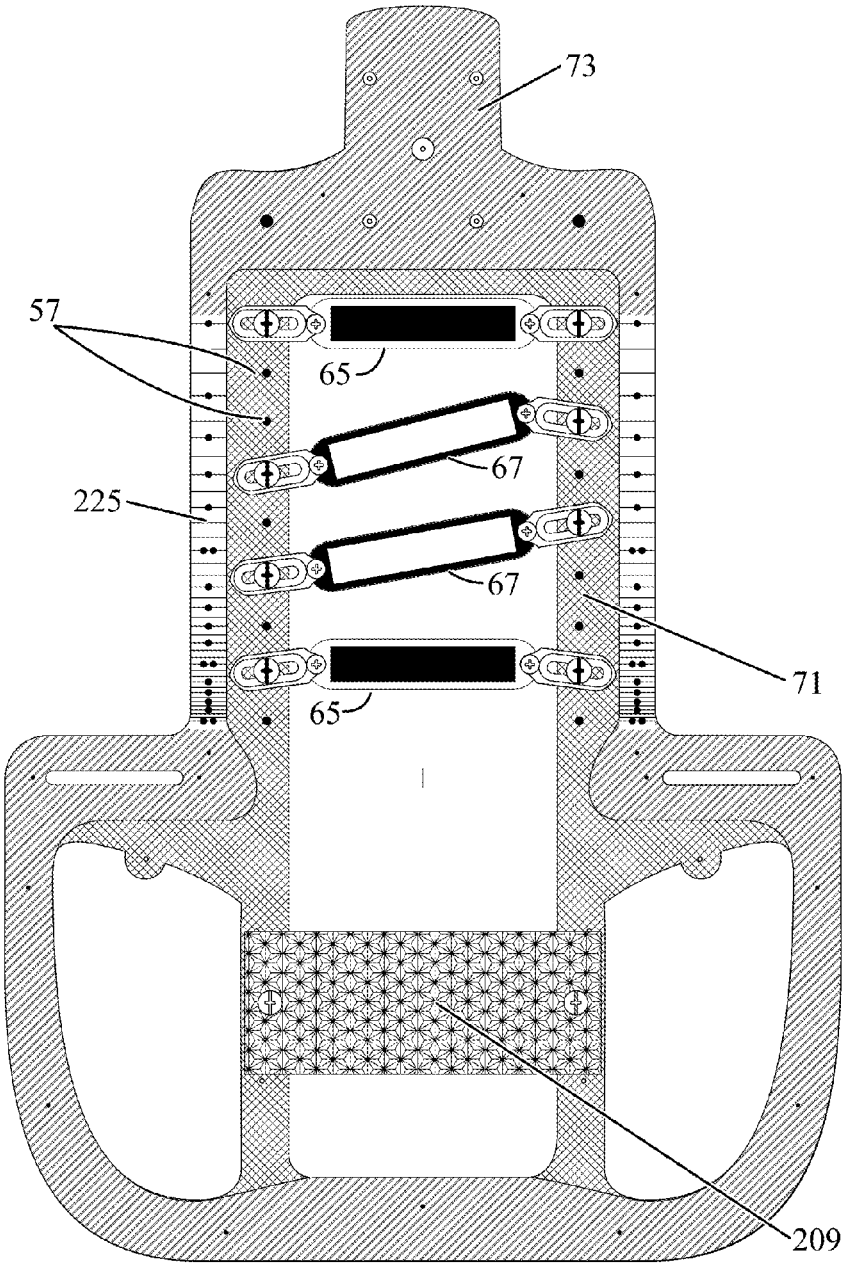
FIG. 17—Bottom view of the lower and core profiles, showing pickups using the bottom mounting system.

FIG. 16 shows the top (16A) and bottom (16B) of the bottom cover (75) with the full extent of the shield (211), the mounting screws (221) corresponding to pilot holes (215), the musician's end of the output jack (219, 16B), and the screw plate (223) for the neck screws. FIG. 17 shows the bottoms of the lower profile (73) and core profile (71) with the pickups (65, 67) mounted from the bottom, using the same threaded holes (57) as the top mounting system. Here the fret scales (225) are inscribed on the bottom of the lower profile. It also shows the electronics circuit board (209) fixed to the bottom of the core profile. The lower profile is just wide enough at the margins to provide screw holes for securing the bottom cover, while passing or providing access to the pickps and electronics.

Figure 18A:
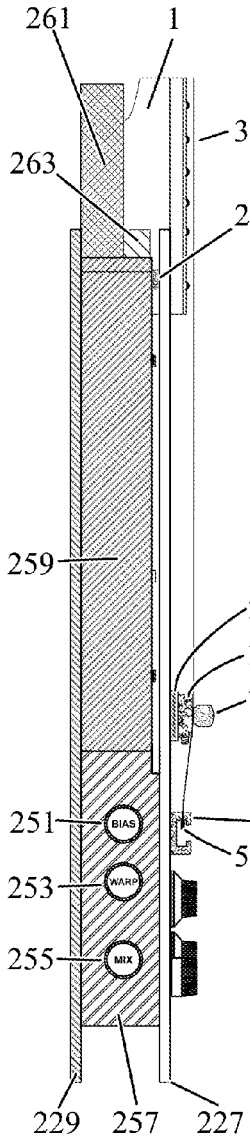
FIG. 18A-B—Side and top view of an alternative embodiment of the instrument, using a shortened core profile, a top-loading tailpiece mounted by screws extending through the soundboard into lower parts, a control box with more room for electronics, and a different soundboard and bottom cover from the previous embodiment, set up for three pickups with a five-way lever switch.
Figure 18B:
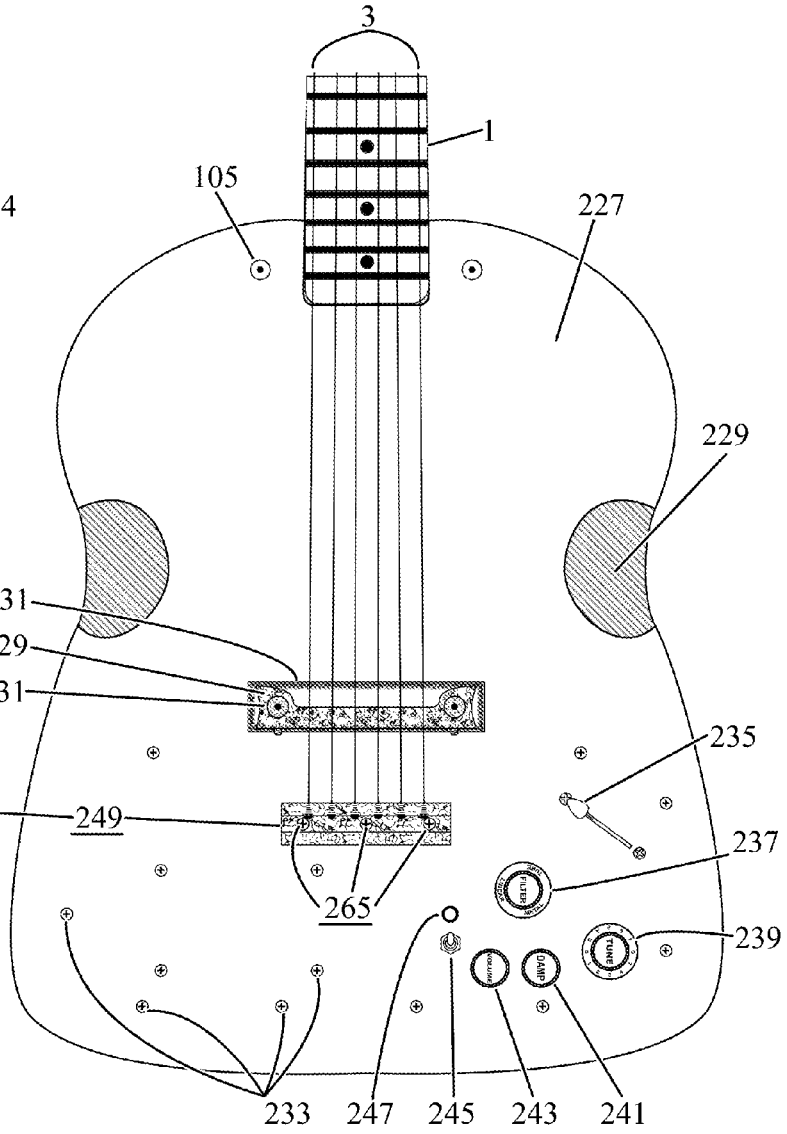

FIG. 18 shows an alternative body and soundboard design conforming the this patent. The neck (1), strings (3), soundboard mounting screw at the neck (105), bridge (129), and bridge hold-down knobs/screws (131) are much as before. The neck screw plate (223, FIG. 19) got left off unintentionally. The alternative soundboard (227) and bottom cover (229) are cut to a different pattern, and the bridge base (231) is more compact. In this case, the height of the strings on the bridge (129) is fixed by the thickness of the bridge, bridge base, and soundboard. The new tailpiece (249) is closer to the bridge to allow more space for controls and indicators (235, 237, 239, 241, 243, 245, 247). Screws (265) pass through the soundboard, mounting the tailpiece to the core profile (261) and tailpiece base (275, FIG. 19). Various screws (233) mount the soundboard to the control box (257) and the controls to the soundboard. The bottom cover (229) attaches to the sides (259) and the control box. The flat sides of the control box allow controls (251, 253, 255) to be mounted on the left side, out of the way of playing and picking.

Figures 19A, 19B:
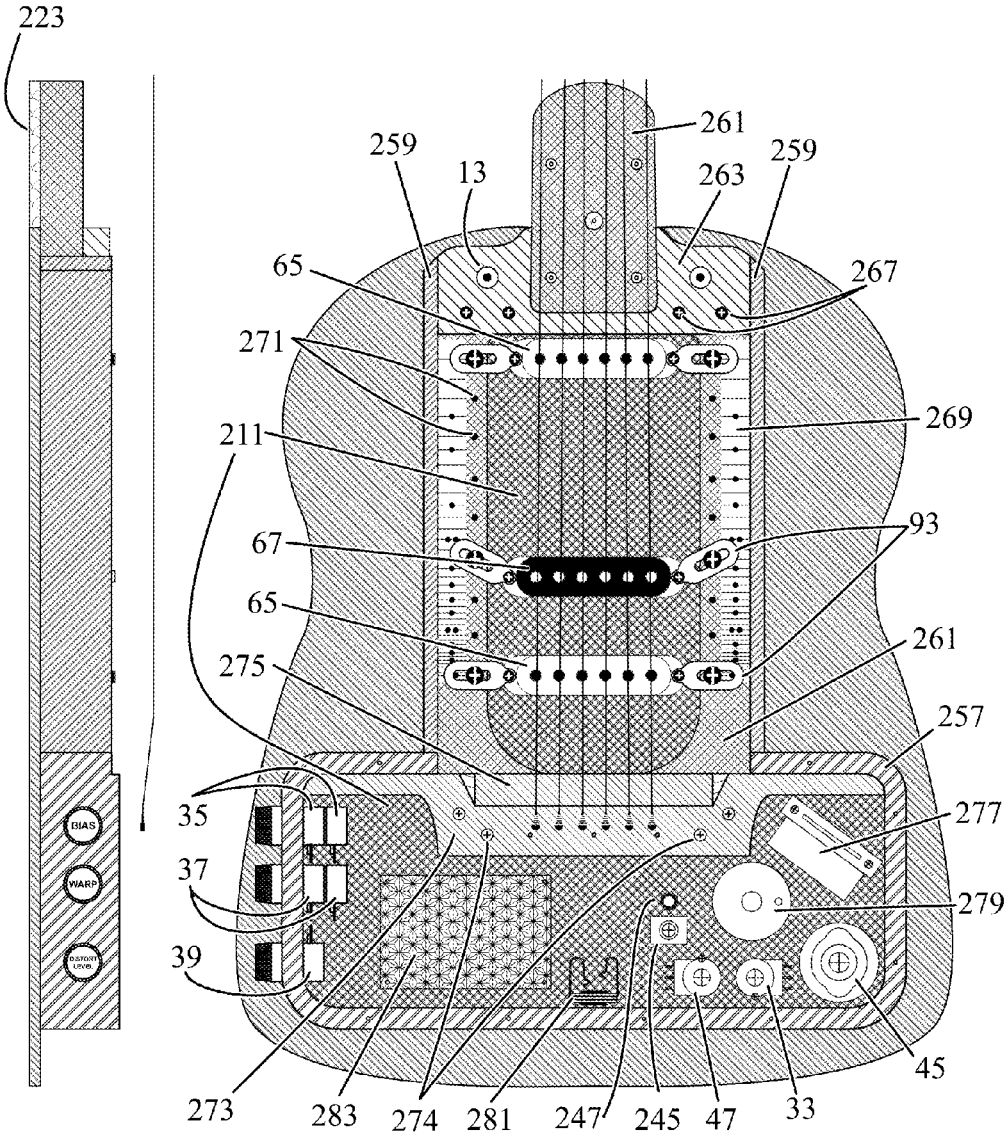
FIG. 19A-B—Side and top view of alternative embodiment with soundboard removed, showing a separate neck socket and tailpiece base in place of an upper profile, a shortened core profile, side walls, three pickups, and a single control box with controls mounted on both the top right and left side to avoid interference with picking.

FIG. 19 shows the soundboard removed, but the strings left in place to show their relationship to the pickups (65, 67), which are mounted using flat plates (93) to holes (271) in the core profile. Here the fret scale (269) is inscribed on the upper side of the core profile (261). The neck socket (263, FIGS. 18 & 19), the tailpiece base (273), screwed (274) to the core, replace the upper profile. The tailpiece base has a bevel cut (275) at the neck side edge of the tailpiece to facilitate transfer of vibrations from the bridge to the soundboard. The control box slides into a slot between the sides and tailpiece base and is attached to the tailpiece base. Also shown are electronic components (33, 35, 37, 39, 45, 245, 247, 277, 279, 281, 283) within the control box.

Figures 20A, 20B:
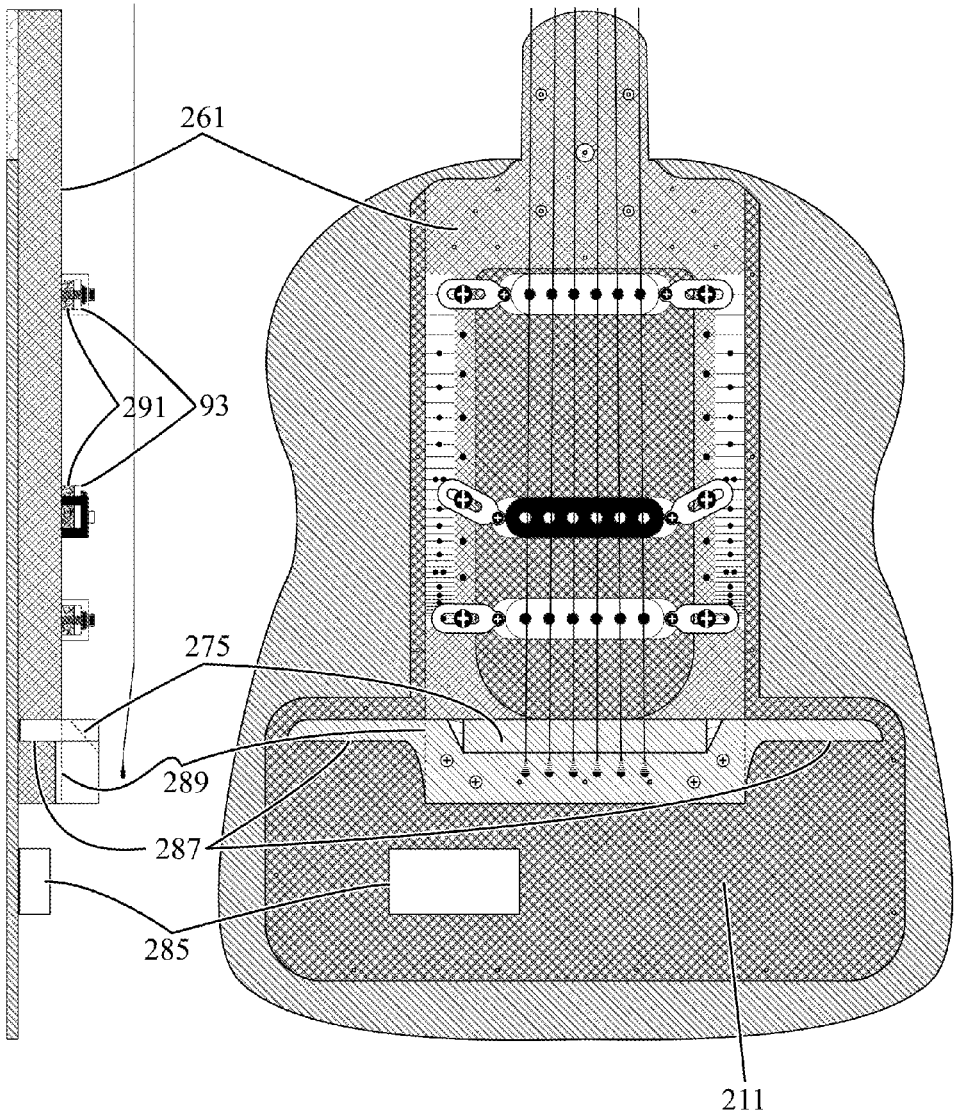
FIG. 20A-B—Side and top views of the alternative core profile, showing pickup mounting and tailpiece base details.
Figures 21A, 21B:
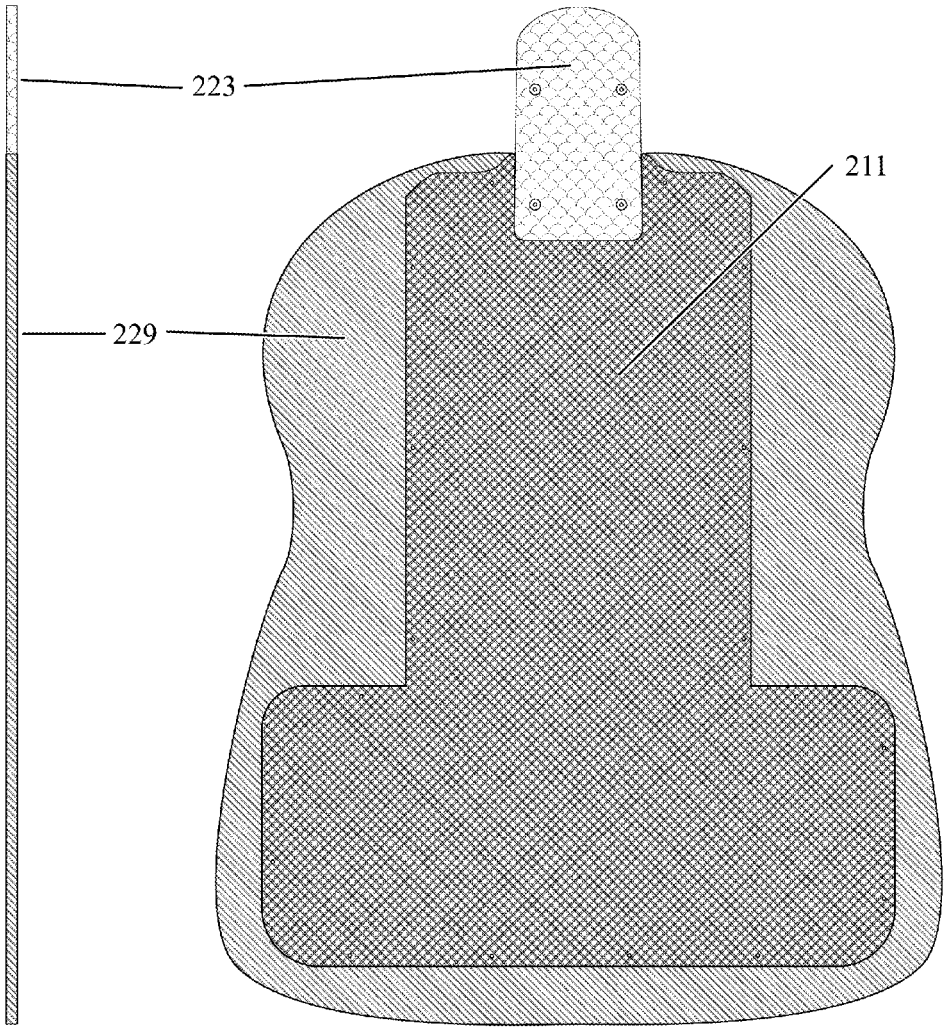
FIG. 21A-B—Side and top views of the alternative bottom cover, bottom cover electric shielding and neck screw plate.

FIG. 20 shows the full extent of the electrostatic shield on the bottom cover (211), how the core (261) extends under the tailpiece base (275) in a shallow dado cut (289), the wings on the tailpiece base (289) to which the control box attaches, more detail of the bevel cut (275), the battery box (285) attached to the bottom cover, and the pickup mounts (93) with thicker vibration-absorbing layers (291). FIG. 21 shows the bottom cover and the placement of the neck screw plate (223).

Figure 22:
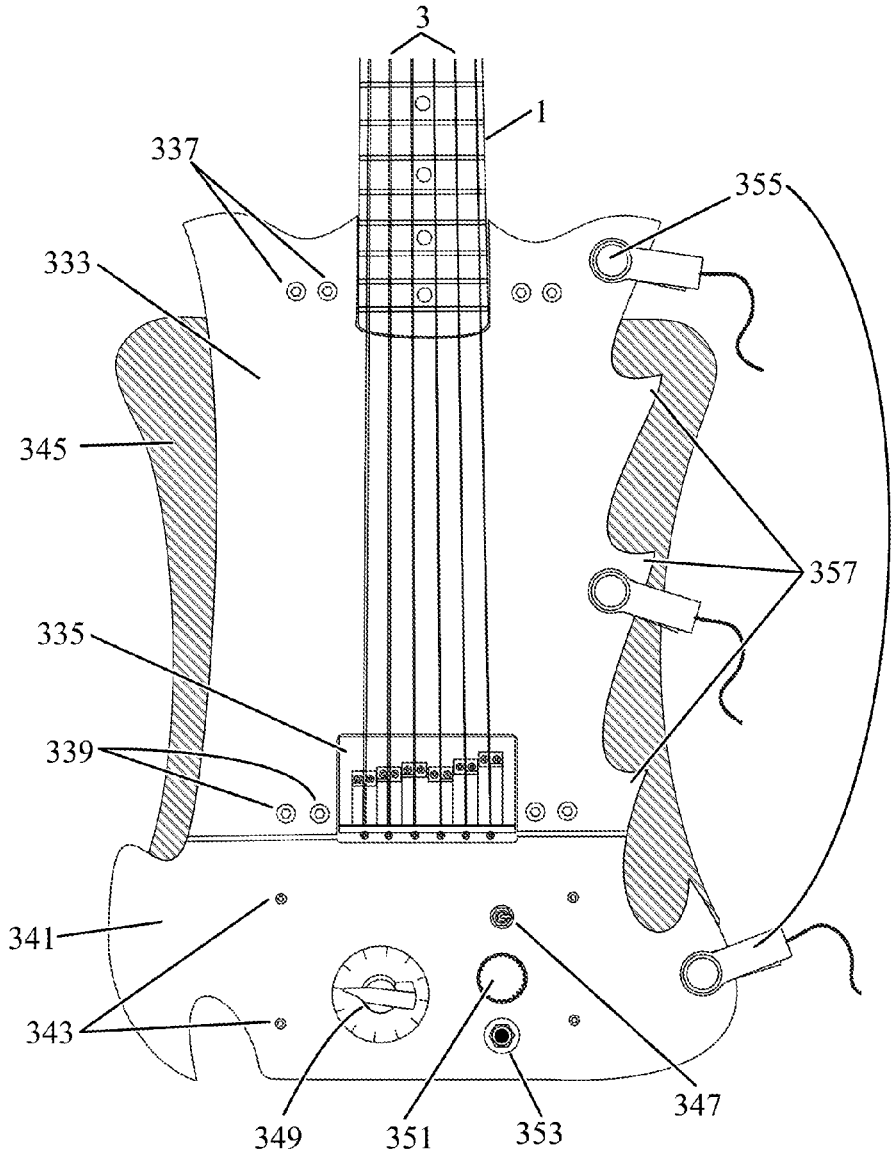
FIG. 22—The second prototype with a metal bridge fixed to the body, showing different contact microphone positions on the soundboard to get different timbres.

FIG. 22 shows the second prototype, with a core (not shown) made of red oak, a two-piece soundboard (333, 341) and back (345) made of masonite, a metal top-loading bridge (335), and two pickps of opposite magnetic polarity (not shown) as in FIG. 22C. The upper soundboard (333) is mounted by four machine screws (337) on a neck socket (not shown) rising above the oak core, and four screws (339) on a bridge base (not shown) rising above the oak core. The lower soundboard (341) is bolted (343) to a set of rails (not shown) on the body, with controls (347,349, 351) and an output jack (353) mounted on it. The soundboard had much more acoustic output that a standard solid-body electric guitar, but much less than an acoustic guitar. But still enough so that a contact microphone (355) can easily pick up signals on the barbs (357) on the soundboard. Each barb produces a different timbre. Thus vibration sensors incorporated into the soundboard at various places can also produce useful output.

FIGS. 23-31 Describe Improvements to the Pickup Switching System

Figure 23A:
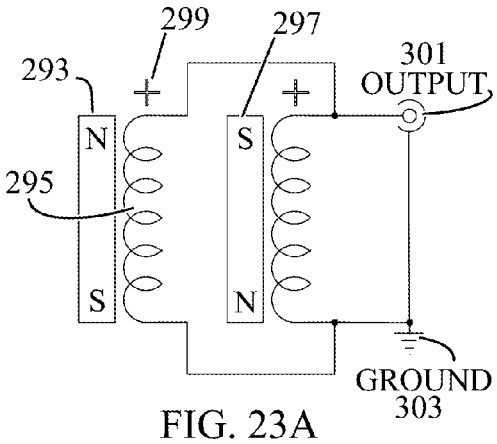
FIG. 23A-D—Introduces the basic circuit diagrams used here for pickups, serial and parallel connections, and wiring details for double-pole, double-throw switches to make those connections.
Figure 23B:
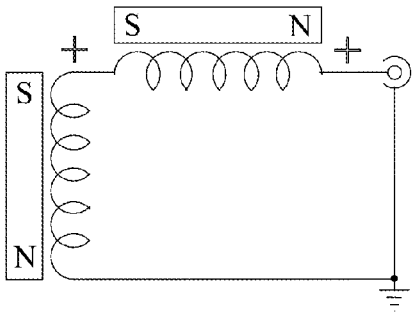

FIG. 23A shows the basic parallel coil humbucking circuit, for either two single-coil pickups, or a dual-coil humbucker. FIG. 23B shows a series connected circuit. Humbucking refers to the ability of the circuit to cancel out external varying magnetic fields that do not arise from the interaction of the strings and the pickup. This drawing presents a single-coil pickup in the simplest possible terms: a magnet (293), a coil of wire (295, usually around or above it), and a lead designated "+" (299) which has the same phase of signal as all the other pickups in the circuit with "+" leads. Standard symbols for the signal output (301) and ground (303) are shown.

Say there are two pickups, one with its north pole (293) next to the strings (or upwards), and the other with the south pole (297) next to the strings. If the coils are wound in the same direction, say CCW in the top view (or left-handed), and are near each other with respect to the vibrations of the string, then the vibrations will produce signals of opposite phase in the same respective leads on each coil, because the magnetic poles are reversed. The leads of one coil must be reversed to keep from canceling out the string signal. But this will cause an external signal, like 60 cycle machinery and light signals, which has nothing to do with the pole oriention, to cancel. Thus "humbucking". It is convenient not to show crossed leads for one coil, but to simply assign the in-phase lead to the top and label it "+".

In order for this to work, both coils have to have the same number of effective turns, which can be influenced by an artificial and/or intended concentration of the external field in the instrument. In general, most replacement pickups will have to be wound to match the pickup in the set with the highest signal output of external fields. Also the series circuit tends to have a stronger signal with less high frequencies (warmer), and the parallel circuit tends to have a weaker signal with a peak in higher frequencies (brighter).

Figure 23C:
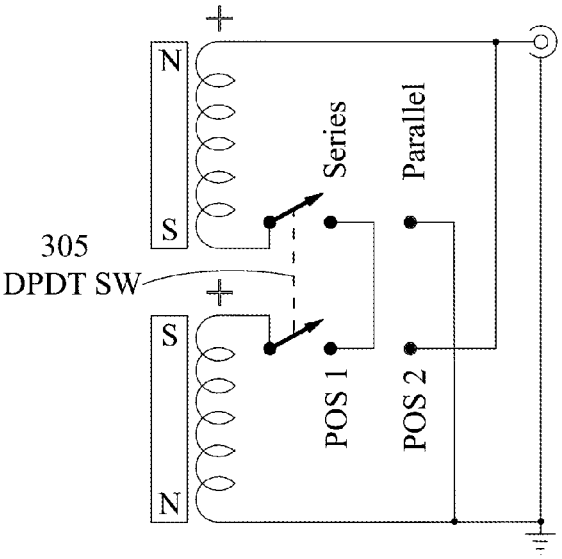

FIG. 23C shows a switched circuit, using a double-pole double-throw (DPDT) switch (305) to produce series and parallel outputs, like 23A and 23B. Rather than having switch arrows that rotate to a number of positions (throws), this diagram uses slightly non-standard symbolism, which puts the poles on the right and the switch positions for "throws" successively to the left. It makes the circuits a lot easier to draw and understand. Note that the + wire of the north-up pickup is connected permanently to the output and the other wire of the south-up pickup is connected permanently to the ground, which makes humbucking circuits easier to draw, with a minimum number of switch poles. So switch position 1 (POS 1) is made series merely by connecting the two switch terminals together, and position 2 (POS 2) is made parallel by the N-up coil switch terminal to the ground and the S-up terminal to the output.

Figure 23D:
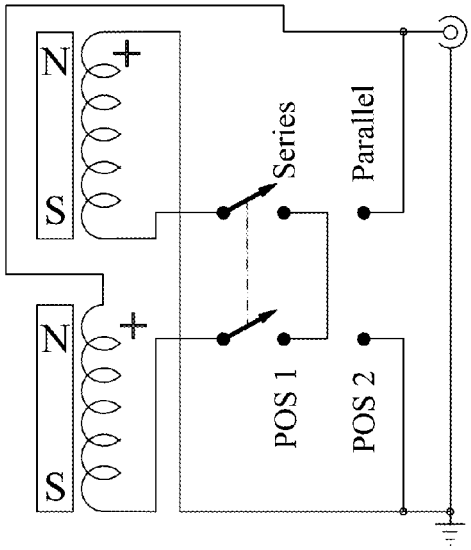

FIG. 23D shows how two N-up single coils are connected in series and parallel circuits. Here, the N-up pickup from 23C is moved down and replaced with another N-up pickup with the "+" wire connected to ground. Because the pickups are both N-up, both the external and string signals tend to cancel each other. But the string signals will still be stronger because of the presence of higher harmonics of the fundamental frequencies of vibrations, which this circuit tends to emphasize.

Figure 24:
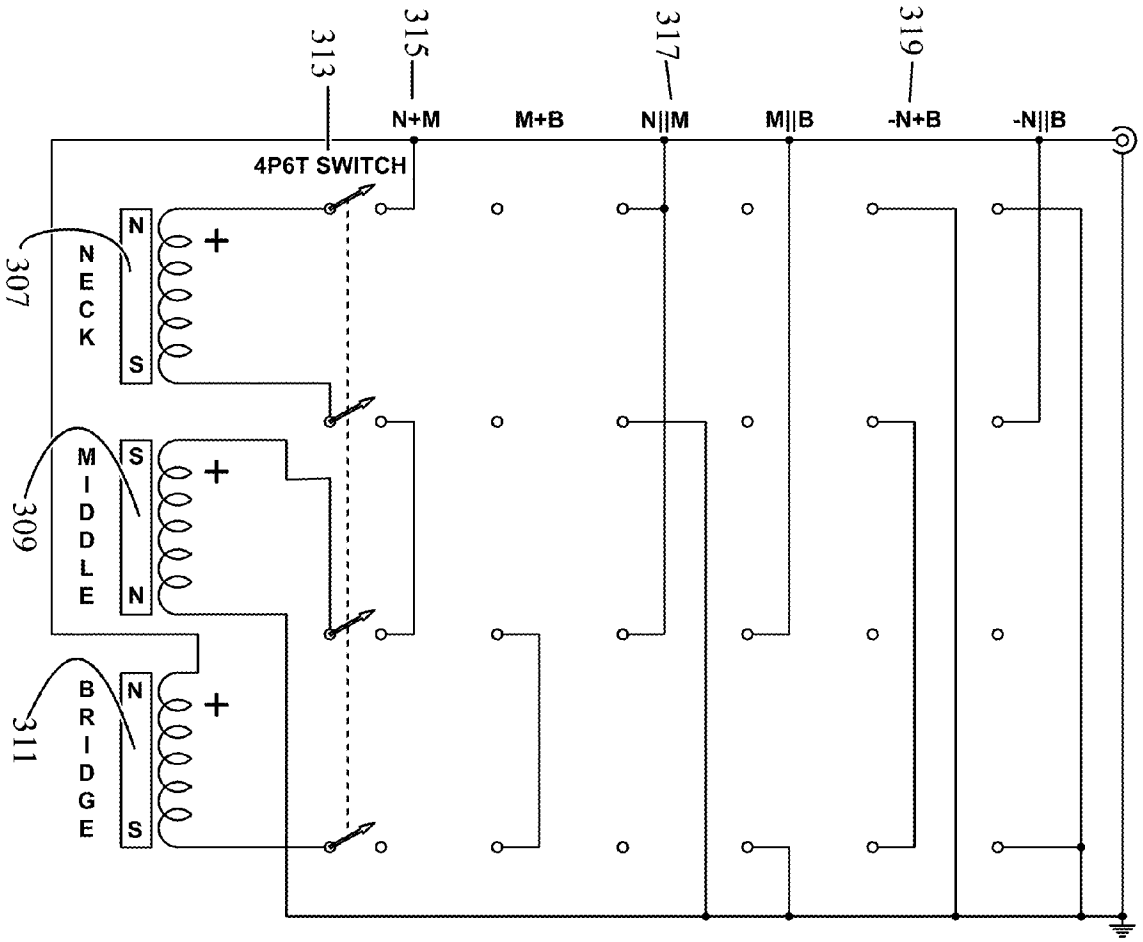
FIG. 24—Shows the 3*2 possible humbucking connections for three single-coil pickups using a 4-pole, 6-throw (4P6T) switch, in series and parallel, with signals aiding and opposed.

FIG. 24 shows how three pickups can be connected into six humbucking pairs with a 4P6T switch (313), using the previous switching symbolism. The neck position pickup (307) and bridge bridge pickup (311) are N-up, with the middle pickup (309) S-up. The number of possible pickup combinations of one type, series or parallel, of three pickups taken combined in pairs is (3*2)/(2*1) or 3, making 6 total for both series and parallel. This includes the opposing signal (out-of-phase) pairings of the two N-up pickups. Here the symbolism at the switch positions for the connections uses "+" for series (315), "||" for parallel (317), and "−" for an opposing signal (319). This makes the circuit diagram easy to read and understand at a glance. Note that for a commercially available 5-way guitar "superswitch", which is 4P5T, one of the combinations must be left off (likely −N||B).

Figure 25:
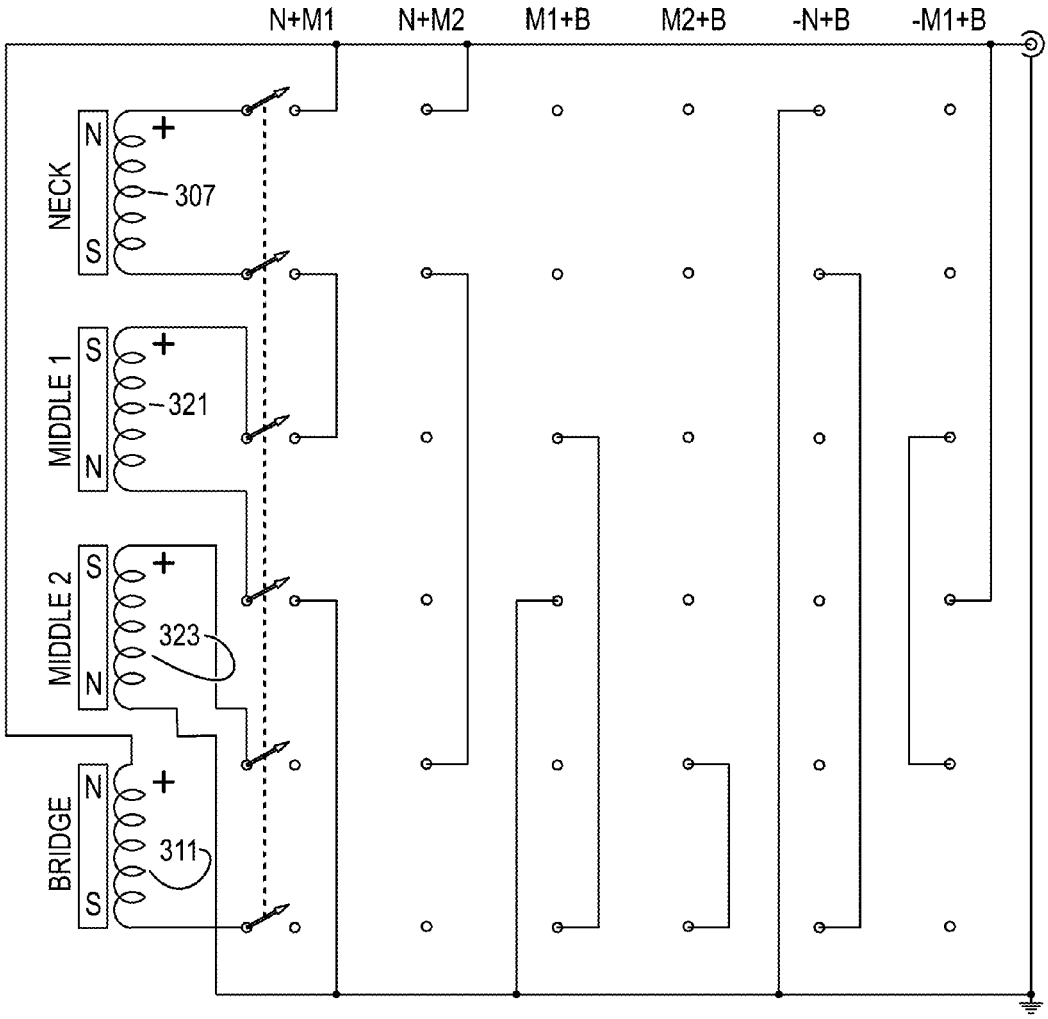
FIG. 25—Shows how a 6P6T switch is used to produce six series humbucking pairs of four single-coil pickups.
Figure 26:
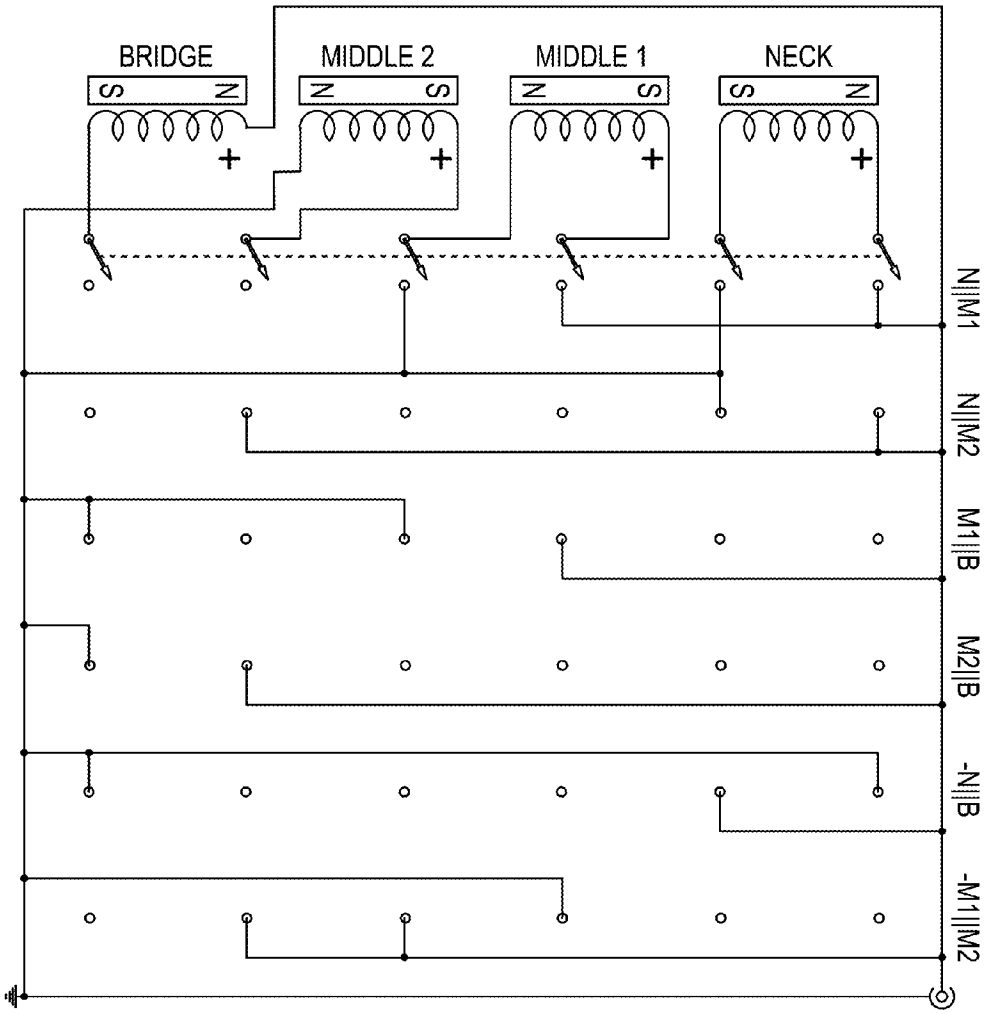
FIG. 26—Shows how a 6P6T switch is used to produce six parallel humbucking pairs of four single-coil pickups.

FIG. 25 shows a 6P6T switching circuit for two N-up pickups at the neck (307) and bridge (311), with two S-up pickups in between in the Middle 1 (321) and Middle 2 (323) positions. Here four pickups taken two at a time in series produces (4*3)/(2*1) different pairs, or 6. FIG. 26 shows the corresponding 6P6T switching circuit for parallel connections. Both figures together produce 12 combinations of humbucking pairs. The least number of switch poles necessary for the circuit to work depends on the number of magnetic poles up. If all K pickups have the same polarity of poles up, then a switch with switch with 2*K−1 poles is needed, and only one pickup can have a permanently connected wire, with the other served by a single pole. If at least one pickup has a different polarity, then a switch with 2*K×2 poles is needed, and a single pickup of each polarity up can have permanently connected wires and be served by single switch poles.

Figure 27:
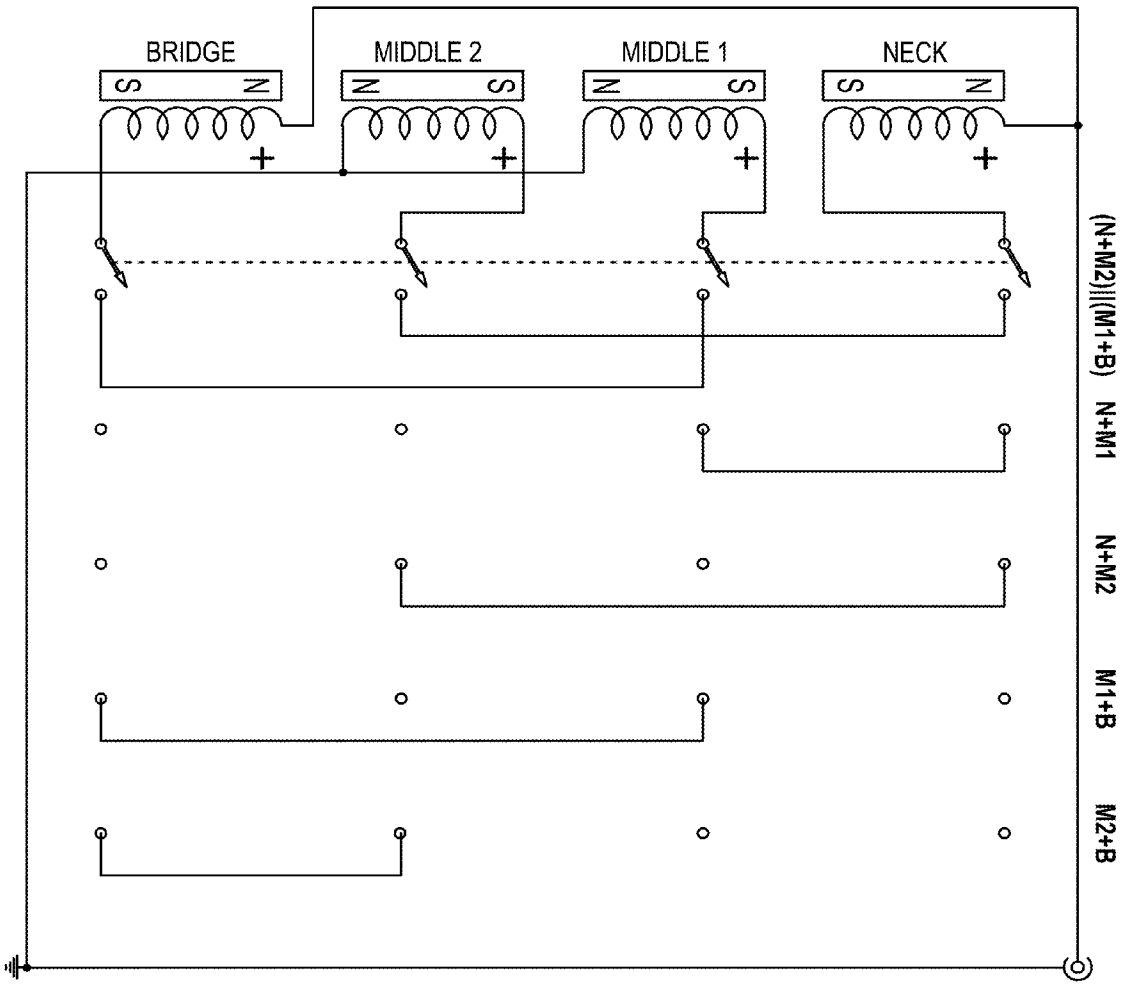
FIG. 27—Use of an existing 5-way lever switch (4P5T) to produce five series humbucking outputs from four pickups.

FIG. 27 shows a different set of series circuits with a 4P5T 5-way "superswitch" used on the fourth prototype to connect together series humbucking pairs of single-coil pickups. Note that this circuit uses the same permanent connections with N-up and S-up as 22C. Here the first switch position connects all pickups together as two series circuits in parallel, which the remaining four positions are the remaining series combinations that do not have any out-of-phase signals. The first position tends to give a signal that sounds like an acoustic guitar. The rest of the positions become brighter in tone and timbre from left to right.

Figure 28:
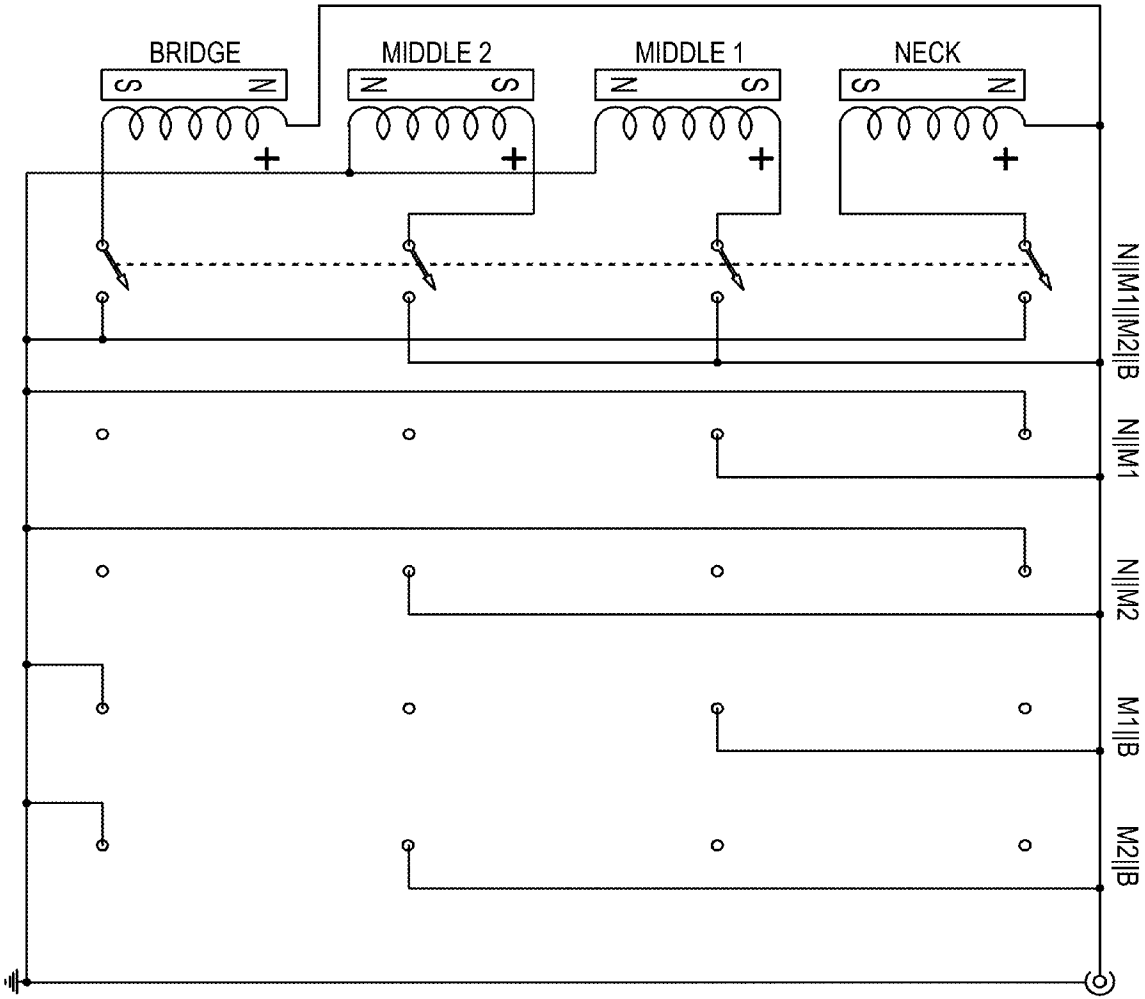
FIG. 28—Use of an existing 5-way lever switch (4P5T) to produce five parallel humbucking outputs from four pickups.

FIG. 28 shows the same kind of circuit used in the fourth prototype for parallel humbucking pairs, with all four connected in parallel in the first position. The first position also emulates an acoustic guitar, but slightly brighter. Again, the timbres get brighter from left to right. Both FIGS. 27 and 28 show connections for humbucking quad pickups. The number of unique possible combinations for just four pickups, connnecting serial-parallel humbucking pairs in serial or parallel to serial-parallel humbucking pairs are less straightforward to calculate. Note that for four pickups connected together in serial there is only one possible combination of four pickups, as there is for four pickups connected together in parallel. Otherwise, there appear to be four sets of three combinations for the pairs, for a total of 14 unique combinations. The predicted outputs for these combinations are about 1, 2, 3 and 4 times the output for a parallel-connected humbucking pair, not counting the combinations with signals that are out of phase.

Figure 29:
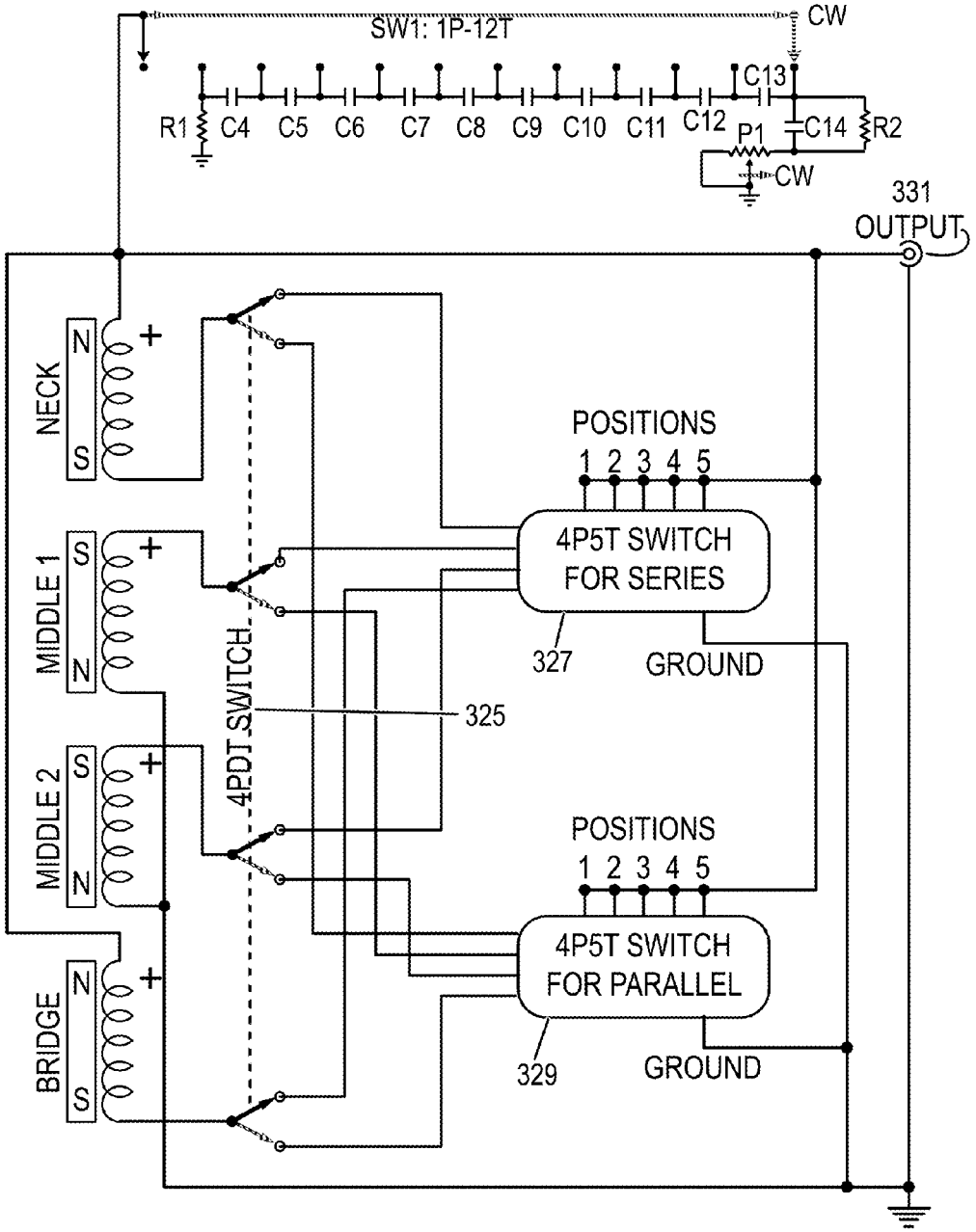
FIG. 29—Use of 4PDT switch to connect four pickups to the 5-way switches in FIGS. 26 and 27 to produce 10 humbucking outputs, with the 12-position capacitor tuning-tone switch and potentiometer attached directly to the chosen pickup output.

FIG. 29 shows how the fourth prototype combined FIGS. 27 & 28 by using a 4PDT switch to switch the pickups from the series 5-way switch (FIG. 27) to the paralled 5-way switch (FIG. 28). Thus producing 10 humbucking outputs compared to the 2 generated by a single standard 5-way switch on most Stratocasters (™Fender) and their imitators.

This switching system can be expanded to any number of single-coil pickups, or four-lead humbucking dual coil pickups. Generally, unless one wants most of the humbucking outputs to be combinations of out-of-phase signals, the number of S-up single coil pickups should number no more that one more or less than the number of N-up pickups. Five pickups, for example have (5*4)/(2*1), or 10 series humbucking combinations, and an equal number of parallel humbucking combinations, for a total of 20. In the case of 3 N-up pickups and 2 S-up pickups, the switch would need two poles each for two of the N-up pickups (4) and one of the S-up pickups (2), plus one each for the remaining pickups (2), for a total of 8 poles and 20 throws or positions (8P20T, or two 8P10T plus an 8PDT) to get 20 series-parallel combinations of signals.

Figure 30:
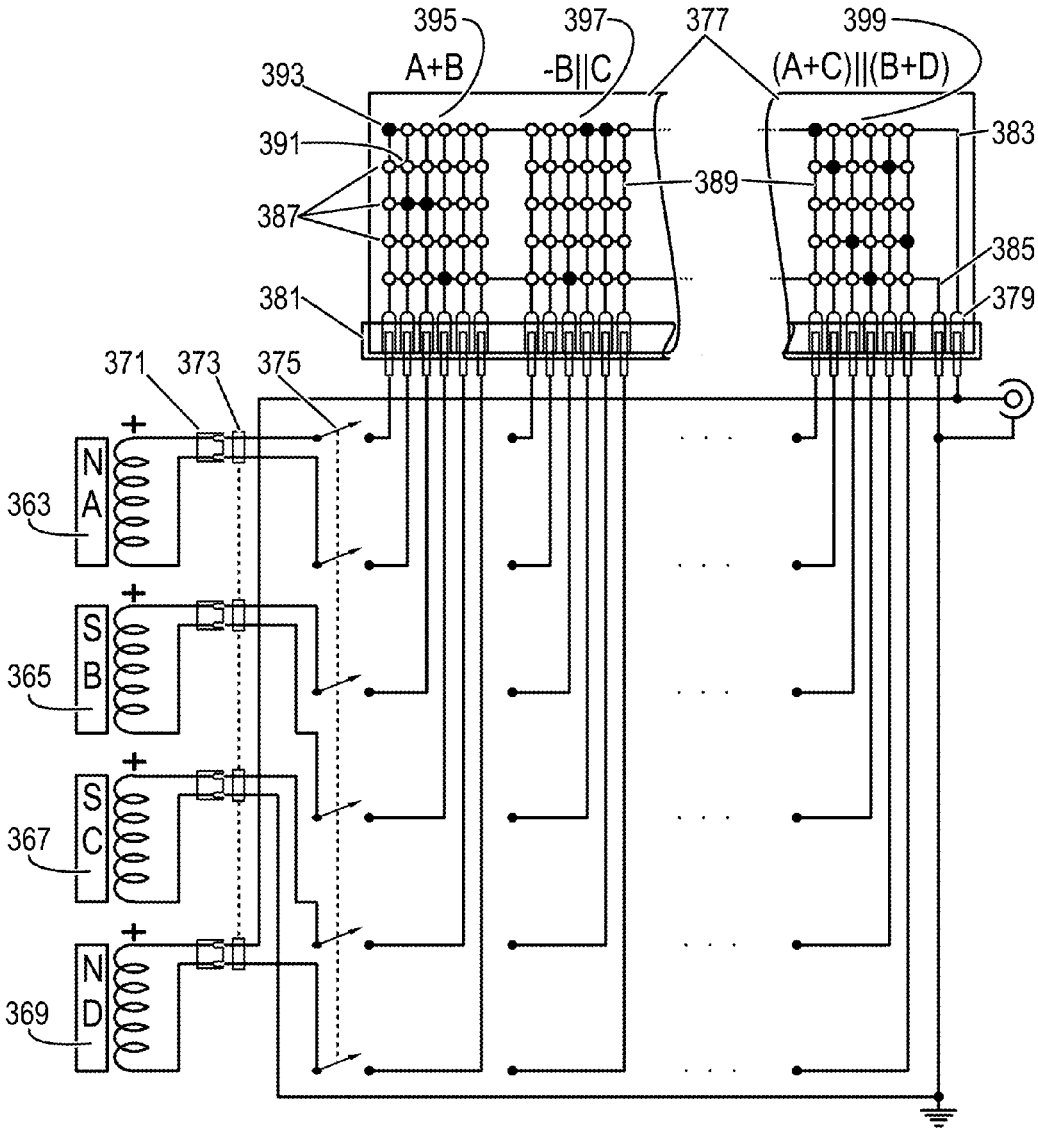
FIG. 30—A crosspoint matrix replacing series-parallel connections directly on the pickup switch(es).

FIG. 30 shows a more flexible embodiment than making all the connections in FIGS. 23-27 directly on the switches and their terminals. N-up pickups A (363) and D (369) and S-up pickups B (365) and C (367) each have wires ending in female connectors (371), which plug into male pin or header connectors (375). These connectors can be either keyed (polarized) or unkeyed. Unkeyed connectors can be reversed in the event of a pickup wiring error. The connectors allow other arrangements of the pickups between the neck and bridge (or tailpiece), such as N-N-S-S or N-S-N-S, or vice versa, to accommodate other musical theories and settings.

The male pins (375) are connected to a 6P6T switch (375), as in FIGS. 24 & 25. The six wires for each switch position are connected to a female circuit board connector (381), into which a circuit board (377) plugs with board-edge finger contacts (379). The board has vertical wires (389) on one side for the switch terminals, and horizontal wires on the other side, consisting of a common output wire (383), a common ground wire (385) and several interconnect wires (387) that are separate for each switch position.

Open circles (391) designate cross points where the horizontal and vertical wires do not connect. Filled circles (393) represent cross points with connections between the horizontal and vertical wires. If the open circles represent holes through the board, this can be as simple as a jumper wire soldered from one side to the other. Here, the connections for A+C (395), −B||C (397) and (A+C)||(B+D) (399) show at three of the switch positions. Otherwise, the same thing can be done with commonly available analog and/or digital semiconductor crosspoint arrays, and a microcomputer driver. In this case, only two of the interconnect wires (387) are necessary, requiring interconnections between 6+4 or 10 wires. So theoretically, 10×10 or 16×16 integrated circuit crosspoint switch matrix could accomplish the same thing as the 6P6T or 6P12T switch (375) and the matrix board (377) combined, to produce all 12 serial and parallel humbucking combinations. Thus the embodiments are not limited to the physical features of FIG. 30.

Figure 31:
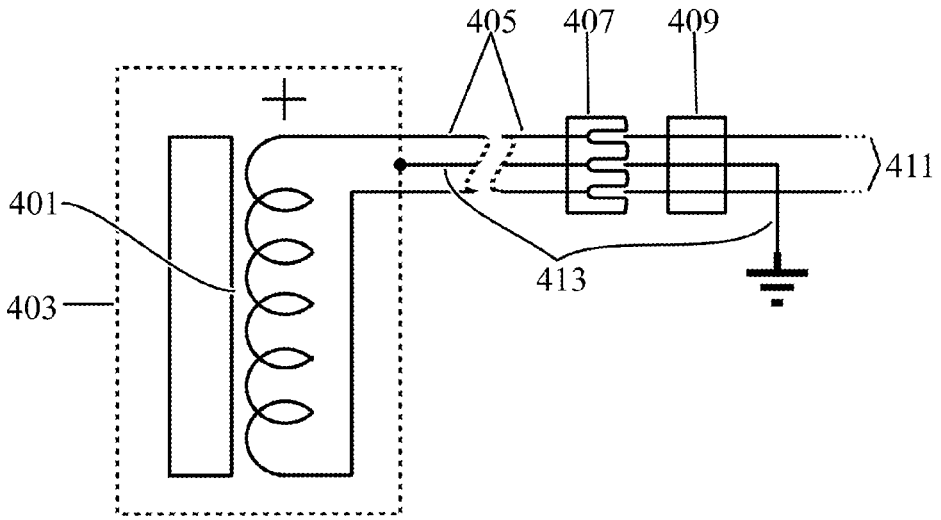
FIG. 31—Improved pickup connector and shielding.

FIG. 31 shows an improved pickup connection embodiment, with shielding. The pickup (401) is enclosed by and electrostatic shield (403), from which a 3-wire cable (405) emerges with the two signal wires (411) and a ground wire (413) connected to the shield. It terminates in the three-pin female connector (407) which connects to the 3-pin male connector (409), with the ground wire in the center. The ground wire is grounded on the other side of the male connector. The 3-conductor cable can be either ribbon cable, as implied here, or 2-wire twisted and shielded cable, or even 5-conductor ribbon cable with ground wires bracketing the signal wires, as are some computer cables, but with only center wire connected to the pickup shield. This would provide better rejection of high-frequency noise pickup from things like fluorescent lights. With either a 3-wire high-gnd-low or S-wire gnd-high-gnd-low-gnd system, the connector will be reversible if not keyed or otherwise polarized.

Figure 32A:
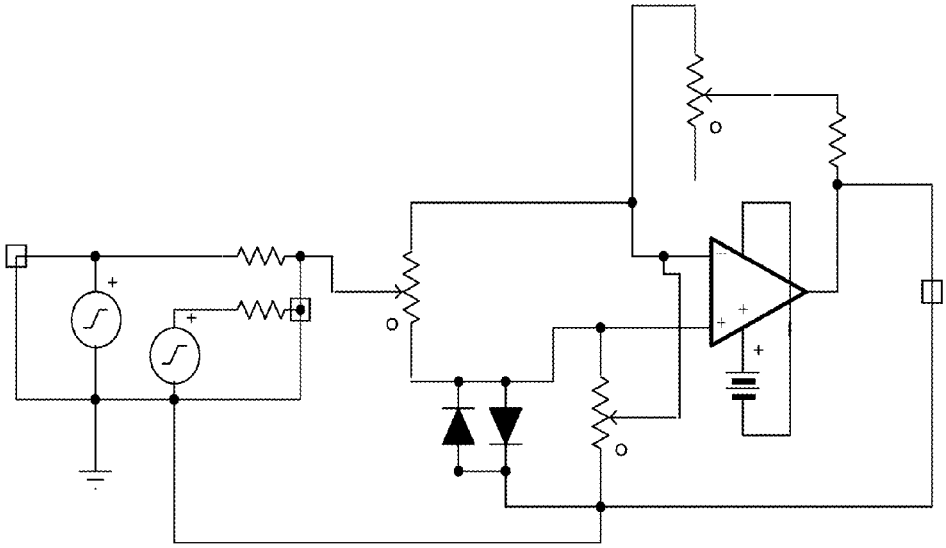
FIG. 32AB, 33AB, 34AB—Show distortion circuits developed by inventor on Dec. 24, 2007 similar to those in U.S. Pat. No. 7,787,634 (Aug. 31, 2010).
Figure 32B:
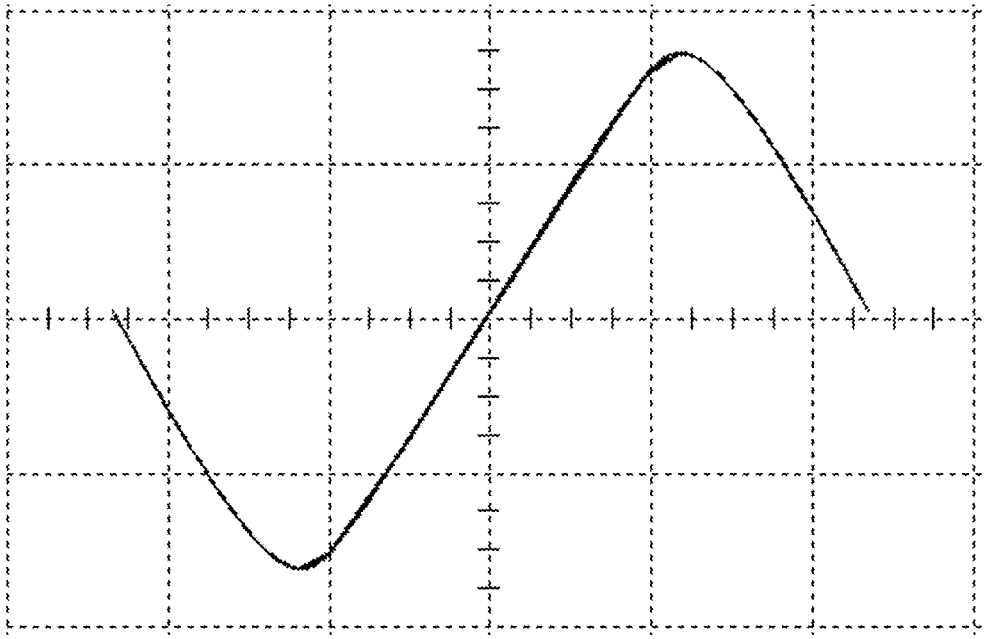
Figure 33A:
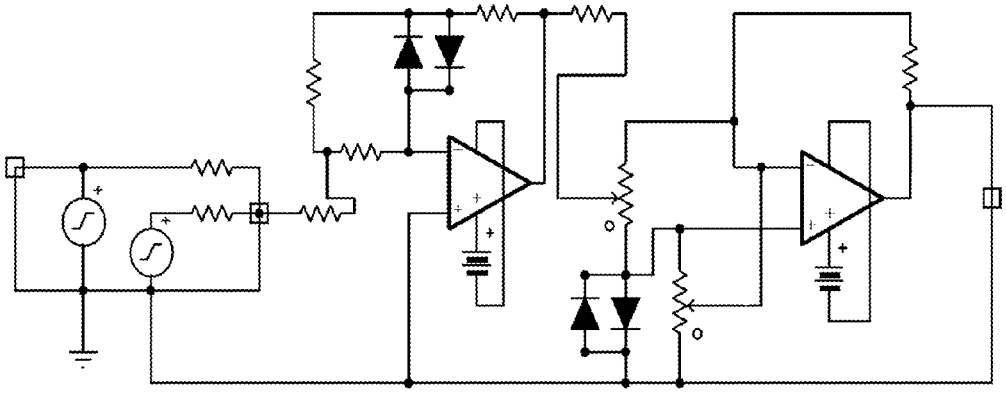
Figure 33B:
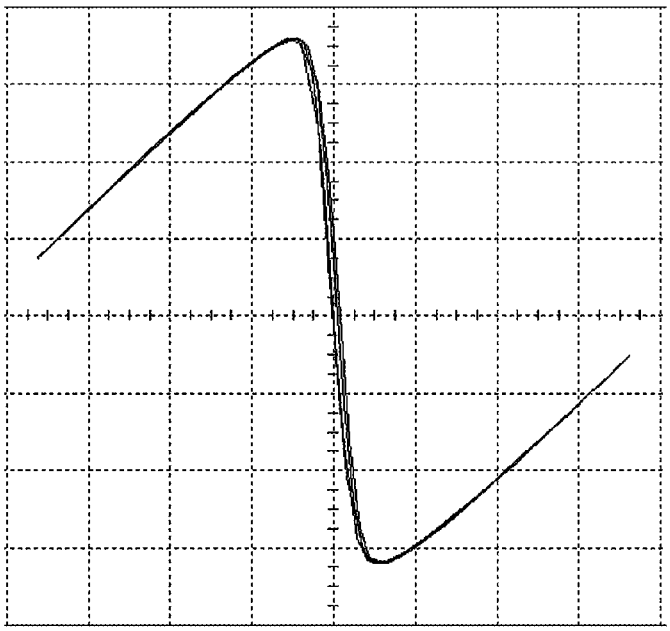
Figure 34A:
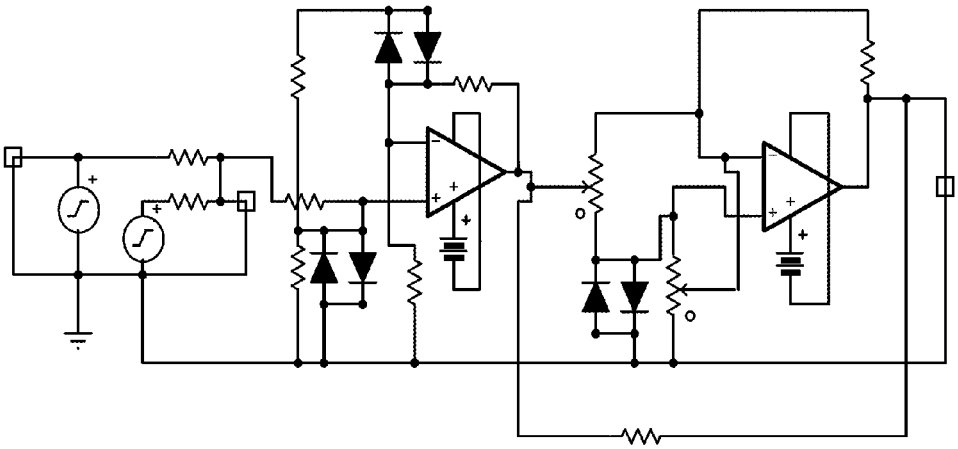
Figure 34B:
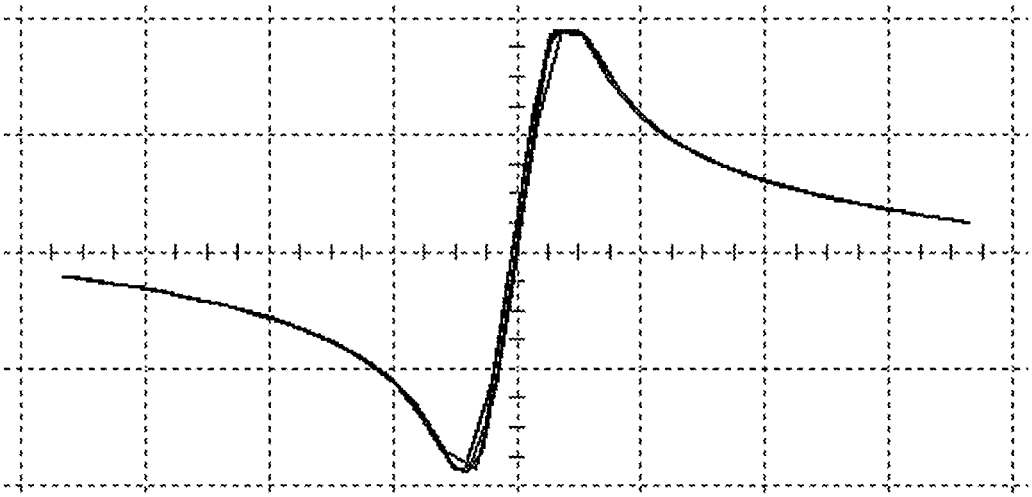
Figure 35A:
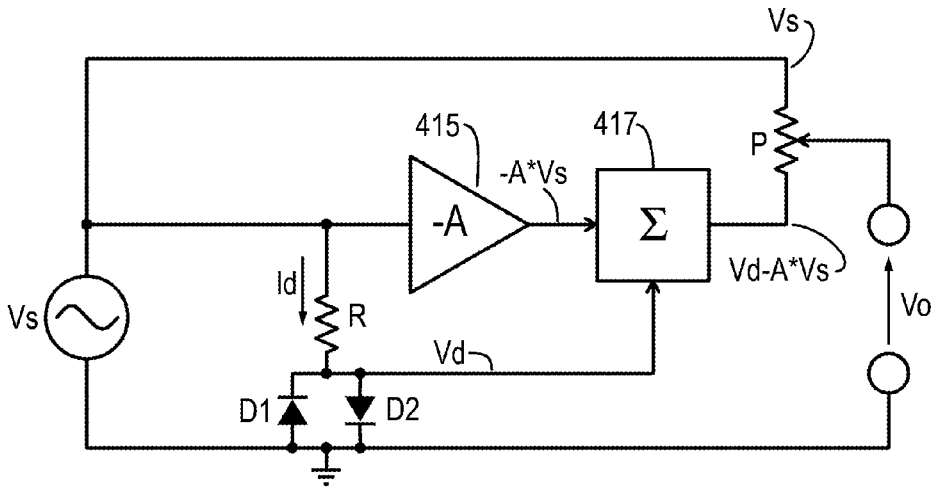
FIG. 35A-B—Show the block diagram and transfer function of the basic circuit that generates signal distortion based upon mixing logarithmic and linear signals.

FIGS. 32-50 Describe the on-Board Signal and Distortion Control Circuits FIGS. 32A-B show respectively a circuit developed and its transfer function, simulated in TINA-TI Ver. 7 (™Design-Soft, Inc.) by this inventor on Dec. 24, 2007. FIGS. 33A-B and 34A-B show similar circuits and their transfer functions, also simulated in TINA-TI by this inventor on Dec. 24, 2007. FIG. 35A shows the block function of basic circuit that produces such curves, with voltages calculated versus the input voltage, Vs, in FIG. 35B. Variations in components and their values in the other circuits produce the differences in curve shape.

Figure 35B:
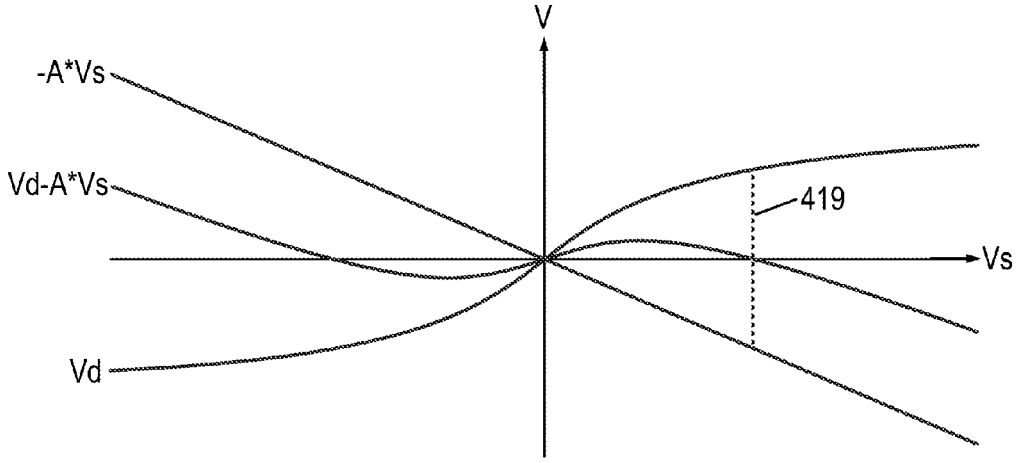

The basic circuit in FIG. 35A comprises just a few simple ideal component functions. Given a signal source, Vs, the resistor, R, and diode pair, D1-D2, form a non-linear voltage divider with a partially logarithmic current, Id, and a partially logarithmic output, Vd, as shown in FIG. 35B. The equation for a single ideal diode is:

$$Id = Is * \left(\exp\left(\frac{Vd}{n * Vt}\right) - 1\right). \quad \text{Math 4}$$

The equation for a pair of diodes in parallel, connected anode to cathode, is:

$$Id = Is * \left(\exp\left(\frac{Vd}{n * Vt}\right) - 1\right) - Is * \left(\exp\left(\frac{-Vd}{n * Vt}\right) - 1\right). \quad \text{Math 5}$$

The non-linear voltage divider in FIG. 35A cannot easily be solved for Vd directly, as the function is related to $x=y*e^{y}$. Instead, here it is plotted in a spread sheet and solved graphically using the equation:

$$Vs(Vd)=Vd+Id*R \text{ using [Math 5.].} \quad \text{Math 6}$$

It produces a plotted inverse function, Vd(Vs), in FIG. 35B that looks like something a stretched-out italic-*f*.

The circuit in FIG. 35A has an ideal amplifier (415) with gain −A, where 0<−A<−1, produces the signal, −A*Vs. An ideal summer (417) adds the signals to get Vd−A*Vs. Very near Vs=0, the function Vd(Vs) has a linear slope, with Vd=Vs. But for increasingly higher values of Vs, Vd increases logarithmically, which is much slower than A*Vs. So the italic-f curve can be warped toward zero at the ends, and made to recross the horizontal axis. As shown in FIG. 35B, this signal has a lazy-S, valley-peak function versus Vs, with three zeros. Note the third zero at the dotted line (419), where Vd=A*Vs. The outer zeros are modified by the gain, −A, by the resistor, R, and the characteristics of the diodes, D1 & D2. If a larger signal, Vs, is used, then the zeros fall closer to the vertical axis with respect to its peak-to-peak amplitude.

Adding the ideal potentiometer, P, produces an output, Vo, which can vary continuously from Vs to Vd−A*Vs with its setting. Thus the transfer function of the entire circuit, Vo(Vs), can vary from linear, Vo equal to Vs, then to Vd, which simulates 1960s tube amplifier distortion, then all the way to Vd−A*Vs. Which tends to emphasize third-order harmonics of Vs, for a more metallic sound, especially if components are used which are more non-linear, or more non-linearities are added, to produce sharper curves, as shown in FIGS. 32B, 33B and 34B.

Figure 36:
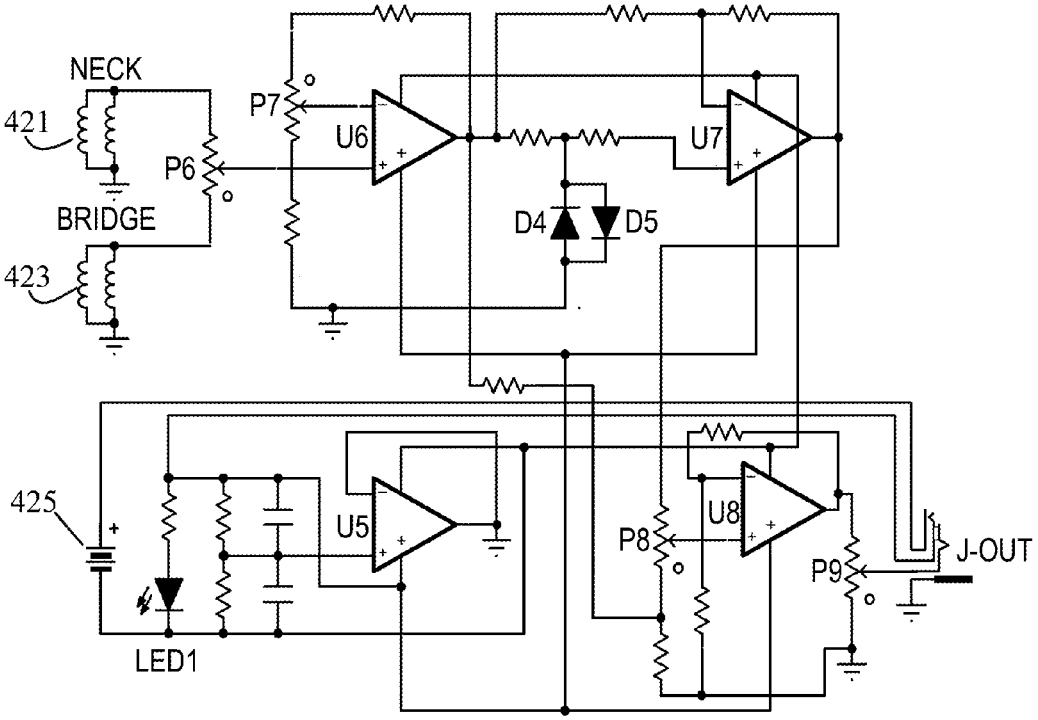
FIG. 36—Shows the embodiment of the circuit in FIG. 35, as installed in the inventor's guitar on or before Jan. 10, 2008.

FIG. 36 shows the circuit installed in a Fender Squier™ guitar on or before Jan. 10, 2008, using the basic circuit in FIG. 35. The routing of additional and expanded cavities in its body provided the space for another pickup at the neck, a plastic electronic breadboard and a 9-volt battery box. A new clear acrylic pickguard allowed mounting of the new pickup and additional controls. Phono jack J-Out contains a switch that complete the connection of the battery to the circuit when the phone plug is inserted, whereupon LED1 lights. Op-amp U5 is a ground-driver, which allows +V and −V supply voltages from a single battery (425).

Potentiometer P6 combines the signals from a double-coil humbucking pickup at the NECK (421) and one at the BRIGDE (423), changing the signal continuously between them. The warmest position, with the lowest content of higher harmonics, turns out to be the middle, where the two pickups are equally combined. Op-amp U6 is a preamp, with the positive gain controlled by P7. Raising the gain has the same effect as changing the gain −A in FIG. 35B closer to zero, which drives the outer zeros of Vd−A*Vs in FIG. 35B closer to the vertical axis, with respect to the amplitude of Vs. Diodes D4 & D5 provide the necessary logarithmic non-linearity. Op-amp U7 functions as the summer in 35B, further modifying the gain of the U6 circuit and changing it to negative. Potentiometer P8 serves the function of P in FIG. 35B, mixing the linear and non-linear signals equivalent to Vs and Vd−A*Vs. Op-amp U8 adds a final buffering and gain stage, with P9 as a volume control connected to the output jack.

Figure 37A:
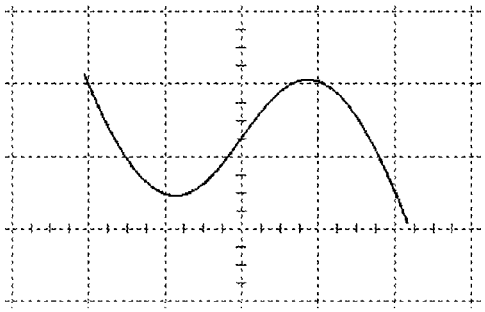
FIG. 37A-B—shows the simulated transfer function of FIG. 36, as the output versus the guitar pickup signal.
Figure 37B:
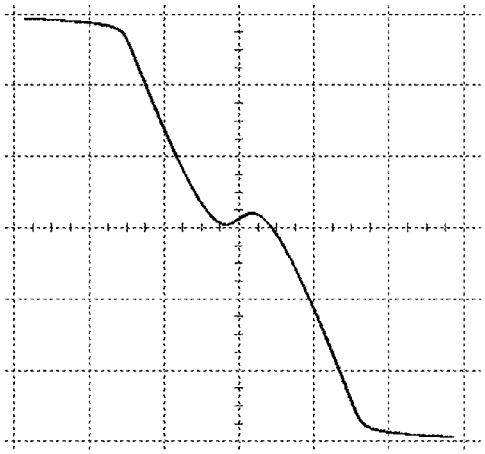

FIG. 37A shows the transfer function of the circuit in FIG. 36, simulated in TINA-TI, for a certain input signal, with P7 set at 1%, near the zero on the potentiometer symbol. It demonstrates a nearly symmetrical peak-valley, lazy-S curve, on a scale of 50 mV per division. Note that it has an uncorrected voltage offset from zero. FIG. 37B shows the transfer function for P7 set at 99%, on a scale of 500 mV per division, ten times higher. Here, the output signal has reached the limits of the battery power supply and is clipped at the upper and lower ends. Unless this kind of behavior is desirable, component selection and testing should be conducted for any change in or range of conditions, such as pickup model and mounting.

Figure 38A:
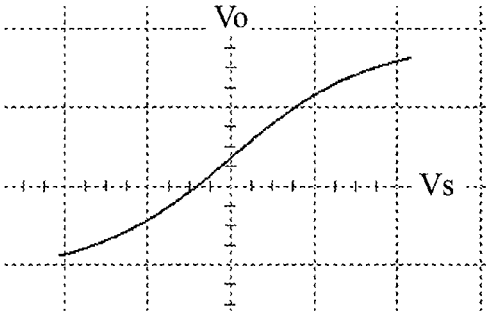
FIG. 38A-B—Shows how settings of the potentiometers in FIG. 36 can simulate 1960s tube amplifier distortion in the guitar output signal.
Figure 38B:
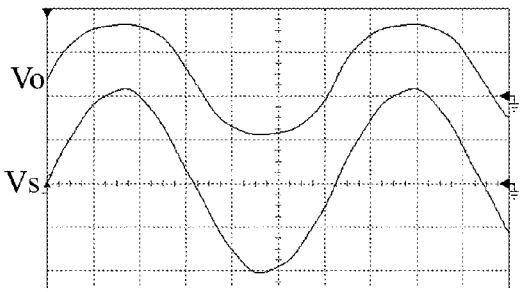
Figure 39A:
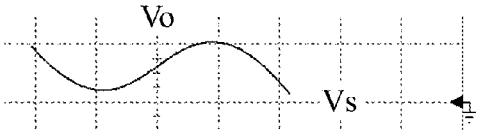
FIG. 39A-B—Shows how settings of the pots in FIG. 36 can produce an output dominated by the third harmonic of the guitar signal.
Figure 39B:
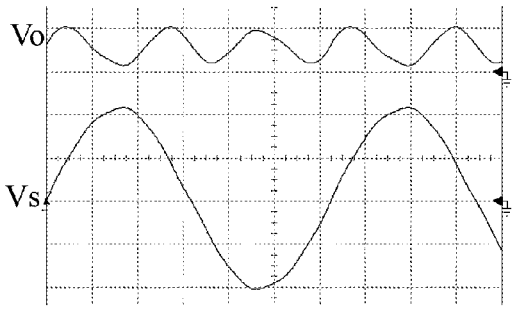

FIG. 38A shows the simulated transfer curve of the circuit in FIG. 36 with P7 set to low gain, and P8 set to about 30% nonlinear signal in the output. Note that it approximates 1960s tube amplifier distortion. For reference, FIG. 38B shows the amplified input signal, Vs, at the output of U6, and the output signal, Vo, of U8, both simulated. FIG. 39A shows the simulated transfer curve of the same circuit with P8 set at about 99% nonlinear signal in the output. FIG. 39B shows the amplified input signal, Vs, and the resulting output signal, Vo. Note that the output signal is virtually the third harmonic of the input signal and has a much lower amplitude.

Figure 40:
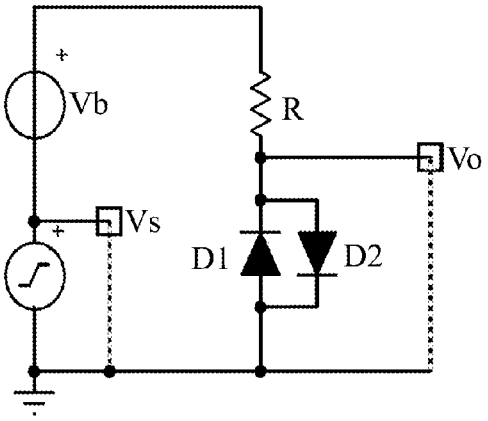
FIG. 40—Shows the basic diagram for a circuit that can produce a much wider range of simulated tube amplifier distortion, using a diode bias voltage to change the operating point, and shift the transfer function.
Figure 41A:
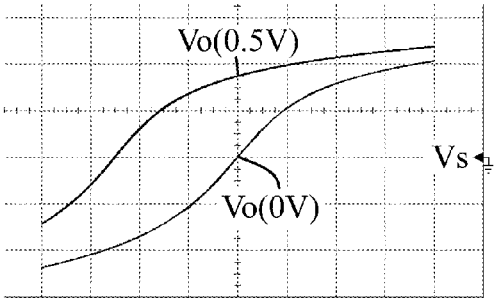
FIG. 41A-B—Shows the transfer functions and signals for zero and maximum bias voltages.
Figure 41B:
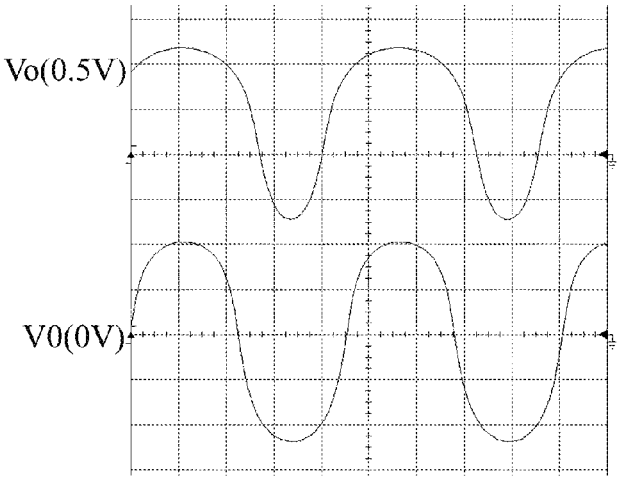

FIG. 40 shows a simple circuit to simulate 1960s tube amplifier distortion, using the non-linear voltage divider comprised of R, D1 and D2, with an output Vo. An added ideal voltage source, Vb, provides a bias voltage that shifts the operating point of the voltage divider from the symmetrical center of its transfer curve to the upper shoulder, as shown in FIG. 41A for Vb settings of 0 V and 0.5V. FIG. 41B shows the resulting signals, Vo(0V) and Vo(0.5V).

Figure 42:
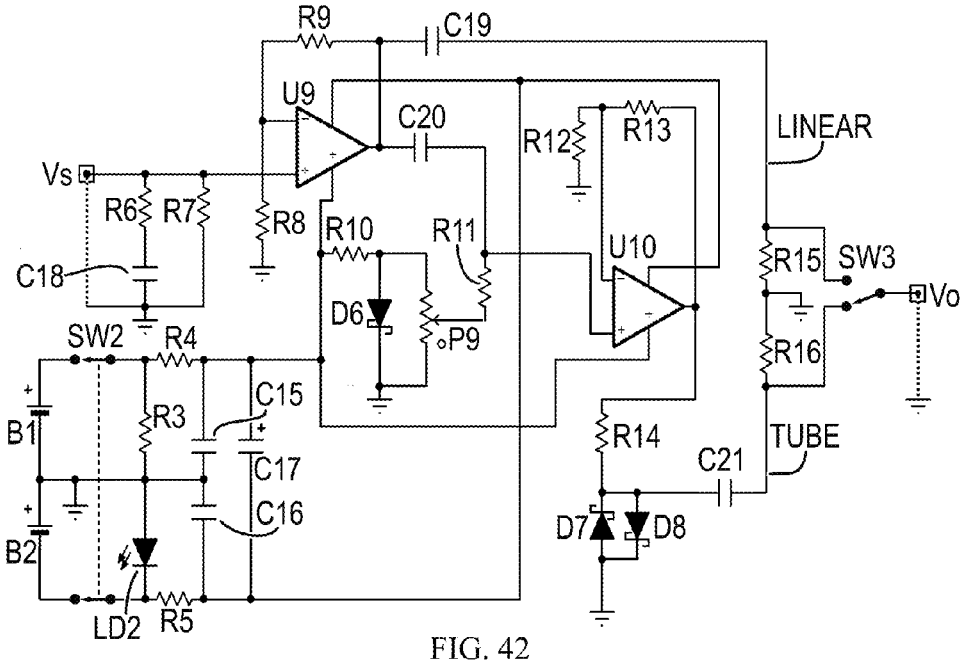
FIG. 42—Shows the embodiment of the circuit in FIG. 40, as installed in the fourth prototype guitar.

FIG. 42 shows the version of this circuit installed in the fourth prototype. It runs on two AA cells (B1, B2), and has enough output to drive a standard guitar amplifier, even though the pickups (FIG. 12, 65, 67) sit below the soundboard (FIG. 2, 69). When turned on, the DPDT switch, SW2, cause the power indicator (R3, LD2) to light, and powers the circuit through a noise filter (R4, R5, C15, C16, C17). The signal from the switched pickups and tuning capacitor (FIG. 29, 331) is applied at the signal input, Vs. A low-pass filter circuit (R6, R7, C18) impedes high frequency noise above 10 KHz. A preamp (U9, R8, R9) boosts the signal by a factor of about ten, and feeds the linear signal (LINEAR) to other parts through capacitors (C19, C20). The variable bias circuit (R10, D6, P9) performs the function of Vb in FIG. 40, via the signal blocking resistor (R11) and amplifier (U10, R12, R13). This drives the non-linear voltage divider (R14, D7, D8), which produces a signal like tube amplifier distortion (TUBE). A switch with ground-bleeder resistors (SW3, R15, R16) provides the instrument player with a choice of LINEAR or TUBE signals.

Figure 43A:
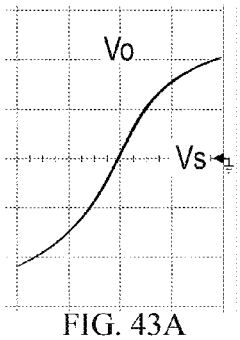
FIG. 43A-B—Shows the simulated transfer function, input signal and output signal of FIG. 42 for zero diode bias.
Figure 43B:
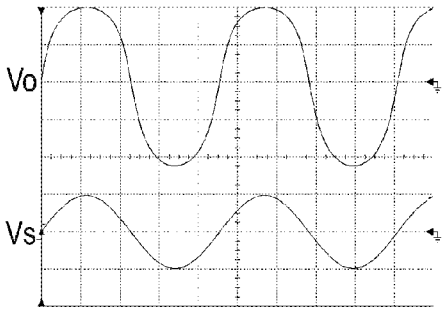
Figure 44A:
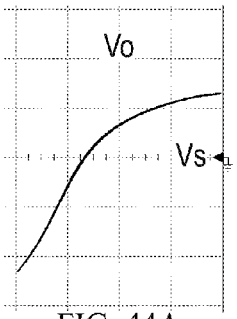
FIG. 44A-B—Shows the simulated transfer function, input signal and output signal of FIG. 42 for maximum diode bias.
Figure 44B:
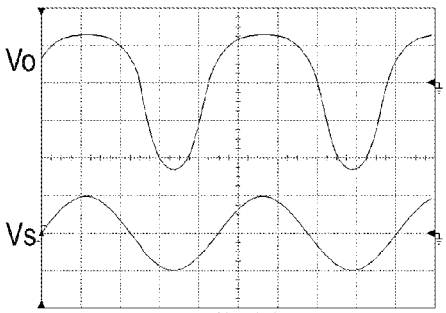

FIG. 43A shows the TINA-TI-simulated transfer curve of Vo(Vs) for P9 set near ground for low bias voltage. FIG. 43B shows the resulting simulated signals for Vs and Vo with respect to time, not at the same vertical scales. Note the result for a transfer curve with a nearly symmetrical italic-f character. FIG. 44A shows the simulated transfer function of Vo(Vs) for P9 set to high bias, near the full voltage across D6. Note that the curve is an extension of that in FIG. 43A, with the operating point of the signal up on the positive shoulder. FIG. 44B shows the resulting simulated signals for Vs and Vo. Note the highly non-linear, non-symmetrical result. In practice, the transfer curve is a bit more extreme, and produces a kind of string-popping effect, with a burst of tone which quickly tapers off in amplitude to a much lower signal, an effect that had not been heard before by the professional musicians who initially reviewed it. Otherwise, the lower bias settings sounded to one musician like a 1960s tube amplifier.

Figure 45:
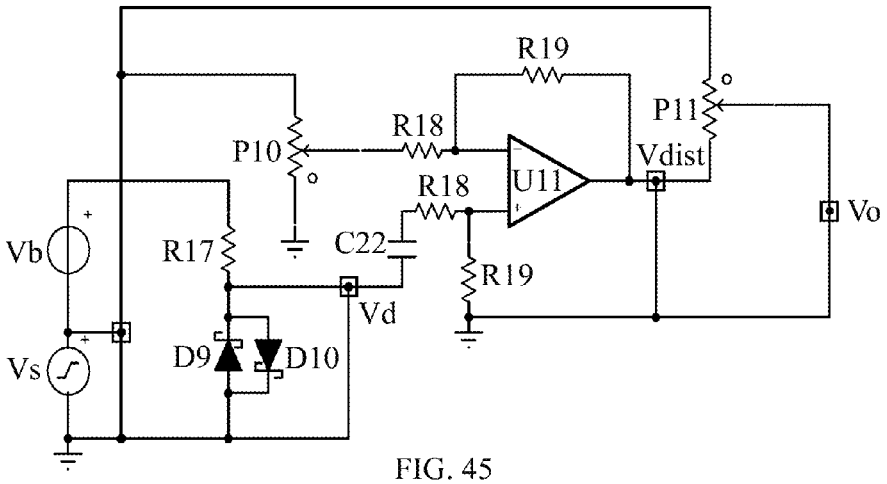
FIG. 45—Shows how to combine the basic circuits in FIGS. 35A & 40.

FIG. 45 shows the combined functions of FIG. 35 and FIG. 40. The linear signal, Vs, is added to a bias signal, Vb, and applied to the non-linear voltage divider (R17, D9, D10) to generate the non-linear signal, Vd. Potentiometer P10 provides a fraction of the linear signal, A*Vs, which is applied to the negative input of the summing amplifier (U11, R18, R19). There are two resistors each of R18 and R19, because they are the same values, respectively. They produce a summing amplifier gain of G>1. The signal Vd is applied through the DC voltage blocking capacitor (C22), which removes the bias voltage, Vb, to the positive input of the summing amplifier. Thus, if Vs and Vd are measured in volts peak-to-peak, the distortion signal, Vdist, has an AC peak-to-peak value of:

$$Vdist=G*(Vd-A*Vs),\ \text{where } G>1, \text{ determined by } R18 \text{ and } R19, \text{ and } 0<A<1. \qquad \text{Math 7}$$

Figure 46A:
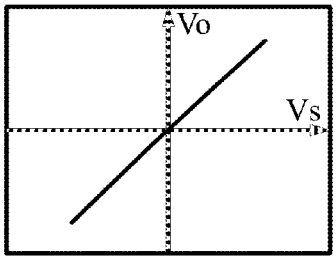
FIG. 46A-B—Shows the transfer function and output signal in FIG. 45, for controls set to produce the linear input signal at the output.
Figure 46B:
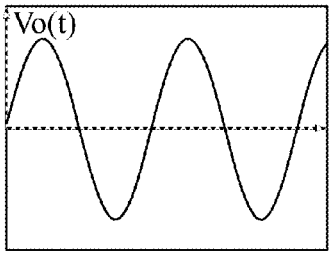

The output potentiometer, P11, provides an output voltage, Vo, which is a continuous mixture of signals from Vs to Vdist. FIG. 46A shows the Vo(Vs) transfer curve when P11 is set to 0%. FIG. 46B shows the resulting signal, Vo(t), displayed here as a sine wave, and equal to Vs. For a given input signal, Vs, varying Vb, P10, and P11, with G as a parameter, a wide variety of timbres can be obtained from the fundamental frequency of Vs through the second harmonic to the third harmonic. For P11 set to 100%, Vo is equal to Vdist. For setting of P11 in between, expressed as the fraction, Vo has an peak-to-peak value of:

$$Vo=(1-B)*Vs+B*G*(Vd-A*Vs),\ \text{where } B=P11\%\text{-setting}/100, \text{ or } Vo=(1-B*(1+G*A))*Vs+B*G*Vd \qquad \text{Math 8}$$

Thus Vo is only a function of Vd, if:

$$B=1/(1+G*A)\Longrightarrow Vo=B*G*Vd \qquad \text{Math 9}$$

Figure 47A:
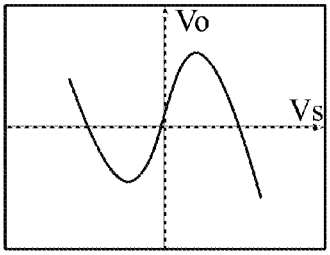
FIG. 47A-B—Shows the transfer function and output signal for settings to produce an output signal dominated by the third harmonic of the input signal.
Figure 47B:
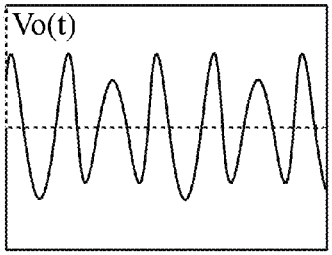
Figure 48A:
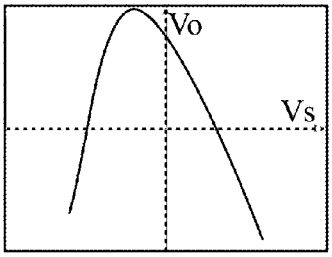
FIG. 48A-B—Shows the transfer function and output signal for settings to produce an output signal dominated by the second harmonic of the input signal.
Figure 48B:
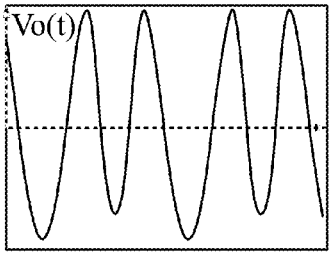

There are two special cases for B=1, or Vo=Vdist, one for Vb=0 and one for Vb=some Vbmax, where Vb is adjustable between 0 and Vbmax. FIG. 47A shows the one for Vb=0, where A is set so that the transfer curve of Vo(Vs) folds with the two most positive values of Vo are closest to each other, while the two most negative values of Vo are closest to each other. This produces the output shown in FIG. 47B, Vo(t), which has the highest possible component of the third harmonic of Vs. In this example with the components and particular amplitude of Vs chosen, this happens to occur for A=0.38. FIGS. 48A and B show the other case, where Vb=Vbmax, and A is set so that the two most negative values of Vo(Vs) are closest to each other, so that Vo(t) has the highest possible content of the second harmonic of Vs. In this particular example, this happens to occur for A=0.25.

Notice that the peak-to-peak amplitudes in FIGS. 46B-48B are not equal. Because Vdist is the difference between the non-linear and linear signals, it is generally smaller in peak-to-peak amplitude than the linear signal, Vs. G is set so that the geometric mean of the peak-to-peak amplitudes of Vo(t, Vb=0) and Vo(t, Vb=Vbmax) is roughly equal to the peak-to-peak amplitude of the chosen typical Vs. This makes the log difference between Vs and the two extremes of Vdist(Vb) about the same. In this particular example, it was about 15.2 and thus may be on the order of 10 to 20. But without further compensation, the peak-to-peak amplitude of Vo will still change with the settings of Vs, Vb, P10 and P11.

Note also that the conditions in FIGS. 47-48 can only occur for one amplitude of the input signal, Vs. Absent any other circuit to compress or equalize the amplitudes of signals from electrified stringed instrument from, a plucked or struck string generates a dynamic signal, decaying in amplitude with time. If Vs starts out larger than that needed for the Figures, the fundamental harmonic component of Vo will start out inverted compared to Vs, and decrease as the signal passes through the conditions of FIGS. 47-48. It will gradually reassert itself as Vs becomes smaller than that condition.

An improved embodiment covered by this patent shall include an automatic gain or compensation control, whereby A in FIG. 35A is inversely proportional to a running average of the peak-to-peak magnitude of the string vibration signal, Vs. A running average of the magnitude Vs over a limited time or number of cycles will keep the zeros (FIG. 35B, 419) in Vd−A*Vs relatively constant in the output signal, Vo, while allowing the it to retain the dynamic nature of Vs. This kind of circuit has been applied in radios for decades; the trick here is knowing that it must be applied to the value of A.

The electronic timbre imposed by this circuit will be highly dependent upon the setup of the pickups, guitar, circuit components and settings, and the style of play, soft or hard and aggressive. Nevertheless, this simple circuit provides huge continuous changes for the player in the dominant timbre of the stringed instrument's electronic output, from the fundamental to the third harmonic.

Figure 49:
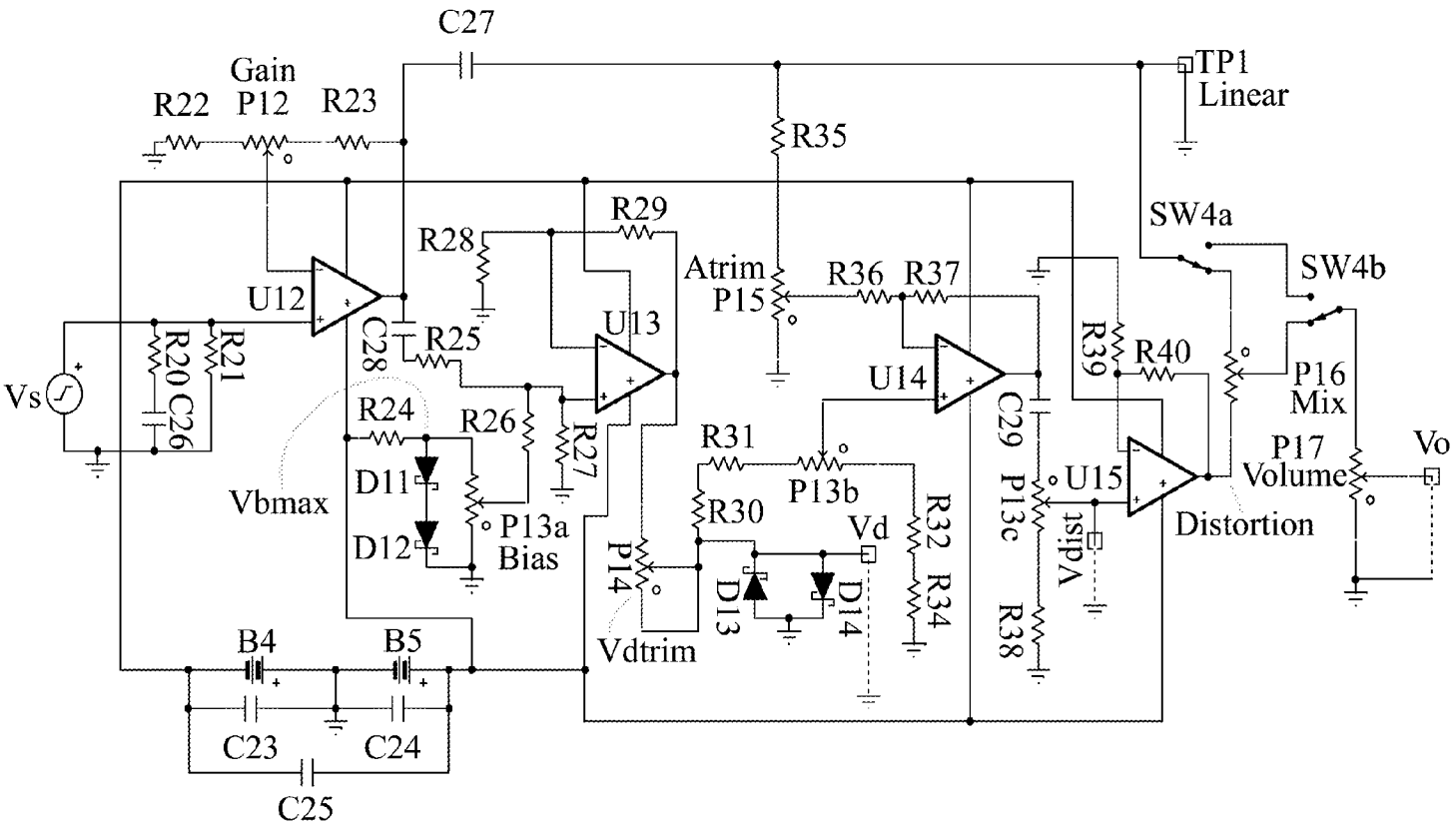
FIG. 49—Shows an embodiment of the basic circuit in FIG. 45, which is compensated to minimize changes in output amplitude for changes in diode bias and mixing of the linear and distortion signals.

FIG. 49 shows an embodiment of the circuit in FIG. 45 which has been simulated in TINA-TI. It provides the functions of that circuit, plus a variable-gain pre-amp and amplitude compensation so that the output conditions in FIGS. 46B-48B have nearly equal peak-to-peak amplitudes. For clarity, the terms Vs, Vd, Vdist and Vo have been retained. The circuit is powered by two batteries (B4, B5), filtered by three capacitors (C23, C24, C25). The input has a low-pass noise filter (R20, R21, C26), connected to a variable-gain pre-amp (U12, R22, R23, P12(Gain)), feeding out through DC blocking capacitors (C27, C28) to the rest of the circuit.

Figure 50A:
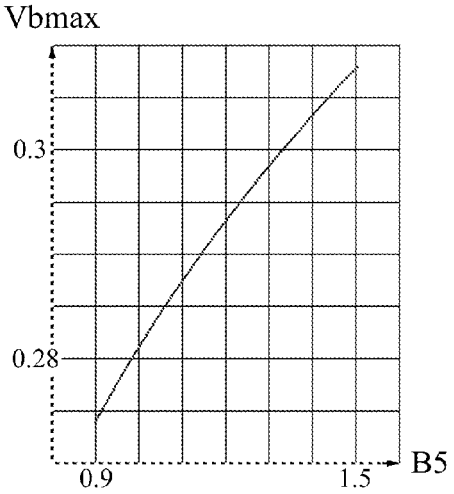
FIG. 50A-C—Shows the estimated variation in maximum bias voltage in FIG. 49 with changes in battery voltage, and the transfer functions for the non-linear voltage divider used in FIG. 49.

In lieu of a semiconductor precision voltage reference in TINA-TI, the maximum bias voltage, Vbmax, in FIG. 45, Vb, is derived here from a pair of diodes in series (D11, D12), driven from the positive supply (B5) through a resistor (R24). It could be replaced by such devices as the LM285 and LM234. FIG. 50A shows an estimated typical response of Vbmax to changes in the voltage of battery B5, on the order of 0.31V to 0.27V (or −13%) in Vbmax for changes of 1.5V to 0.9V (or −40%) in B5, as B5 discharges. Assuming that B4 and B5 have capacities of at least 1500 mA-Hr, the batteries should last on the order of 400 hours of operation. So the effect on the character of the output signal should be gradual over that time. An improved embodiment covered by this patent shall include a precision voltage reference of value on the order of 0.3 to 0.6 volts.

Figure 50B:
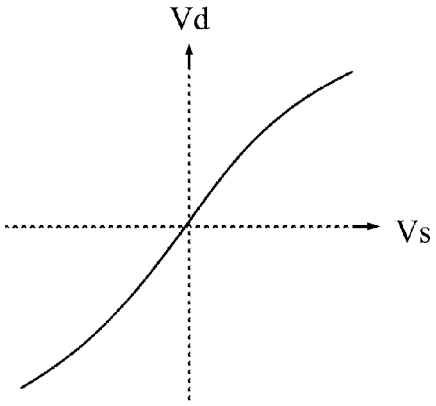
Figure 50C:
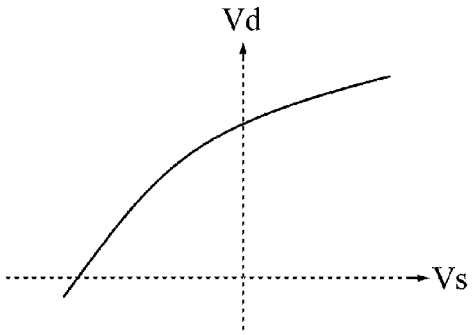

A variable portion of Vbmax, taken from the first gang (P13*a*(Bias)) of a 3-gang potentiometer (P13*a-c*), is summed with the amplified input signal, Vs, through an amplifier with a gain between 1 and 2 (U13, R25, R26-R29). This is applied to a non-linear voltage divider (P14, D13, D14), which generates the non-linear signal, Vd(Vs). FIG. 50B shows the approximate shape of this signal for Vb=0. FIG. 50C shows the approximate shape and offset of Vd(Vs) for Vb=Vbmax.

A portion of the linear signal, Vs, taken from a voltage divider (R35, P15(Atrim)) is subtracted from it in a summing amplifier (U14, P13*b*, R30-R34, R36, R37), to which a portion of Vd is added. The summing amplifier has a gain between 10 and 20. The result is applied a DC blocking capacitor (C29) to a voltage divider (P13*c*, R38) to generate the distortion signal, Vdist. The second gang (P13*b*) of P13 turns in lock step with the others. The values of all the resistances (P15, R30-37) associated with D13, D14 and U14 are chosen so that for a given amplitude of Vs and gain of the pre-amp via P12, and a single setting of P15(Atrim), the signals for Vdist, as a function of Vb equal to zero and Vbmax, are the same character as FIGS. 47 & 48.

The value of resistor R38 then ensures that the output of the third gang (P13*c*) of P13 produces signals like FIGS. 47 & 48 with the same amplitude. The gain of the amplifier formed on U15 (U15, R39, R40) ensures that those amplitudes are approximately the same as the signal of Vs after amplification by the pre-amp (U12, P12, R22, R23), called Linear at Test Point 1 (TP1). The output of U15 is called Distortion. The Linear and Distortion signals are applied to either end of the Mix potentiometer, P16, allowing a continuous and linear mixture of those signals. The optional double-pole, double-throw switch, SW4, provides the Volume pot (P17), and output, Vo, with choice of Linear or Mixed signals, in case the non-linear parts of the circuit become malfunctioning or maladjusted.

As a consequence of all these manipulations in amplitude, for the particular input signal, Vs, that produces outputs at Vo with the character of FIGS. 46-48, the amplitude of Vo does not markedly change with changes in the settings of P13 and P16. This may save the stringed instrument player the pain of making many more adjustments for every change in the Bias and Mix controls. As a consequence, P15(Vdtrim) and P16 (Atrim) need not have external control knobs, and can be set for a particular guitar, with infrequent adjustments needed only for the player's preferred style of play, or changes in pickup model or spatial adjustments in the guitar.

I claim the following, and as a Pro Se inventor with limited resources request the help of the Patent Examiner to state these claims correctly:

1. An improvement for mounting electric vibration sensors in conventional stringed instrument at any point on said instrument, comprising:

a. sensors for transforming the vibrations of body parts and strings of said stringed instrument into electric signals of an audio nature, b. a plurality of paired and marked mounting points for said sensors in or on said face of said instrument, placed on opposite sides of said strings in the area between the neck and tailpiece of said instrument, near line positions perpendicular to said strings, said line positions placed near mathematical projections of the fret scale of said neck, called here virtual fret marks, visibly marked on the body of said instrument beside said mounting points, c. a mounting and adjustment system, capable of placing said sensors in a plurality of positions and orientations in a cavity or a face of said stringed instrument, allowing for at least five degrees of freedom, based upon mounting plates containing a hole and a slot, said hole used to mount one end of said sensor via a spring and screw, with said mounting plate shaped such that said mounting plate can rotate about said sensor mounting screw at least 180 degrees relative to said sensor without interfering with the body of said sensor, said slot affixed either of said paired mounting points, with another of said mounting plates at the other end of said sensor, such that said sensor with a pair of mounting plates can rotate about and slide to and from said mounting points, and adjust in distance from said strings, whereby each of said ends of each said sensor can be moved independently toward and away from said strings, giving two degrees of freedom, and whereby each said end of said sensor can move independently along the direction of said strings, to positions between said neck and said tailpiece, giving two more degrees of freedom, and whereby each said sensor can move across the direction of said strings, perpendicular to a line between said neck and said tailpiece, giving one more degree of freedom, thereby allowing the player to choose and change the number, kinds and orientations of said sensors mounted upon said instrument.

2. An improvement as recited in claim 1, further comprising a marked scale in the direction of said strings, to one side of each line of said mounting points, on both the upper and lower surfaces of the body of said instrument, further comprising:

a. wherein any of said virtual fret marks is at a distance from said bridge of said instrument by a factor of one divided by two raised to the 1/12 power, approximately 0.943874, times the distance from said bridge to an adjacent virtual fret mark which is closer to said neck, or the adjacent last fret of said neck, b. a plurality of distinguishing visible marks on said body to each side of said strings at virtual fret marks in each octave, further comprising:

i. lines at every virtual fret mark, until said lines are too close together to be legible and distinguishable from one another, and ii. larger symbolic markings, corresponding to the traditional fret dots on said neck, until said markings are too close together to be legible and distinguisable from one another.

3. An improvement as recited in claim 1, wherein said mounting plates have one or more layers of vibration-absorbing material at contact points against said mounting points and said sensors, with cutaways to pass said screws and said connectors, to control unwanted conduction of undesired vibrations from said body to said sensors.

4. An improvement as recited in claim 1, wherein said mounting points are slides in tracks in or mounted to said body, to facilitate movement of said ends of said sensors along said strings, such that said slide can be held in a fixed position in said track by a mounting point screw, without bearing upon the bottom of said track, to hold said slide there by resulting friction.

5. An improvement as recited in claim 1, wherein said mounting plate further comprises:

a. a reinforcing ridge on the surface opposite said body of said instrument, with a cutaway about said mounting plate slot to pass the head of a mounting connector, and a cutaway to pass a head of a mounting screw for said string vibration sensor, also known as a pickup, b. a reinforcing ridge on the surface toward said body of said instrument to guide and support said pickup mounting screw, whereby said ridges lighten and stiffen and strengthen said mounting plate.

6. An improvement to the body of a stringed instrument, comprising:

a. a plate-like and removable acoustic soundboard, also known as a top or top cover, mounted on the top surface of said body of said instrument, with the upper surface of said soundboard, away from said body, being a decorated surface, with a bridge assembly on said upper surface of said soundboard, which said mounting of said soundboard on said body allows acoustic vibrations across the entire surface of said soundboard, from interior to edges, except where said soundboard is fixed to said body, i. being fixed to said body with removable connectors and adjustable in height above said body at two points adjacent to the neck of said instrument, ii. being fixed to said body at and under a tailpiece, iii. being fixed to said body with connectors in approximate line with said bridge at the sides of said body, said line called the bridge line or intonation line, an average of positions on said strings from said neck and the nut of said instrument to assure nearly correct intonation, iv. having incorporated into said soundboard an electrostatic shield, over most of its extent, connected to the output ground of said instrument, for the purpose of shielding any sensors or electronics incorporated into said instrument, v. with said bridge fixed to said soundboard between said soundboard and said strings for the purpose of adjusting the height of said strings above said soundboard, adjusting the intonation of said strings, and transferring the vibrations of said strings to said soundboard, b. a tailpiece, with slots in the surface facing said bridge through which said strings of said instrument may pass, but the buttons on the ends of said strings may not, so that said strings are captured and positioned vertically and horizontally with respect to said bridge at the points where they exit said tailpiece, and with an electronic connection between said strings and said output ground of said instrument, c. a decorated plate-like and removable bottom cover or back, fixed to said body with removable connectors, incorporating electrostatic shielding being electrically connected to said output ground of said instrument, wherein said soundboard vibrates independently from said body over much of its surface free of restrictions due to lack of connection at its edges to said body, allowing said body to vibrate at lower modes, wherein said soundboard and said bottom cover may be removed to gain access to any said sensors or electronics in said body, wherein said sensors and electronics may be mounted out of sight beneath said soundboard for the purpose of unobstructed decoration and improving or changing the timbre of said soundboard by removing the inertia and movement of said sensors or electronics.

7. The improvement to the body of a stringed instrument of claim 6 further comprising:

a. two screw plates placed on or in said body at the sides of said body, in line with each other and said bridge, with a series of threaded holes on said bridge line, b. two bearing plates placed on the bottom of said soundboard, above said screw plates, with non-threaded holes aligned with said threaded holes in said screw plates, and with holes in said sound board, said non-threaded holes in said bearing plate and said sound board sized to pass the threads of adjustment screws, c. two or more of said adjustment screws, having flat heads, screwing into each of said screw plates, pushing upwards against said bearing plates, providing at both ends of said bridge line independent control of the height of said soundboard, and hence said bridge, above said body, d. two or more of adjustment screws passing through each side of said soundboard and each of said bearing plates, so as to hold said soundboard down against said flathead adjustment screws, whereby said adjustment screws and plates provide fine adjustments of the inclination along said bridge line and in the height of said bridge, independently at both sides of said body, and provide a means to eliminate rattle of said soundboard at said adjustment points with opposing pressures, and provide a means of bowing said soundboard upwards at said bridge to counteract sagging due to aging of said soundboard and string pressure, and provide a means to affect changes timbre by adjusting the resulting tension in said soundboard and by moving said adjustment screws to different positions on said screw plates.

8. The improvement to the body of a stringed instrument in claim 6 further comprising said bridge on said soundboard, situated vertically between said strings and said soundboard and horizontally between said tailpiece and said neck, closer to said tailpiece, over a cavity in said body, such that said bridge transmits vibrations from said strings to said soundboard, and such that said bridge adjusts the rough height of said strings above said soundboard, by means of removal of material from said bridge and an acoustically rigid spacing plate, otherwise known as the bridge base, between said bridge and said soundboard, with said bridge and said base mounted to said soundboard by removable connectors, and such that the intonation of said strings can be adjusted by removal of material from said bridge surface facing said neck, and by horizontal set screws in said bridge bearing upon said removable connectors to said soundboard, further comprising, a. an upper part, otherwise known as said bridge, in contact with said strings on its upper surface, from which upper surface material may be removed to accommodate the radius of the frets and fretboard of said neck, and from which upper surface material can be removed in notches to affect string holding, rattle and position across said bridge at string bearing points on said bridge line, and from which upper surface material can be removed from said bearing points towards said tailpiece and said neck to reduce string rattle, and from which material may be removed from the upper surface of said bridge and the surface facing said neck to affect the individual intonation of said strings, with vertical slots at each end of said bridge, roughly parallel to said strings, though which said removable connectors pass, said slots roughly divided into equal parts by said bridge line, so that the average intonation of said strings can be adjusted by moving said bridge under said removable connectors in the direction of the neck, b. a lower part, otherwise known as said bridge base, between said bridge and said soundboard, roughly uniform in thickness with holes situated roughly on said bridge line, underneath said intonation adjustment slots in said bridge, through which said removable bridge connectors pass into said soundboard, c. said removable connectors, passing through said bridge and said bridge base into said soundboard, for the purpose of holding said bridge and said bridge base in position and correct intonation, and for removal of said bridge and said base without removing said strings, d. said horizontal set screws, residing in said bridge slots roughly parallel to said strings, to bear upon said removable connectors, so as to affect the average intonation of said strings, and allow said bridge to be removed for the removal of material or replacement of strings, and replaced in the same position without changing the average intonation of said strings.

9. The improvement to the body of a stringed instrument of claim 6, wherein the soundboard is not fixed to said body between said bridge and the end of said body furthest from said neck, but instead is held to said body by the downward pressure of a removable and decorative tailpiece, further comprising:

a. a decorative and functional top part of said tailpiece, into which holes are fabricated to accept buttons of said strings, also known as the eyes of said strings, b. slots fabricated to pass said strings from said buttons to said bridge while holding said buttons and said strings in place, and angled off the lines of said strings to prevent said strings from rattling in said slots, c. at least one electrically conducting connection between all said strings and a point on said body for the purpose of grounding said strings to said instrument output ground, to reduce electrical noise and reduce static from the body of said instrument's player, d. a decorative and electrically conducting hinge affixed to both said instrument body at the end furthest from the neck and said tailpiece top, part of the circuit to said ground, with a removable pin, such that an imaginary line between said pin and the points at which said strings exit from said tailpiece lies at an angle below the line of said strings from said tailpiece to said bridge, urging said tailpiece down upon said soundboard, providing a means to hold said strings in relation to said bridge and said neck, to conduct vibration from said strings to said soundboard, and to hold said soundboard against said body at that point, as well as to express the user's visual style.

10. The improvement to the body of a stringed instrument of claim 6, comprising: a section of said soundboard, fixed by removable connectors to the edges of a box-like structure, otherwise known as an electronics compartment, containing batteries, electronics and controls, attached to the end of said body of said instrument furthest from said neck, otherwise known as the tail end, and a simple top-loading tailpiece, further comprising:

a. said top-loading tailpiece with a section on the vertical wall of the side facing said bridge tending away from said bridge, so as to keep or force said buttons of said strings downward towards said soundboard, with one or more vertical slots in said tailpiece, to accept said strings, sized and spaced so as to maintain the tendency in angle and spacing of said strings from said neck, while keeping said buttons of said strings from passing through, b. removable connectors, i. passing through said tailpiece and soundboard into said body of said instrument, shortly behind said bridge, and ii. passing through said soundboard and said bottom cover into said edges of said electronics compartment, c. said electronics compartment, covered on the top by said soundboard and on the bottom by said bottom cover, with removable connectors passing through said soundboard and said bottom cover into the edges of said compartment, said controls attached to and through said soundboard and the sides of said electronics compartment, with grounded electrostatic shielding incorporated into all sides of said compartment, thus allowing for more room between said tailpiece and said tail end of said instrument for said batteries, electronics and controls, and a mounting area on said soundboard which will be acoustically isolated by said removable connectors from the vibrating area of said soundboard.

11. The improvement to the body of a stringed instrument of claim 6 further comprising one or more other electronic vibration sensors attached upon it or incorporated within it to pick up other modes or timbres of vibrations in said soundboard at different points upon it, so as to offer the player more choices of sound.

12. The improvement to the body of a stringed instrument of claim 6 wherein said soundboard has side scallops, otherwise known as c-bouts, in close proximity to said bridge line, such that said soundboard is more flexible and able to carry vibrations from said bridge to the portion of said soundboard between said bridge and said neck, than said soundboard without c-bouts, whereby the acoustic output of said soundboard is increased.

13. An improvement to said soundboard in claim 6, wherein said soundboard has one or more fixed holes so that any of said sensors mounted within said body rise through said soundboard without making contact with said soundboard, for the purpose of positioning said sensors closer to said strings, without adding their mass and inertia to said soundboard, and thus inhibiting acoustic vibration.

14. A pickup switching system for electric stringed instruments that use electromagnetic coil sensors to sense the vibrations of ferrous-like metal strings, also known as pickups, so as to reduce the pickup of external electromagnetic noise from other sources, also known as humbucking, with two or more switched tone capacitors in parallel with the pickup output, comprising:

a. a pickup switching system that connects K single-coil pickups, all with equal numbers of turns in their coils, two at a time, such that when two of said connected pickups have opposite magnetic poles upwards, their signal outputs are connected together in phase, and when two of said connected pickups have the same magnetic poles upwards their signal outputs are connected together out of phase, producing $(K*(K-1)/2)$ parallel-connected humbucking pair outputs and $(K*(K-1)/2)$ series-connected humbucking pair outputs, for a total of $(K*(K-1))$ humbucking pair outputs, and for K greater than 3, a number of humbucking quad outputs from humbucking combinations of four of said single-coil pickups, b. a switch of one or more poles and two or more positions, connected to two or more of said capacitors with one or more resistors of high value, typically one MegOhm or more, also known as bleeder resistors, across one or more of said capacitors, typically with the highest values of capacitance, to provide slow discharge of said capacitors to avoid switching noise, with one position which is not connected to any of said capacitors, with a potentiometer connected in series with said switched capacitance, to damp its effect, the resulting capacitance of said switched capacitance and potentiometer connected in parallel with said humbucking output of said pickup switching system, whereby said pickup switching system provides the instrument player at least (K*(K−1)) choices of humbucking outputs, such that in the instance of three of said matched single-coil pickups, it provides six humbucking pair outputs, such that in the instance of four of said matched single-coil pickups, it provides 12 humbucking pair, multiplied by the number of capacitor switch positions, wherein three of said single-coil pickups and a 3-position capacitor switch provide at least 18 choices of tone and timbre, and wherein four of said single-coil pickups and a 12-position capacitor switch, provide at least 144 choices of tone and timbre, plus the optional action of said tone potentiometer.

15. The pickup switching system of claim 14 wherein said matched single-coil pickups are designated as associated pairs, and connected together to assure humbucking by the functional equivalent of a double-pole, multiple-throw switch, such that one signal wire of one said pickup is connected to the high signal output, and a signal wire of the other said pickup is connected to the low signal output, otherwise known as the circuit ground in single-ended non-differential systems, leaving the remaining connections of said pickup pair to be switched, whereby the number of necessary switching poles for each said associated pair is reduced from four to two, generally in exchange for a lower number of humbucking connections than K*(K−1), where K is the total number of said pickups, such that:

a. in the instance of a number Knsp of said associated pairs with one north pole up and one south pole up, generally connected together so that their signals are in phase, said switching system can provide at least 2*Knsp humbucking connections within said associated pairs and Knsp*(Knsp-1) humbucking cross-connections between said associated pairs, and b. in the instance of a number Knnp of said associated pairs with two north pole ups, generally connected together so that their signals are out of phase, said switching system can provide at least 2*Knnp humbucking connections within said associated pairs, and at least Knnp*(Knnp-1) humbucking connection between said associated pairs, and c. in the instance of number Kssp of said associated pairs with two south poles up, generally connected together with signals out of phase, said switching system can provide at least 2*Kssp humbucking connections within said associated pairs, and at least Kssp*(Kssp-1) humbucking connections between said associated pairs, and d. in the instance that said Knsp, Knnp and Kssp associated pairs exist in said switching system, it can provide at least 4*Knsp*Knnp plus 4*Knsp*Kssp plus 2*Knnp*Kssp additional humbucking connections between said associated pairs, and e. in the instance of said associated pairs with the same pole up, if said pickups in one or more of said pairs are both reversed in signal polarity compared to at least one other of said pairs, said switching system may provide extra interconnections between said pairs, not calculated above.

16. The pickup switching system of claim 14 comprising circuitry for sequentially reducing the high-frequency peak or roll-off due to the resulting connection said humbucking pickup output with the resulting equivalent capacitance of said switched capacitors, by approximate steps of multiple fret units, M, otherwise known as factors of 2 to the power −M/12 in Western musical theory, comprising of:

a. said capacitors connected in series, connected to ground at one end of said series, with the switched terminals of said switch, commonly known as throws, connected at the junctions between said capacitors, with values of resulting switched capacitance chosen to approximate the equivalent capacitance to ground, necessary to facilitate said fret steps in frequency response, b. two or more of said high value resistors, one connected in parallel with the grounded capacitor of said series, and the other connected from the other end of said capacitor series to ground, to inhibit electrical noise from the switching of said circuit, whereby the frequency roll-off steps produced by the circuit provides a monotonically increasing or decreasing progression to fit some desired rate and range of tone control, as determined by said factor M and the number of switch positions.

17. The pickup switching system of claim 14, comprising a. said pickups connected via female plug connectors with at least three pins, the center of which is grounded, so the plug may be reversed, allowing reversing the phase of the signal of each said pickup, and b. said switch connections of said pickup switching system are made via programmable cross-point connections on plug-in boards with physically shorted cross points, whereby the order and phase of switching said pickup pairs can be easily changed with new pickups, pickup positions and pickup signal phases, to accommodate some desired progression in tone and timbre with switching direction.

18. A system for amplifying, distorting or analog predistortion in an electrified acoustic and string instrument, comprising:

a. an anti-parallel diode pair for shaping the input signal, Vs, into an input-output signal transfer function, similar to an italic-f, which can be shifted with respect to the input with a bias voltage, Vb, providing a distorted output signal, Vd, with respect to said Vs and said Vb, Vd(Vs, Vb), such that an unshifted version of said Vd, Vd(Vs,0), approximates a combination of said linear signal, Vs, plus the approximate cubic of said linear signal, $Vs^3$, and such that for non-zero values of said Vb, said Vd varies from said linear and cubic combination to a signal that approximates a combination of said linear signal, Vs, and its square, $Vs^2$, b. a mixer circuit which linearly and continuously combines said distorted signal, Vd, with the negative of said linear input signal, -Vs, so as to provide a predistorted output signal, Vdist, which varies continuously from a near-second harmonic of said Vs, $Vs_2$, and to a near-third harmonic of said Vs, $Vs_3$, with said $Vs_2$ and said $Vs_3$ respectively created by the cancellation of said Vs in said Vd, as it varies from said combination of said Vs and said $Vs^2$ to said combination of said Vs and said $Vs^3$, which Vdist is then combined with said Vs to create an output signal, Vo, which is a linear combination of said signals Vs, $Vs_2$ and $Vs_3$, which varies continuously in tonal character through said linear combination of said Vs, and its near-second and near-third harmonics, $Vs_2$ and $Vs_3$.

19. The system of claim 18 further comprising a multiple-gang potentiometer network to maintain the perceived amplitude of said Vdist within 6 decibels, by simultaneously controlling the level of said bias, Vb, the level of said Vd used by used by said mixer, and the levels of said $Vs_2$ and said $Vs_3$ provided by said mixer to produce said Vdist.

20. The system of claim 18, further comprising an automatic gain control, or AGC, which makes the amplitude of a duplicate of said Vs, which is used by said mixer to produce said $Vs^2$ and said $Vs^3$ and their linear combinations, constant over a range of at least 20 decibels in said Vs, such that said $Vs^2$ and said $Vs^3$ and their linear combinations are also constant in amplitude over said range of said Vs, and such that when said duplicate Vs is canceled from said $Vs^2$ and said $Vs^3$ by the mixer, said $Vs_2$ and said $Vs_3$ produced by said mixer are also constant in amplitude over said range of said input Vs.

21. The system of claim 18, wherein the circuit comprises separate diode pairs and mixers, in separate signal paths, to separately generate said near-second harmonic, $Vs_2$, of said Vs, and said near-third harmonic, $Vs_3$, of said Vs, such that for one given value of said Vs, all said signals and their linear combinations have amplitudes that produce similar perceived loudness in said output signal, Vo.

22. The system of claim 18, whereas the operating characteristics of said anti-parallel diode pair has an exponential dependence on the inverse of the operating temperature of said diodes, such that the control of said near-second harmonic and said near-third harmonic cannot be maintained over temperature changes, an embodiment of said electronic circuit in claim 18 wherein the component temperature of said anti-parallel diode pair is held constant by means of a resistive heater, comprised of:

a. a temperature measuring device thermally connected to both said diodes, b. a heating device, thermally connected to both said diodes, to raise the temperature of both said diodes above the highest anticipated operating temperature of said diodes without a heater, as determined experimentally by said temperature measuring device, and c. a controller to maintain the temperature of said diodes, said resistor and said temperature measuring device above said highest anticipated operating temperature, whereby the effects of said temperature dependence upon the character of said tonal and timbre output of said electronic circuit may be reduced.

* * * * *